US006458522B1

(12) United States Patent
Taniguchi et al.

(10) Patent No.: US 6,458,522 B1
(45) Date of Patent: Oct. 1, 2002

(54) SILVER HALIDE PHOTOGRAPHIC LIGHT-SENSITIVE MATERIAL AND PROCESSING METHOD THEREOF

(75) Inventors: Masahiko Taniguchi; Kohzaburoh Yamada; Ken-ichi Kuwabara; Tetsuo Yamaguchi, all of Minami-ashigara (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 0 days.

(21) Appl. No.: 09/663,944

(22) Filed: Sep. 18, 2000

(30) Foreign Application Priority Data

Sep. 17, 1999 (JP) ..... 11-264058
Sep. 17, 1999 (JP) ..... 11-264120

(51) Int. Cl.[7] ..... G03C 1/06

(52) U.S. Cl. ..... 430/543; 430/544; 430/546; 430/599; 430/600; 430/601; 430/607; 430/551

(58) Field of Search ..... 430/543, 544, 430/546, 599, 600, 601, 607, 551

(56) References Cited

U.S. PATENT DOCUMENTS 5,382,496 A 1/1995 Sakai et al.
5,972,577 A * 10/1999 Komatsu et al. ..... 430/401

FOREIGN PATENT DOCUMENTS

| | | | |
|---|---|---|---|
| JP | 5-045767 | * | 2/1993 |
| JP | A-5-232615 | | 9/1993 |
| JP | 6-175253 | * | 6/1994 |
| JP | A-10-39444 | | 2/1998 |
| JP | A-10-90841 | | 4/1998 |
| JP | 11-184099 | * | 7/1999 |

OTHER PUBLICATIONS

Patent Abstracts of Japan for JP–A–10–90841.
Patent Abstracts of Japan for JP–A–10–39444.
Patent Abstracts of Japan for JP–A–5–232615.

* cited by examiner

*Primary Examiner*—Janet Baxter
*Assistant Examiner*—Amanda C. Walke
(74) *Attorney, Agent, or Firm*—Sughrue Mion, PLLC

(57) ABSTRACT

A silver halide photographic light-sensitive material includes a compound selected from:

(1) a quaternary nitrogen or phosphorus salt compound, having 20 or more of total recurring units consisting of an ethyleneoxy group and/or a propyleneoxy group;

(2) a quaternary salt compound represented by formula (A):

wherein Q represents nitrogen or phosphorus, $R^1$, $R^2$ and $R^3$ represent an alkyl, aryl, alkenyl, alkynyl, or heterocyclic group, $L^1$ represents an alkylene group, Y represents —C(=O) or —$SO_2$—, $L^2$ represents a divalent connecting group having at least one hydrophilic group, $X^{n-}$ represents an n-valent counter anion, n being an integer of 1 to 3; and (3) a quaternary salt compound represented by formula (B):

wherein A represents an organic moiety necessary to complete a nitrogen-containing aromatic heterocyclic ring. $L^2$ represents a divalent connecting group having at least one hydrophilic group that divides $L^2$. $L^1$, Y and $X^{n-}$ have the same meanings as above.

19 Claims, No Drawings

SILVER HALIDE PHOTOGRAPHIC LIGHT-SENSITIVE MATERIAL AND PROCESSING METHOD THEREOF

FIELD OF THE INVENTION

The present invention relates to a silver halide photographic light-sensitive material and an image forming method using the light-sensitive material. Particularly, the present invention relates to a silver halide light-sensitive material that is used in the fields of graphic art, and to an image forming method to form a ultra-high contrast photographic image using the light-sensitive material.

BACKGROUND OF THE INVENTION

The photomechanical process in the field of graphic arts includes a process of converting a photographic original image in continuous gradation to a dot image. In order to improve reproduction of the image, a technique of forming an ultra-high contrast image has been used.

Image formation systems capable of obtaining ultra-high contrast photographic properties through development with a processing solution having good storage stability are disclosed, for example, in U.S. Pat. Nos. 4,166,742, 4,168,977, 4,221,857, 4,224,401, 4,243,739, 4,272,606, and 4,311,781. These methods are a system of forming an ultra-high contrast image by processing a silver halide light-sensitive material, having incorporated therein a specific acylhydrazine compound, with a developing solution containing 0.15 mole/liter or more of a sulfuric acid salt preservative and having a pH ranging from 11.0 to 12.3.

In order to complete a high-contrast image formation using hydrazine derivatives, it is necessary to process with a developing solution having a pH of 11 or more, usually 11.5 or more.

However, developing solutions having a high pH value of pH 11 or more, even though they contain preservatives, are prone to air oxidation and are unstable. Therefore, such a developing solution needs a large amount of replenishment in order to maintain good photographic properties in running use over a long period of time. An image formation system capable of obtaining an ultra-high contrast image, even in a processing with a developing solution having a pH of less than 11, in order to compensate for such a defect, is disclosed as described below. For example, the development of hydrazine derivatives capable of minimizing the variation width of photographic properties ascribable to the change in the pH of the developing solution, the use of a nucleation development accelerator for acceleration of hard gradation enhancement, or the like is attempted, to achieve such an image formation system.

For example, JP-A-62-222241 (the term "JP-A-" as used herein means an unexamined published Japanese patent application), JP-A-62-250439, JP-A-62-280733, and the like disclose nucleation accelerators for acceleration of hard gradation enhancement. A high-contrast image showing a certain level of photographic properties can indeed be attained by incorporating these nucleation accelerators, in combination with a specific hydrazine derivative, in a light-sensitive material. However, light-sensitive materials prepared by such a previous method are not fully satisfactory, in view of deterioration of dot image quality, because they cause a sand-like or spot-like fogging, so-called "black spots," which are made of fine developed silver, at the non-image portion that is not exposed.

The black spots are apt to occur when, particularly by aerial oxidation of a developing solution, a rise in pH of the solution, and/or a reduction in the concentration of sulfuric acid therein, is caused.

JP-A-1-179939 and JP-A-1-179940 describe a method of processing a light-sensitive material containing a nucleation development accelerator having a group adsorptive onto silver halide emulsion particles and a nucleating agent having the same adsorptive group, with a developing solution having a pH of 11 or less. U.S. Pat. No. 4,975,354 discloses that an effect on acceleration of hard gradation enhancement can be attained by processing a light-sensitive material containing a secondary or tertiary amine compound having a repeating unit of ethylene oxide in combination with a hydrazine compound, with a developing solution having a pH of 11.4.

JP-A-6-242534 discloses a method of forming a high-contrast image that shows a gamma value of 10 or more, by processing a light-sensitive material containing a bis-type heterocyclic N-quaternary onium salt and a hydrazine compound, with a developing solution having a pH of 11 or less.

Further, JP-A-10-90841 describes bispyridinium salt development accelerators in which pyridinium moieties are connected via an alkylene group. However, it is also difficult to obtain satisfactory high-contrast photographic properties by using these compounds with a developing solution having a low pH in particular. Further, JP-A-10-90841 and JP-A-10-39444 disclose bispyridinium salt and bis-isoquinolinium salts, each of which has a recurring unit of 4 to 18 ethyleneoxy groups. However, the compounds disclosed therein fail to reach a satisfactory level, even though somewhat high-contrast photographic properties can be attained thereby.

SUMMARY OF THE INVENTION

Accordingly, a first object of the present invention is to provide a silver halide photographic light-sensitive material that has improved photographic properties. A secondary object of the present invention is to provide a silver halide photographic light-sensitive material that is capable of obtaining photographic properties of high-contrast negative gradation having a gamma ($\gamma$) value exceeding 10, by the use of a stable developing solution, and further that is excellent in image quality. A third object of the present invention is to provide a silver halide photographic light-sensitive material that is excellent in reproducibility of an original. A fourth object of the present invention is to provide a silver halide photographic light-sensitive material showing, in addition to the foregoing, less variation in sensitivity, $\gamma$ value, and Dmax, without increasing black spots, even though the light-sensitive material is processed with a developing solution in which the concentration of sulfurous acid preservative has been reduced, or in which the pH value has been changed, due to fatigue over time, or a developing solution in which the pH value has been changed and/or the bromide ion concentration has been increased by processing a large amount of films. Further, a fifth object of the present invention is to provide a processing method of a silver halide photographic light-sensitive material, which method is capable of obtaining a negative image having an ultrahigh contrast and improved photographic properties, by use of a developing solution having a lower pH than the previous pH which has been used in the past.

Other and further objects, features, and advantages of the invention will appear more fully from the following description.

DETAILED DESCRIPTION OF THE INVENTION

The foregoing objects of the present invention have been achieved with the following constructions of (1) to (7).

(1) A silver halide photographic light-sensitive material comprising at least a light-sensitive silver halide emulsion layer applied on a support, wherein said emulsion layer or another hydrophilic colloidal layer comprises at least one kind of compounds selected from a group consisting of a quaternary nitrogen or phosphorus salt compound, having 20 or more of total recurring units consisting of an ethyleneoxy group and/or a propyleneoxy group in a molecule; a quaternary salt compound represented by the following formula (A); and a quaternary salt compound represented by the following formula (B):

formula (A)

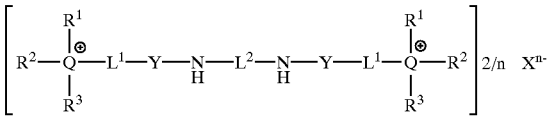

wherein Q represents a nitrogen atom or a phosphorus atom, $R^1$, $R^2$ and $R^3$ each independently represent an alkyl group, an aryl group, an alkenyl group, an alkynyl group, or a heterocyclic group, $L^1$ represents an alkylene group, Y represents —C(=O) or —$SO_2$—, $L^2$ represents a divalent connecting group having at least one hydrophilic group, $X^{n-}$ represents an n-valent counter anion, and n represents an integer of 1 to 3, provided that $X^{n-}$ can be omitted when another anionic group exists in a molecule and forms an intramolecular salt with $P^+$ or a quaternary nitrogen atom, formula (B)

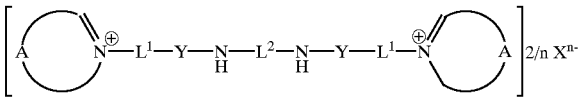

wherein A represents an organic moiety necessary to complete a nitrogen-containing aromatic heterocyclic ring, provided that the nitrogen-containing aromatic heterocyclic ring formed by A may have a substituent, but the substituent having thereon a primary hydroxyl group is excluded. $L^1$, Y, $L^2$ and $X^{n-}$ each have the same meanings as those of the formula (A).

(2) The silver halide photographic light-sensitive material as described in (1), wherein the nitrogen-containing aromatic heterocyclic ring formed by A in the quaternary salt compound represented by formula (B) is 4-phenylpyridine, quinoline or isoquinoline.

(3) The silver halide photographic light-sensitive material as described in (1), wherein the quaternary nitrogen or phosphorus salt compound having the total of 20 or more recurring units consisting of an ethyleneoxy group and/or a propyleneoxy group in a molecule, is represented by any one of the following formulae (I) to (IV):

(I)

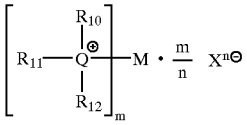

(II)

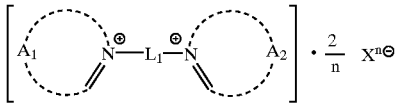

(III)

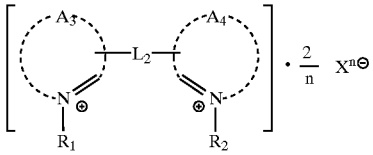

(IV)

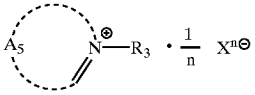

in formula (I), Q represents a nitrogen atom or a phosphorus atom, $R_{10}$, $R_{11}$ and $R_{12}$ each represent an aliphatic group, an aromatic group, or a heterocyclic group, these groups may combine with each other to form a ring structure, M represents an m-valent organic group in which a carbon atom bonds to $Q^+$, m represents an integer of 1 to 4;

in formulae (II), (III) and (IV), $A_1$, $A_2$, $A_3$, $A_4$ and $A_5$ each represent an organic moiety necessary to complete a quaternary nitrogen-containing unsaturated heterocyclic ring, $L_1$ and $L_2$ each represent a divalent connecting group, $R_1$, $R_2$ and $R_3$ each independently represent a substituent;

in formulae (I), (II), (III) and (IV), $X^{n-}$ represents an n-valent counter anion, n represents an integer of 1 to 3, provided that $X^{n-}$ can be omitted when another anionic group exists in a molecule and forms an intramolecular salt with $Q^+$ or a quaternary nitrogen atom;

the quaternary salts represented by formulae (I), (II), (III) and (IV) each have 20 or more of total recurring units consisting of an ethyleneoxy group and/or a propyleneoxy group in each of their molecules, said recurring units may be present at plural portions in the molecule.

(4) The silver halide photographic light-sensitive material as described in (3), wherein the quaternary salt compound is a compound represented by the formula (II) or (III).

(5) The silver halide photographic light-sensitive material as described in any one of (1) to (4), wherein said silver halide emulsion layer comprises at least one kind of hydrazine derivatives.

(6) The silver halide photographic light-sensitive material as described in (5), wherein a second silver halide emulsion layer which is different from the first silver halide emulsion layer containing the hydrazine derivatives, or another hydrophilic colloidal layer, comprise a redox compound capable of releasing a development inhibitor by oxidization.

(7) A processing method of a silver halide photographic light-sensitive material, which comprises processing the silver halide photographic light-sensitive material as described in any one of (1) to (6) with a developing solution having a pH of less than 11.0, thereby forming an ultrahigh contrast negative image.

The quaternary salt compounds for use in the present invention are described in detail below.

Examples of the aliphatic groups represented by $R_{10}$, $R_{11}$ and $R_{12}$ in the formula (I) include straight-chain or branched alkyl groups such as a methyl group, ethyl group, propyl group, isopropyl group, butyl group, isobutyl group, sec-butyl group, tert-butyl group, octyl group, 2-ethylhexyl group, dodecyl group, hexadecyl group and octadecyl group; aralkyl groups such as a substituted or unsubstituted benzyl group; cycloalkyl groups such as a cyclopropyl group, cyclopentyl group and cyclohexyl group; alkenyl groups such as an aryl group, vinyl group and 5-hexenyl group; cycloalkenyl groups such as a cyclopentenyl group and cyclohexenyl group; and alkynyl groups such as a phenylethynyl group. Examples of the aromatic group include aryl groups such as a phenyl group, naphthyl group and phenanthryl group. Examples of the heterocyclic group include a pyridyl group, quinolyl group, furyl group, imidazolyl group, thiazolyl group, thiadiazolyl group, benzotriazolyl group, benzothiazolyl group, morpholyl group, pyrimidyl group and pyrrolidyl group.

Examples of the substituent substituted on these groups include the groups represented by $R_{10}$, $R_{11}$ and $R_{12}$, halogen atoms (such as a fluorine atom, chlorine atom, bromine atom and iodine atom), nitro groups, (alkyl or aryl)amino groups, alkoxy groups, aryloxy groups, (alkyl or aryl)thio groups, carbonamide groups, carbamoyl groups, ureido groups, thioureido groups, sulfonylureido groups, sulfonamide groups, sulfamoyl groups, hydroxyl groups, sulfonyl groups, carboxyl groups (including carboxylato groups), sulfo groups (including sulfonato groups), cyano groups, oxycarbonyl groups, acyl groups, and heterocyclic groups (including heterocyclic groups containing a quaternary nitrogen atom). These substituents may be further substituted with these substituents.

The groups represented by $R_{10}$, $R_{11}$ and $R_{12}$ of the formula (I) may be combined with each other to form a cyclic structure.

Examples of the group represented by M in the formula (I) include groups having the same meanings as $R_{10}$, $R_{11}$ or $R_{12}$ when m represents 1. When m represents an integer of 2 or more, M represents a connecting group with m valences which connects to $Q^+$ by a carbon atom contained in M. Specifically, M represents an m-valent connecting groups which are formed by combining groups such as an alkylene group, arylene group, heterocyclic group, with a —CO— group, —O— group, —N($R_N$)— group, —S— group, —SO— group, —$SO_2$— group, or —P═O— group ($R_N$ represents a hydrogen atom or a group having the same meaning as $R_{10}$, $R_{11}$ or $R_{12}$. When plural $R_N$S are present in a molecule, they may be the same or different and further they may be combined with each other). M may have an optional substituent. Examples of the optional substituent include the same substituents as those which the group represented by $R_{10}$, $R_{11}$ or $R_{12}$ may have.

In the formula (I), $R_{10}$, $R_{11}$ and $R_{12}$ are preferably groups having 20 or less carbon atoms. When Q represents a phosphorous atom, $R_{10}$, $R_{11}$ and $R_{12}$ are particularly preferably aryl groups having 15 or less carbon atoms. When Q represents a nitrogen atom, they are particularly preferably alkyl, aralkyl, or aryl groups, having 15 or less carbon atoms. Preferably, m is 1 or 2. When m represents 1, M is preferably a group having 20 or less carbon atoms and particularly preferably an alkyl, aralkyl or aryl group, having a total carbon number of 15 or less. When m represents 2, the divalent organic group represented by M is preferably an alkylene group, arylene group, or a divalent group which is formed by combining these groups with a —CO— group, —O— group, —N($R_N$)— group, —S— group, or $SO_2$— group ($R_N$ is the same meanings as the above $R_N$) . When m represents 2, M is preferably a divalent group that connects to $Q^+$ by a carbon atom contained in M and that has a total carbon number of 20 or less. In addition, the preferable range of the total carbon number is not limited to the above range, when M, or $R_{10}$, $R_{11}$ or $R_{12}$ contains plural repeating units of an ethyleneoxy group or propyleneoxy group. Also, when m represents an integer of 2 or more, $R_{10}$, $R_{11}$ and $R_{12}$ are each present in plural in a molecule. In this case, these plural $R_{10}$s, $R_{11}$s or $R_{12}$s may be the same or different respectively.

The quaternary salt compound represented by the formula (I) has 20 or more repeating units of an ethyleneoxy or propyleneoxy group in total in its molecule. These repeating units either may be substituted on one position or may be substituted so as to extend over plural positions. When m represents an integer of 2 or more, more preferably the connecting group represented by M has 20 or more repeating units of an ethyleneoxy or propyleneoxy group.

In the formula (II) or (III) , $A_1$, $A_2$, $A_3$, and $A_4$ respectively represent an organic moiety necessary to form a substituted or unsubstituted unsaturated heterocyclic ring that contains a quaternary nitrogen atom. The organic moiety may contain a carbon atom, oxygen atom, nitrogen atom, sulfur atom, and hydrogen atom. The heterocyclic ring may be further condensed with a benzene ring.

Examples of the unsaturated hetero ring formed by $A_1$, $A_2$, $A_3$ and $A_4$ include a pyridine ring, quinoline ring, isoquinoline ring, imidazole ring, thiazole ring, thiadiazole ring, benzotriazole ring, benzothiazole ring, pyrimidine ring and pyrazole ring. A pyridine ring, a quinoline ring, and an isoquinoline ring are particularly preferable.

The unsaturated hetero ring which $A_1$, $A_2$, $A_3$ and $A_4$ form in combination with a quaternary nitrogen atom may have a substituent. Examples of the substituent in this case include the same substituents as those which the group represented by $R_{10}$, $R_{11}$ or $R_{12}$ may have. Preferable examples of the substituent include halogen atoms (particularly a chlorine atom); and aryl groups, (preferably a phenyl group), alkyl groups, carbamoyl groups, (alkyl or aryl) amino groups, oxycarbonyl groups, alkoxy groups, aryloxy groups, (alkyl or aryl)thio groups, hydroxy groups, carbonamide groups, sulfonamide groups, sulfo groups (including sulfonato groups), and carboxyl groups (including carboxylato groups), which have 20 or less carbon atoms. Particularly preferable examples include phenyl groups, alkylamino groups, carbonamide groups and a chlorine atom and most preferable examples include phenyl groups. Specifically, in the formula (II), the most preferable heterocylic groups which $A_1$ and $A_2$ form are 4-phenylpyridine.

The divalent connecting groups represented by $L_1$ or $L_2$ are preferably those constituted by singly, an alkylene group, arylene group, alkenylene group, alkynylene group, divalent heterocyclic group, —$SO_2$—, —SO—, —O—, —S—, —N($R_N$')— (wherein $R_N$' represents an alkyl group, aralkyl group, aryl group, or hydrogen atom), —C(═O)—, or —P(═O)— ; or by a combination of these groups. The divalent connecting groups represented by $L_1$ or $L_2$ may have an optional substituent. Examples of the substituent include the same substituents as those which the group represented by $R_{10}$, $R_{11}$ or $R_{12}$ may have. Particularly preferable examples of $L_1$ or $L_2$ include those constituted by singly, the alkylene group, the arylene group, —C(═O)—, —O—, —S—, —$SO_2$ or —N($R_N$'), or by a combination of these groups.

$R_1$ or $R_2$ is preferably an alkyl or aralkyl group, having 1 to 20 carbon atoms, and $R_1$ and $R_2$ may be the same or different. $R_1$ or $R_2$ may have a substituent. Examples of the substituent include the same substituents as those which the group represented by $R_{10}$, $R_{11}$ or $R_{12}$ may have. Particularly preferably, $R_1$ and $R_2$ respectively are an alkyl or aralkyl group, having 1 to 10 carbon atoms. Preferable examples of the substituent include carbamoyl groups, oxycarbonyl groups, acyl groups, aryl groups, sulfo groups (including sulfonato groups), carboxyl groups (including carboxylato groups), hydroxy groups, (alkyl or aryl)amino groups, and alkoxy groups.

In addition, the preferrable range of the total carbon number is not limited to the above range, when $R_1$ or $R_2$ contains plural repeating units of an ethyleneoxy group or propyleneoxy group.

The quaternary salt compound represented by the formula (II) or (III) has 20 or more repeating units of an ethyleneoxy or propyleneoxy group in total in its molecule. Although these repeating units may be substituted either on one position or on plural positions and may also be substituted on any of $A_1$, $A_2$, $A_3$, $A_4$, $R_1$, $R_2$, $L_1$ and $L_2$, preferably the connecting group represented by $L_1$ or $L_2$ has a total of 20 or more repeating units of an ethyleneoxy or propyleneoxy group.

In formula (IV), $A_5$ represents an organic moiety capable of forming an unsaturated heterocyclic ring with a quaternary nitrogen atom. $R_3$ represents a substituent.

The nitrogen-containing unsaturated ring composed of $A_5$ may contain a carbon atom, a hydrogen atom, an oxygen atom, or a sulfur atom, in addition to the nitrogen atom, may be further condensed with a benzene ring, further may have a substituent. Examples of the hetero ring include the same as those of the nitrogen-containing unsaturated ring composed of $A_1$, $A_2$, $A_3$, or $A_4$ of formulae (II) and (III). The preferred range is also the same. Among them, pyridine, quinoline and isoquinoline rings are specifically preferred.

When the nitrogen-containing unsaturated ring composed of $A_5$ has a substituent, examples of the substituent is the same as the substituent which the nitrogen-containing unsaturated ring composed of $A_1$, $A_2$, $A_3$ or $A_4$ of formulae (II) and (III) may have. The preferred range is also the same.

Preferably, $R_3$ represents an alkyl group or an aralkyl group, which may be unsubstituted or substituted with a substituent, and straight-chain, branched, or cyclic. Examples of the foregoing substituent are the same as the substituent that the groups represented by $R_1$ and $R_2$ of formula (III) may have. The preferred range is also the same. Among them, especially preferred are a carbamoyl group, an oxycarbonyl group, an acyl group, an aryl group, a sulfo group including sulfonato, a carboxyl group including carboxylato, an (alkyl or aryl)amino group, and an alkoxy group.

The quaternary salt compound represented by the formula (IV) has a total of 20 or more repeating units of an ethyleneoxy or propyleneoxy group in its molecule. Although these repeating units may be substituted either on one position or on plural positions and may also be substituted on any of $A_5$ and $R_3$, preferably the group represented by $R_3$ has a total of 20 or more repeating units of an ethyleneoxy or propyleneoxy group.

In the formula (I), (II), (III) and (IV), $X^{n-}$ is a counter anion that has a negative charge capable of neutralizing a positive charge existing on the quaternary salt. n represents an integer of 1 to 3. $X^{n-}$ may be an inorganic acid ion or an organic acid ion. As the inorganic acid ion, halide ions such as a chloride ion and a bromide ion, a sulfuric acid ion, a phosphoric acid ion, a nitric acid ion, or the like can be used. As the organic acid ion, carboxylate ions such as an acetate ion, oxalate ion, fumarate ion and benzoate ion, sulfo ions such as a methane sulfonic acid ion, a p-toluene sulfonate, a naphthalene disulfonic acid ion, or the like can be used.

As the counter anion represented by $X^{n-}$, a halide ion, carboxylate ion, sulfo ion or sulfuric acid ion is preferable. Preferably n is 1 or 2. As $X^{n-}$, a chloride ion or bromide ion is particularly preferable and a chloride ion is most preferable.

However, $X^{n-}$ can be omitted when another anionic group exists in a molecule and forms an intramolecular salt with $P^+$ or a quaternary nitrogen atom.

The quaternary salt compounds represented by the formulae (I), (II), (III) and (IV) may include an ethyleneoxy group and a propyleneoxy group repeatedly at the same time. In the case of including plural repeating units of an ethyleneoxy or propyleneoxy group, the number of repetitions may be given either by taking one value strictly or as an average. In the latter case, the quaternary salt compound is a mixture having a certain degree of distribution of molecular weight.

In the present invention, the case of having a total of 20 or more repeating units of an ethyleneoxy group is more preferable and the case of having 20 to 67 repeating units of an ethyleneoxy group in total is most preferable.

In the present invention, among quaternary salts represented by formulae (I), (II), (III) and (IV), those represented by formulae (II) or (III) are preferred. Among them, those represented by formula (II) are more preferred. In formula (II), it is preferable that a connecting group represented by L1 has 20 or more of recurring units of the ethyleneoxy group. Further, it is most preferable that a connecting group represented by L1 has from 30 to 67 in total of recurring units of the ethyleneoxy group. If the total number of the recurring units exceed the above range, a synthesis of the compound will become complicated.

Next, specific examples of the quaternary salt compounds for use in the present invention will be shown (in the following formulae, Me, Bu, and Ph each represents methyl, butyl, and phenyl groups, respectively.). The present invention is not limited by the following compound examples.

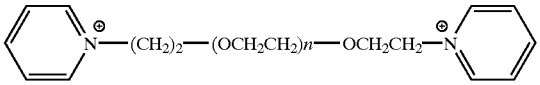

$2Cl^{\ominus}$

I-1 n = 20
I-2 30
I-3 average 21
I-4 average 33
I-5 average 44

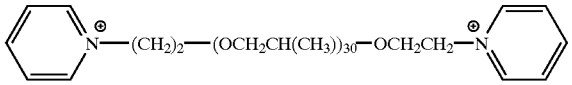

$2Cl^{\ominus}$

I-6 n = 20
I-7 30
I-8 average 21
I-9 average 33
I-10 average 44

-continued
I-11
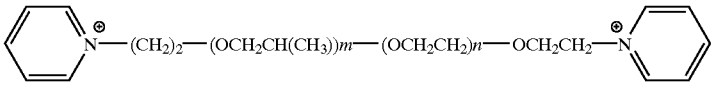
2Cl⊖ m + n = 20
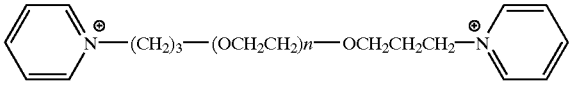
2Cl⊖
I-12 n = 20
I-13 30
I-14 average 21
I-15 average 33
I-16 average 44
I-17
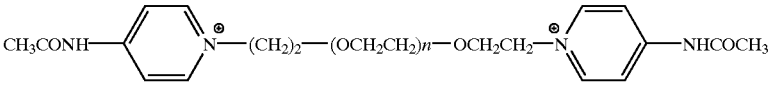
2Br⊖ n: average 21
I-18
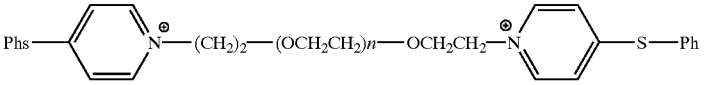
2CH3SO3⊖ n: average 21
I-19
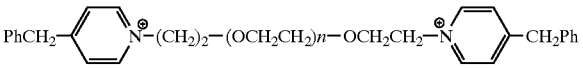
2 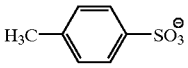 n: average 32
I-20
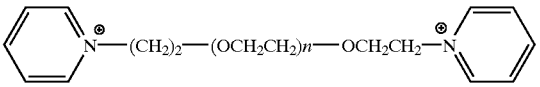
⊖OOC—COO⊖ n: average 43
I-21
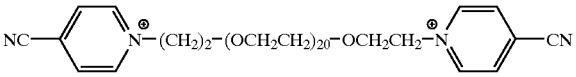
2Cl⊖
I-22
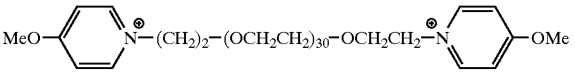
2Cl⊖
I-23
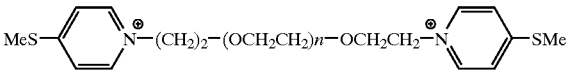
2Cl⊖ n: average 62
I-24
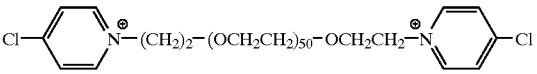
2Cl⊖
I-25
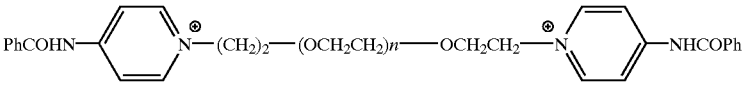
2Cl⊖ n: average 43
I-26
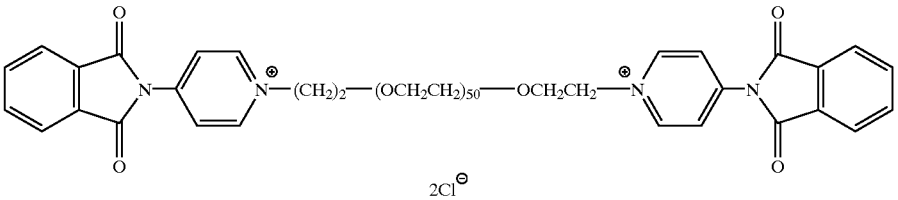
2Cl⊖

-continued
I-27
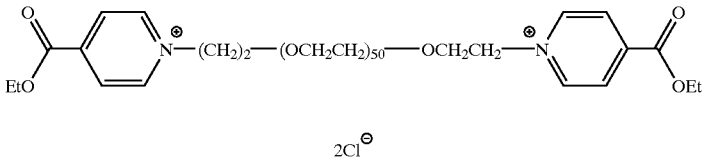
I-28
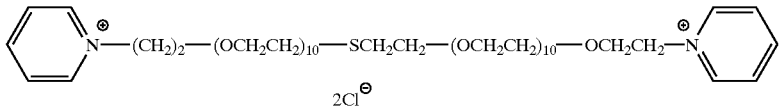
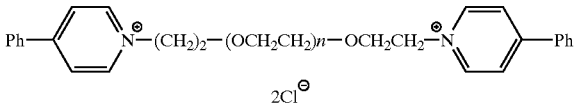
| | |
|---|---|
| I-29 | n = 20 |
| I-30 | 30 |
| I-31 | average 21 |
| I-32 | average 32 |
| I-33 | average 43 |
| I-34 | average 66 |
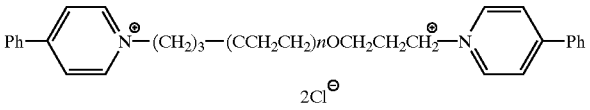
| | |
|---|---|
| I-35 | n = 20 |
| I-36 | 30 |
| I-37 | average 21 |
| I-38 | average 32 |
| I-39 | average 43 |
| I-40 | average 67 |
I-41
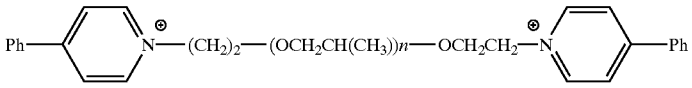
n = average 62
I-42
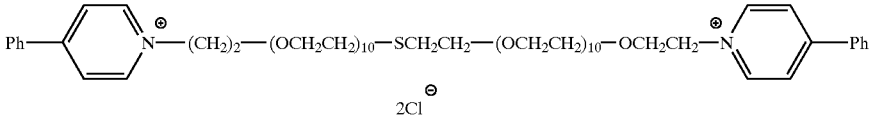
I-43
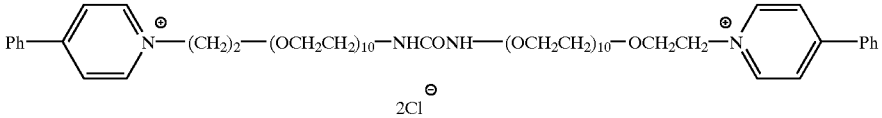
I-44
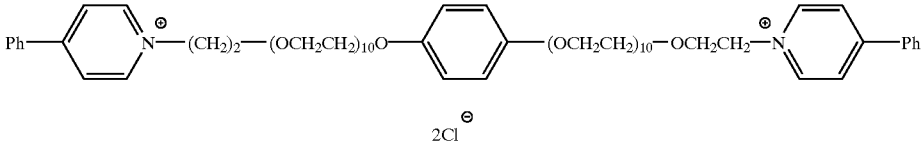
I-45
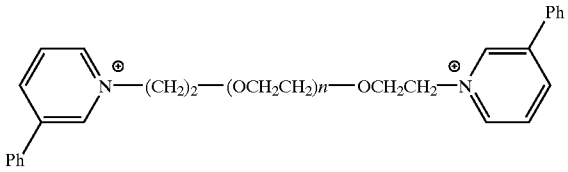
n: average 43
I-46
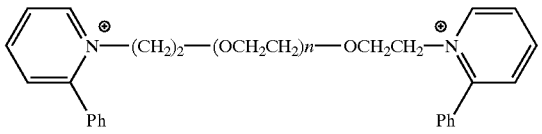
*n*: average 66

-continued
I-47
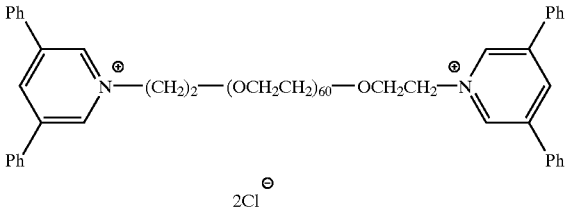
I-48 n = 20
I-49 30
I-50 average 21
I-51 average 32
I-52 average 43
I-53 average 66
I-60
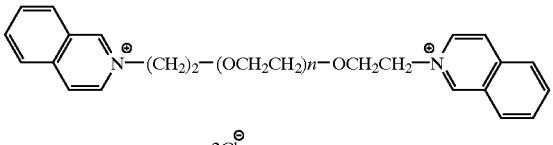
I-54 n = 20
I-55 30
I-56 average 21
I-57 average 32
I-58 average 43
I-59 average 66
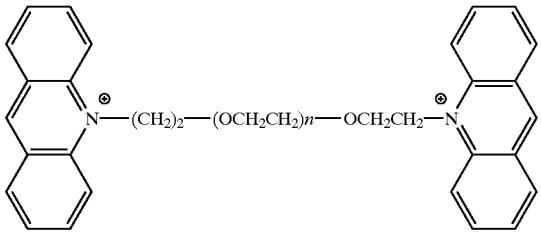
n : average 21
I-61
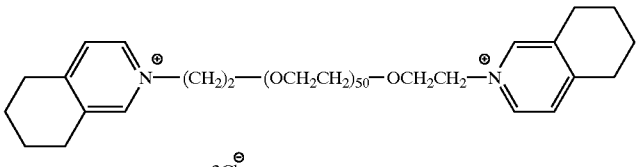
I-62
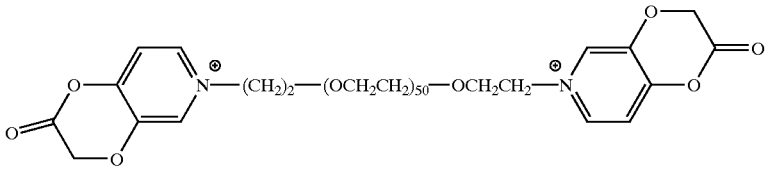
I-63
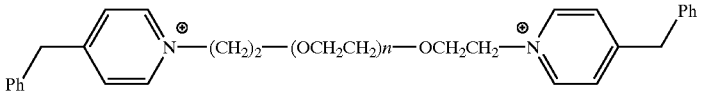
n = average 43
I-64
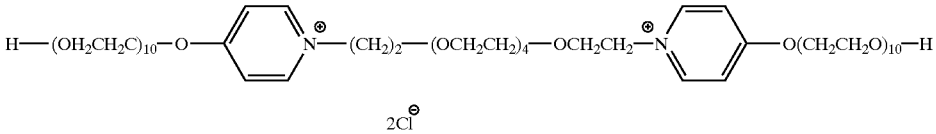
I-65
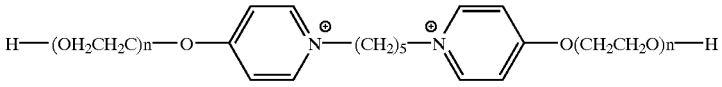
n : average 20

-continued
I-66
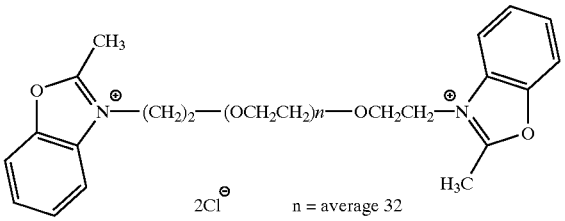
n = average 32
I-67
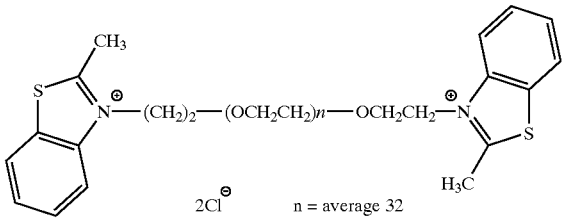
n = average 32
I-68
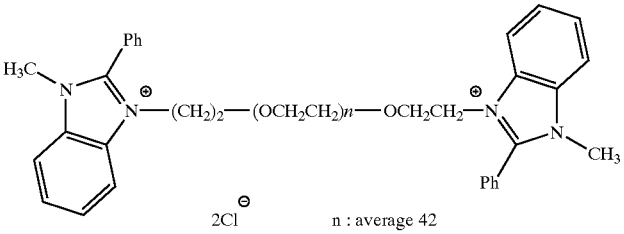
n : average 42
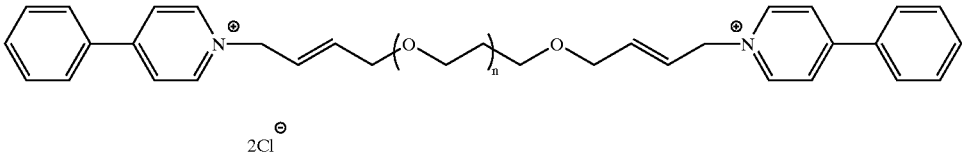
I-69 n = 20
I-70 30
I-71 average 33
I-72 average 44
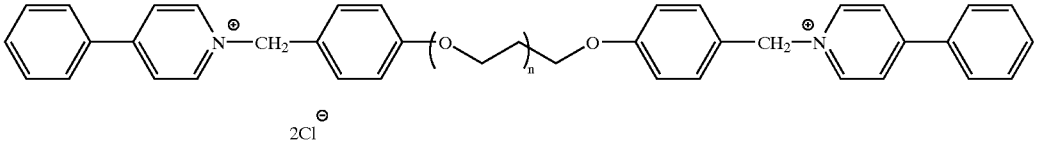
I-73 n = 20
I-74 30
I-75 average 44
I-76 average 64
I-77
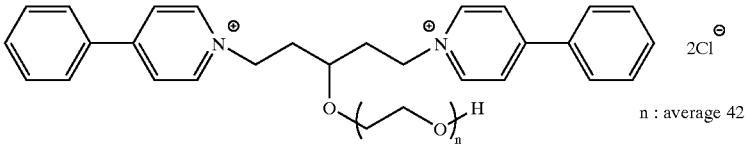
n : average 42
I-78
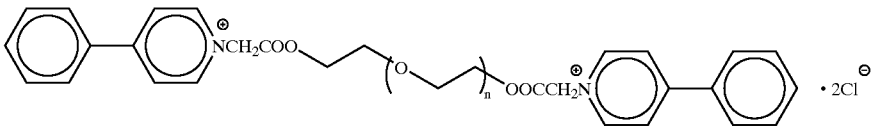
n = 20
I-79
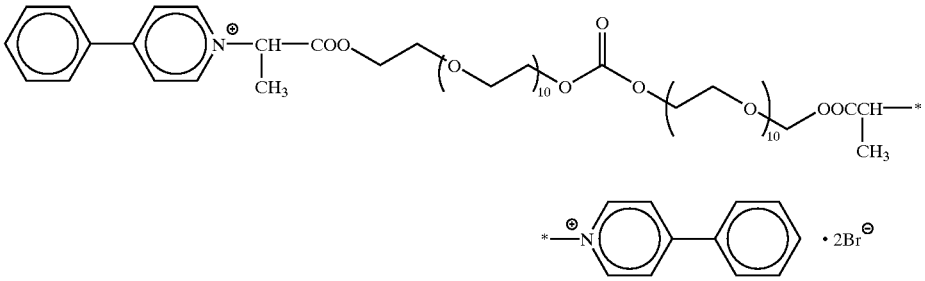

-continued
I-80
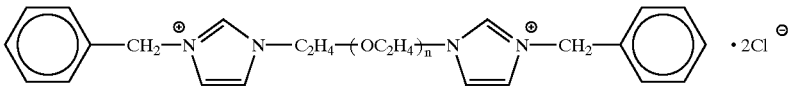
n ≈ 43
I-81
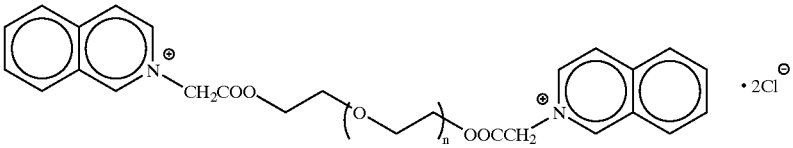
n ≈ 67
II-1
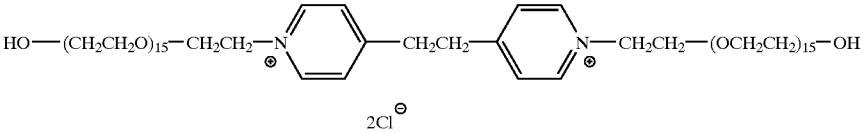
II-2
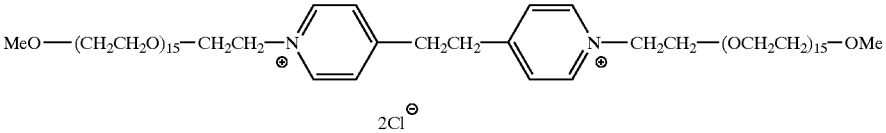
II-3
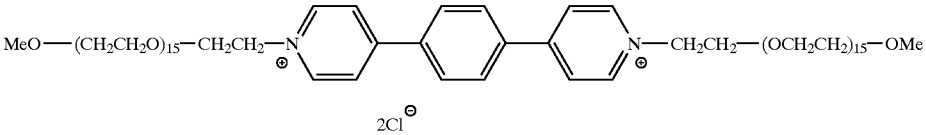
II-4
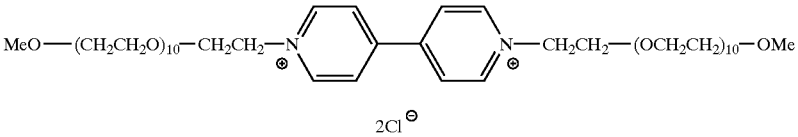
II-4
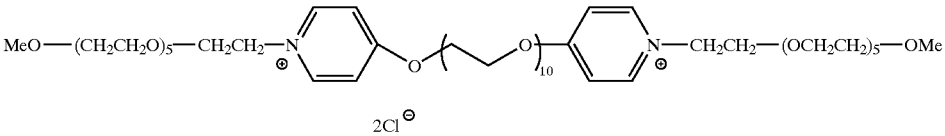
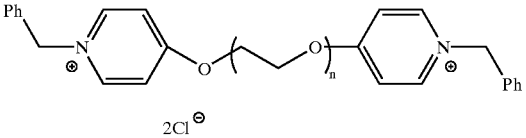
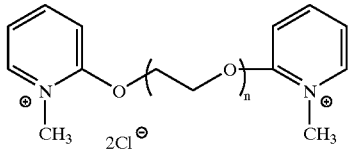
II-5 n = 20
II-6 30
II-7 40
II-8 average 33
II-9 average 44
II-10 n = 20
II-11 30
II-12 average 33
II-13 average 44

-continued
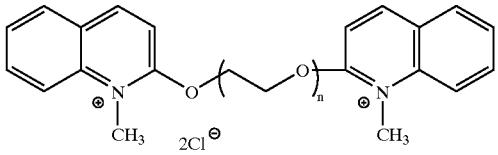
II-14 n = 20
II-15 30
II-16 average 33
II-17 average 44
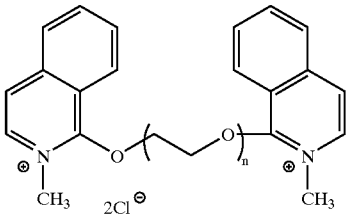
II-18 n = 20
II-19 30
II-20 average 33
II-21 average 44
II-22
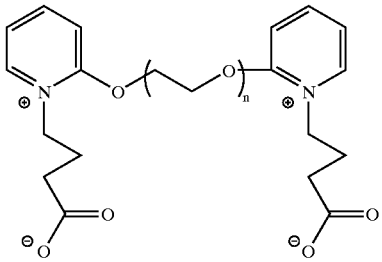
n : average 45
II-23
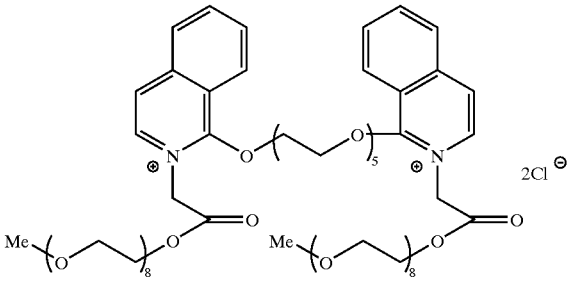
II-24
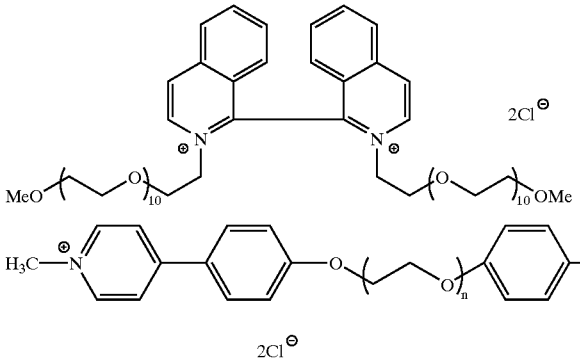
II-25
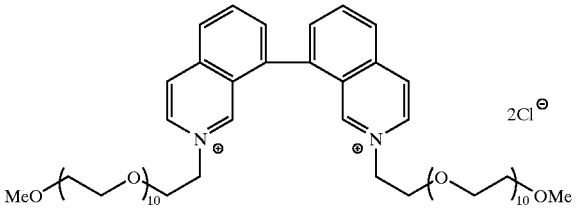
II-26 n = 20
II-27 average 33
II-28 average 44
II-29
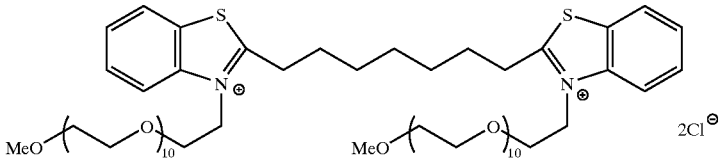
II-30
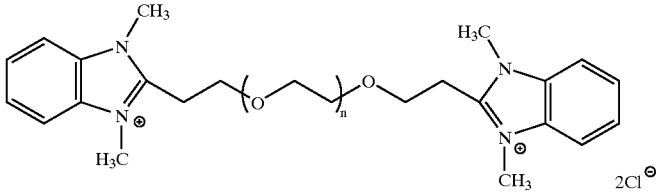
n : average 43

-continued
II-31
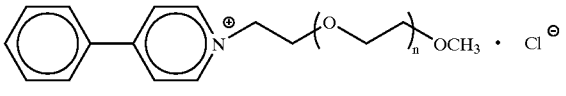
n ≈ 33
II-32
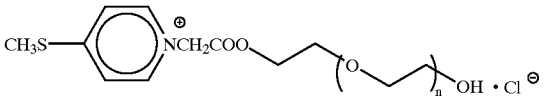
n ≈ 67
II-33
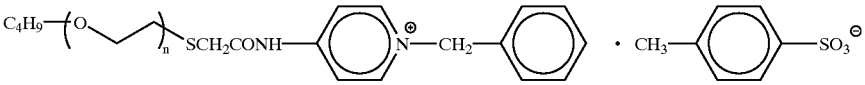
n = 30
II-34
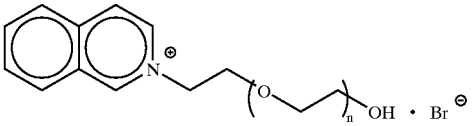
n ≈ 43
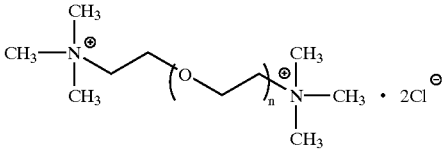
II-35 n = 20
II-36 n ≈ 43
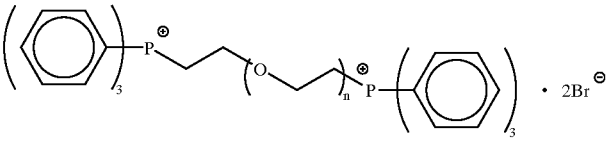
II-37 n = 20
II-38 n ≈ 33
II-39 n ≈ 43
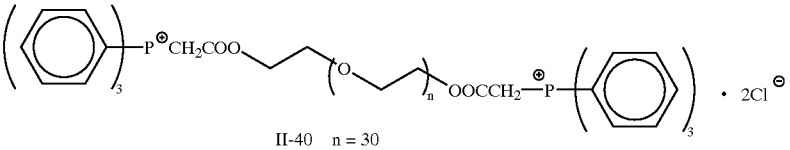
II-40 n = 30
II-41 n ≈ 67
II-42
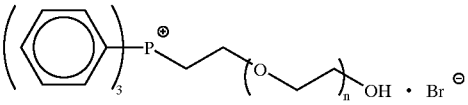
n ≈ 43
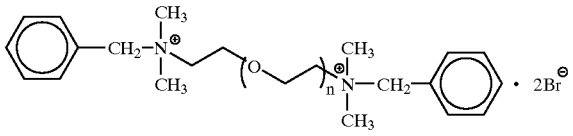
II-43 n = 20
II-44 n = 30
II-45 n ≈ 43
II-46
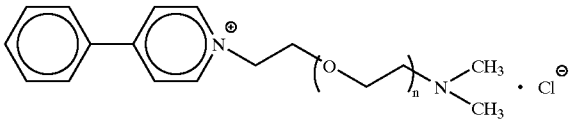
n = 20
II-47
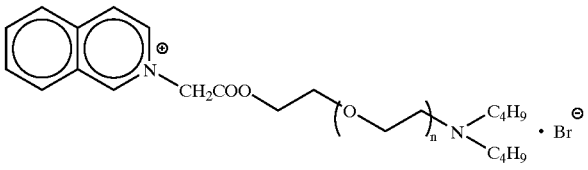
n ≈ 42
II-48
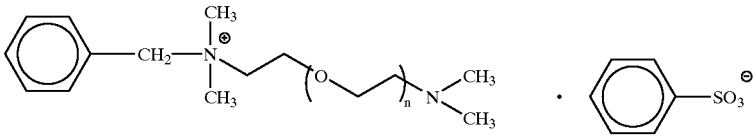
n = 30

-continued

II-49

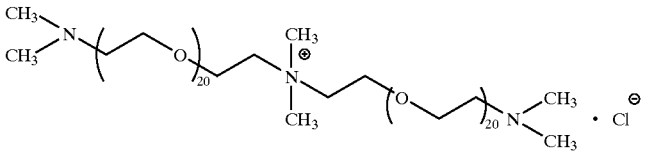

II-50

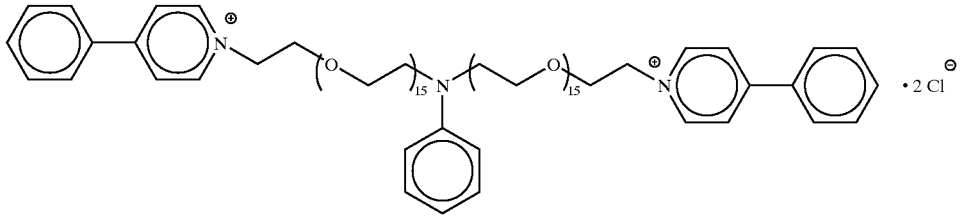

The quaternary salt compounds for use in the present invention can be synthesized with ease by known methods. Synthesis examples of these compounds will be shown below.

Synthesis Example 1

(Synthesis of the Exemplified Compound I-33)

A polyethylene glycol (average molecular weight: 2000, 800 g), thionyl chloride (584 ml) and DMF (4 ml) were mixed at ambient temperature and the mixture was heated to 90° C. and stirred for 5 hours. After excess thionyl chloride was removed, 4-phenylpyridine (372 g) was added to the mixture, which was then reacted at 150° C. for 7 hours. An ethyl acetate/2-propanol (10:1) solution of the reaction mixture was prepared and cooled. The precipitated solid was collected by filtration and dried to obtain the target exemplified compound I-33 (584 g, yield: 62%).

Synthesis Example 2

(Synthesis of the Exemplified Compound I-58)

A polyethylene glycol (average molecular weight: 2000, 10 g), thionyl chloride (7.3 ml) and DMF (0.1 ml) were mixed at ambient temperature and the mixture was heated to 90° C. and stirred for 5 hours. After excess thionyl chloride was removed, isoquinoline (4.0 g) was added to the mixture, which was then reacted at 150° C. for 7 hours. An ethyl acetate/2-propanol (10:1) solution of the reaction mixture was prepared and cooled. The precipitated solid was collected by filtration and dried to obtain the target exemplified compound I-58 (7.1 g, yield: 60%).

Synthesis Example 3

(Synthesis of the Exemplified Compound I-34)

The exemplified compound I-34 was prepared in the same manner as in the above Synthesis Example 1 except that a polyethylene glycol (average molecular weight: 3000) was used in place of the polyethylene glycol (average molecular weight: 2000).

Next, the quaternary salt compounds represented by formula (A) for use in the present invention are described in detail below.

Q represents a nitrogen atom or a phosphorus atom. $R^1$, $R^2$ and $R^3$ that are substituents on Q, each independently represent an alkyl group, an aryl group, an alkenyl group, an alkynyl group, or a heterocyclic group. These groups may combine with each other to form a cyclic structure. These groups may be further substituted with the above-described groups, or other substituents described below. Namely, as the substituent, there are a hydroxyl group, an acyloxy group, a halogen atom, an alkoxy group, an aryloxy group, an alkylthio group, an arylthio group, an acyl group, an (alkyl or aryl)oxy carbonyl group, a sulfo group including sulfonato, a carboxyl group including carboxylato, a mercapto group, a carbonamide group, a sulfonamide group, a sulfamoyl group, a carbamoyl group, an ureido group, a thioureido group, an (alkyl or aryl)amino group, a cyano group, a nitro group, etc.

In formula (A), when Q is a nitrogen atom, preferable groups of $R^1$, $R^2$ and $R^3$ are an alkyl group, or an aryl group, more preferably an alkyl group. When Q is a phosphorus atom, preferable groups of $R^1$, $R^2$ and $R^3$ are an alkyl group, an aryl group or a heterocyclic group, more preferably an aryl group. Generally, it is preferable that $R^1$, $R^2$ and $R^3$ each have 30 or less carbon atoms.

Preferable examples of the substituent which these groups may have, include an alkyl group, an aryl group, a heterocyclic group, an acyloxy group, a halogen atom, an alkoxy group, an aryloxy group, an alkylthio group, an arylthio group, an acyl group, an (alkyl or aryl)oxycarbonyl group, a mercapto group, a carbonamido group, a sulfonamido group, a sulfamoyl group, a carbamoyl group, an ureido group, a thioureido group, an (alkyl or aryl)amino group, a cyano group and a nitro group.

More preferable examples include an alkyl group, an aryl group, a heterocyclic group, a halogen atom, an alkoxy group, an aryloxy group, an alkylthio group, an arylthio group, and a cyano group.

The group represented by $L^1$ is described below.

In the formulae (A) and (B), $L^1$ represents an alkylene group. The alkylene group has preferably 1 to 20 carbon atoms, and may be a straight-chain, branched, and/or comprising cyclic structure. Also, the alkylene group may be not only a saturated alkylene group, for example, an ethylene group, but also a alkylene group containing an unsaturated group, for example, by $—CH_2C_6H_4CH_2—$ or $—CH_2CH{=}CHCH_2—$. $L^1$ may have a substituent. Preferable examples of the substituent include an alkyl group, an aryl group, a heterocyclic group, an acyloxy group, a halogen atom, an alkoxy group, an aryloxy group, an alkylthio group, an arylthio group, an acyl group, an (alkyl or aryl) oxycarbonyl group, a mercapto group, a carbonamido group, a sulfonamido group, a sulfamoyl group, a carbamoyl group, an ureido group, a thioureido group, an (alkyl or aryl) amino group, a cyano group and a nitro group.

$L^1$ includes preferably an alkylene group having 1 to 10 carbon atoms, more preferably a straight-chain or branched saturated group having 1 to 10 carbon atoms, further preferably a substituted or unsubstituted, methylene, ethylene, or trimethylene group, particularly preferably a substituted or unsubstituted, methylene or ethylene group, and most preferably a substituted or unsubstituted methylene group.

The group represented by $L^2$ is described below.

$L^2$ represents a divalent connecting group having at least one hydrophilic group. Here, the hydrophilic group represents a group represented by —C(=O)—, —$SO_2$—, —SO—, —O—, —P(=O)=, —CONH—, —$SO_2$NH—, —$NHSO_2$NH— or —NHCONH—, or a cationic group (specifically, a quaternary salt structure of nitrogen or phosphorous, or a nitrogen-containing hetero ring containing a quaternary nitrogen atom), an amino group, a guanidino group, or a group obtained by combining these groups. These hydrophilic groups are properly combined with an alkylene group, alkenylene group, arylene group, or heterocyclic group, to constitute $L^2$.

The groups, such as an alkylene group, arylene group, alkenylene group, and heterocyclic group, which constitute $L^1$, may have a substituent. Examples of the substituent include the same substituents as those which $L^1$ may have.

The hydrophilic group in $L^2$ may be present either as a group dividing $L^2$ or as a part of substituents on $L^2$. It is preferable that a group represented by the formula —C(=O)—, —$SO_2$—, —SO—, —O—, —P(=O)=, —CONH—, —$SO_2$NH—, —$NHSO_2$NH— or —NHCONH—, or cationic group (specifically, a quaternary salt structure of nitrogen or phosphorous, or a nitrogen-containing hetero ring containing a quaternary nitrogen atom), amino group, guanidino group, or divalent group obtained by combining these groups, is present as a group dividing $L^2$ into parts.

One of preferable examples of the hydrophilic group which $L^2$ has, is a partial structure of the poly(alkyleneoxy) group exemplified by a poly(ethyleneoxy) group and a poly(propyleneoxy) group, or a polymerized group thereof. In this case, the poly(alkyleneoxy) group may be a single polymerization degree, or may be a mixture having a molecular weight distribution. The polymerization degree or average polymerization degree is preferably the range of 2 to 67.

As the hydrophilic group contained in $L^2$, those including a dissociating group as a result of combining the group represented by —$SO_2$—, —SO—, —O—, —P(=O)=, —C(=O)—, —CONH—, —$SO_2$NH—, —$NHSO_2$NH—, —NHCONH—, the amino group, or the guanidino group, or those including a dissociating group as a substituent which $L^2$ has are also preferable. Here, the dissociating group means a group, or a partial structure, having a proton(s) of such low acidity that the proton is dissociable by an alkaline developer, or a salt of such a group or structure. Specific examples of the dissociating group include carboxy group/—COOH, sulfo group/—$SO_3$H, phosphonic acid group/—$PO_3$H, phosphoric acid group/—$OPO_3$H, hydroxy group/—OH, mercapto group/—SH, —$SO_2NH_2$, N-substituted sulfonamide group/—$SO_2$NH— group, —$CONHSO_2$-group, —$SO_2NHSO_2$— group, —CONHCO— group, an activated methylene group, —NH— group present in a nitrogen-containing heterocyclic group, or salts of these groups.

As $L^2$, those obtained by properly combining an alkylene group or an arylene group with a group represented by the formula —C(=O)—, —$SO_2$—, —O—, —CONH—, —$SO_2$NH—, —$NHSO_2$NH—, or —NHCONH—, are preferably used. More preferably those obtained by combining an alkylene group having 2 to 5 carbon atoms with a group represented by the formula —C(=O)—, —$SO_2$—, —O—, —CONH—, —$SO_2$NH—, —$NHSO_2$NH— or —NHCONH— are used.

Y represents —C(=O)— or —$SO_2$—. Preferably —C(=O)— is used.

$X^{n-}$ has the same meanings as $X^{n-}$ in the above formula (I) to (IV).

Next, the quaternary salt compounds represented by formula (B) are explained.

$L^1$, $L^2$, Y and $X^{n-}$ in formula (B) each have the same definition as those of formula (A).

In formula (B), A represents an organic moiety necessary to complete a nitrogen-containing aromatic heterocyclic ring. The term "nitrogen-containing aromatic heterocyclic ring compound" is employed to embrace pyridine derivatives, quinoline derivatives, isoquinoline derivatives, pyrrole derivatives, oxazole derivatives, thiazole derivatives, imidazole derivatives, bezoxazole derivatives, benzothiazole derivatives and benzimidazole derivatives. These compounds may be a monocyclic compound, or a compound condensed with another ring. Further, these heterocyclic compounds may have the following group(s) as a substituent. However, a substituent containing a primary hydroxyl group is excluded.

Examples of the substituent that the nitrogen-containing aromatic heterocyclic compound formed by A in formula (B) may have, include an alkyl group, an alkenyl group, an alkynyl group, an aryl group, a heterocyclic group, an acyloxy group, a halogen atom, an alkoxy group, an aryloxy group, an alkylthio group, an arylthio group, an acyl group, an (alkyl or aryl)oxycarbonyl group, a sulfo group (including sulfonato), a carboxyl group (including carboxylato), a mercapto group, a carbonamido group, a sulfonamido group, a sulfamoyl group, a carbamoyl group, an ureido group, a thioureido group, an (alkyl or aryl)amino group, a cyano group and a nitro group. These substituents may be further substituted with these groups.

In formulae (B), as an aromatic heterocyclic compound formed by A, there are preferably pyridine derivatives, quinoline derivatives, isoquinoline derivatives, bezoxazole derivatives, benzothiazole derivatives and benzimidazole derivatives. Among these compounds, pyridine derivatives, quinoline derivatives, isoquinoline derivatives are more preferred. As a substituent of the aromatic heterocyclic compound, an alkyl group an aryl group, a heterocyclic group, a halogen atom, an alkoxy group, an aryloxy group, an alkylthio group, an arylthio group, an (alkyl or aryl) amino group and a cyano group are preferred.

In the present invention, among quaternary salt compounds represented by formulae (A) and (B), more preferred is those represented by formula (B). In formula (B), as the aromatic heterocyclic compound formed by A, 4-phenylpyridine, isoquinoline n and quinoline are especially preferably used.

Next, specific examples of the quaternary compounds represented by formula (A) or (B) are shown below. However, the present invention is not limited thereto. In the chemical formulae, Me, Bu and Ph each stand for methyl, butyl and phenyl groups, respectively.

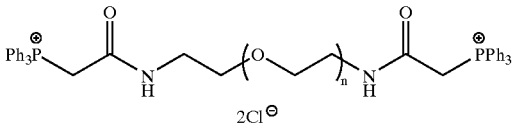
A-1 n = 1
A-2 n = 2
A-3 n = 3
A-4 n = 12
A-5 n = 30
A-6 n = average 34
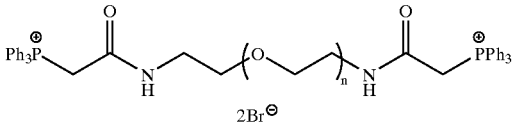
A-7 n = 1
A-8 n = 2
A-9 n = 3
A-10 n = 12
A-11 n = 30
A-12 n = average 34
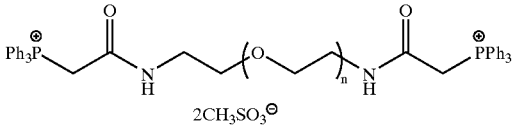
A-13 n = 1
A-14 n = 2
A-15 n = 3
A-16 n = 12
A-17 n = 30
A-18 n = average 34
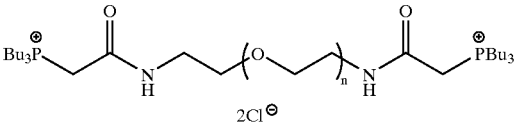
A-19 n = 1
A-20 n = 2
A-21 n = 3
A-22 n = 12
A-23 n = 30
A-24 n = average 34
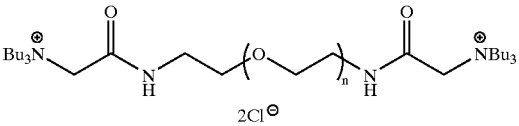
A-25 n = 1
A-26 n = 2
A-27 n = 3
A-28 n = 12
A-29 n = 30
A-30 n = average 34
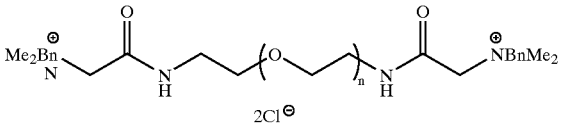
A-25′ n = 1
A-26′ n = 2
A-27′ n = 3
A-28′ n = 12
A-29′ n = 30
A-30′ n = average 34
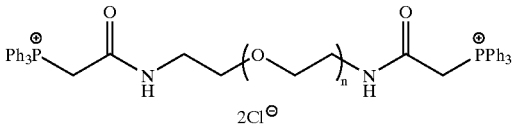
A-31 n = 1
A-32 n = 2
A-33 n = 3
A-34 n = 12
A-35 n = 30
A-36 n = average 34
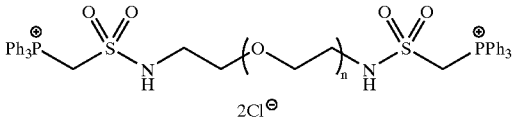
A-37 n = 1
A-38 n = 2
A-39 n = 3
A-40 n = 12
A-41 n = 30
A-42 n = average 34
A-43
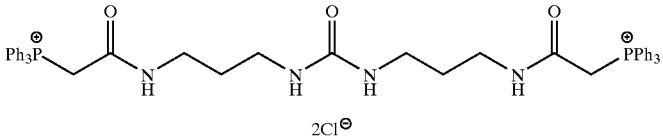
A-44
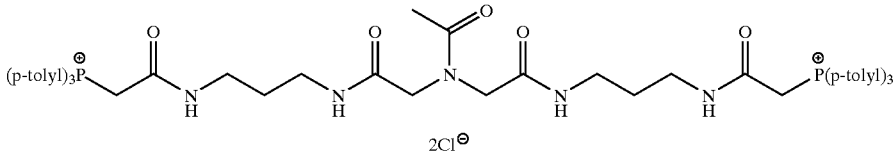
A-45
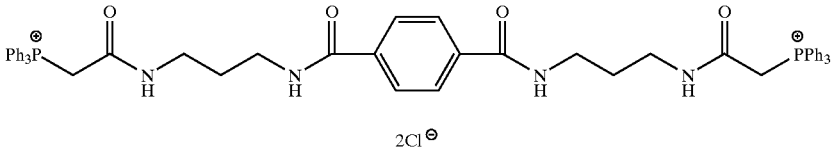

-continued
A-46
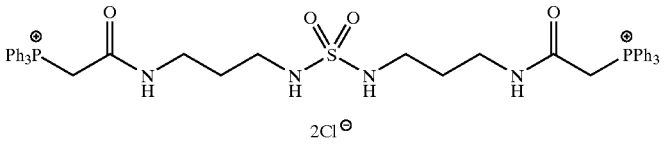
A-47
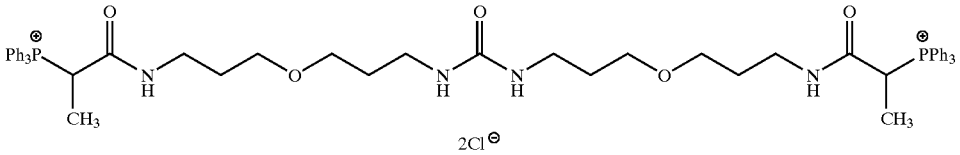
A-48
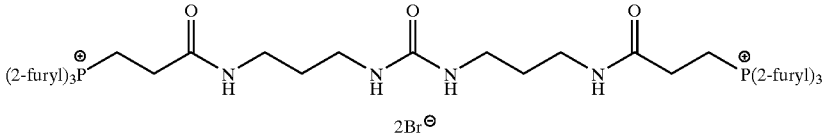
A-49
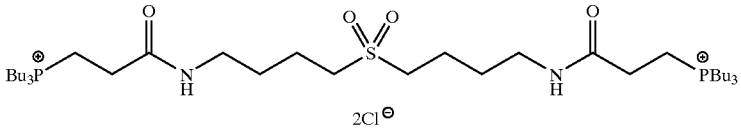
A-50
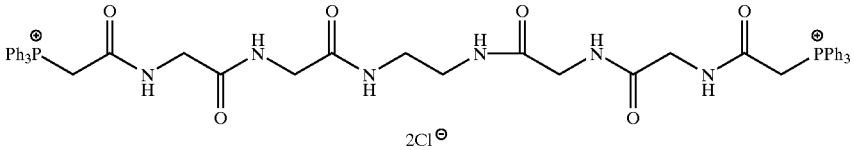
A-51
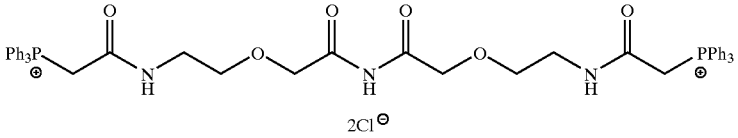
A-52
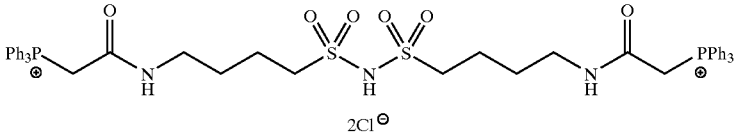
A-53
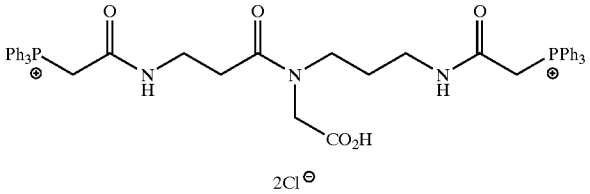
A-54
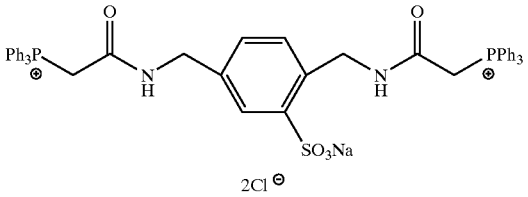

-continued

A-55

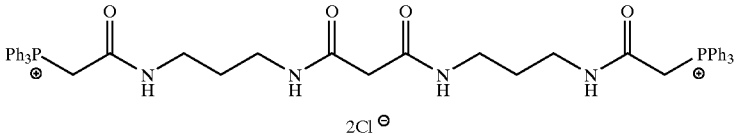

B-1 n = 1
B-2 n = 2
B-3 n = 3
B-4 n = 4
B-5 n = average 13
B-6 n = average 45

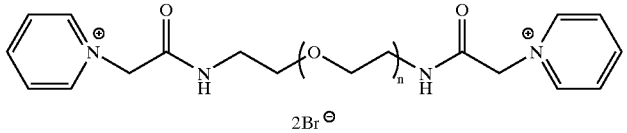

B-7 n = 1
B-8 n = 2
B-9 n = 3
B-10 n = 4
B-11 n = average 13
B-12 n = average 45

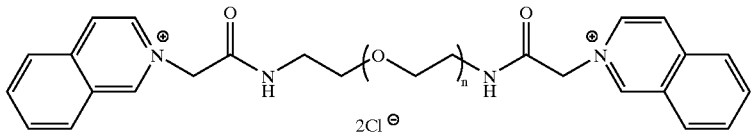

B-13 n = 1
B-14 n = 2
B-15 n = 3
B-16 n = 4
B-17 n = average 13
B-18 n = average 45

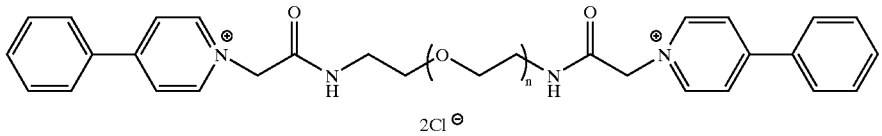

B-19 n = 1
B-20 n = 2
B-21 n = 3
B-22 n = 4
B-23 n = average 13
B-24 n = average 45

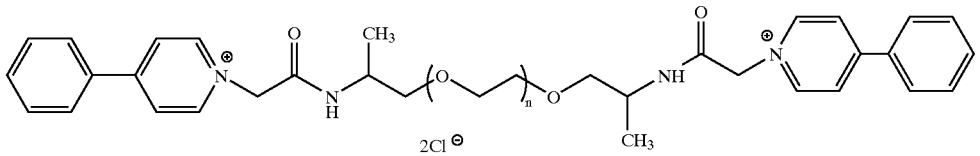

B-19′ n = 1
B-20′ n = 2
B-21′ n = 3
B-22′ n = 4
B-23′ n = average 13
B-24′ n = average 45

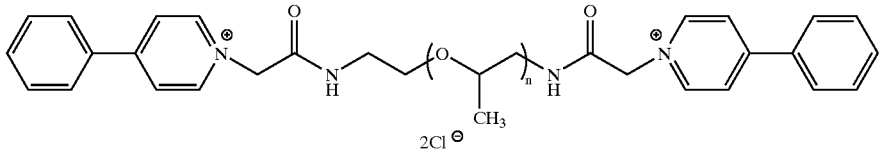

B-25 n = 1
B-26 n = 2
B-27 n = 3
B-28 n = 4
B-29 n = average 13
B-30 n = average 45

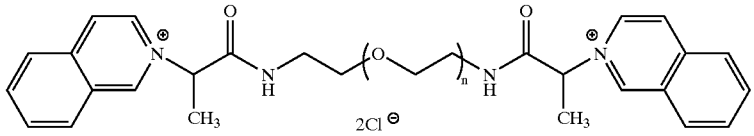

B-31 n = 1
B-32 n = 2
B-33 n = 3
B-34 n = 4
B-35 n = average 13
B-36 n = average 45

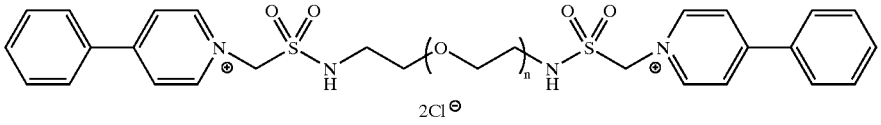

B-37 n = 1
B-38 n = 2
B-39 n = 3
B-40 n = 4
B-41 n = average 13
B-42 n = average 45

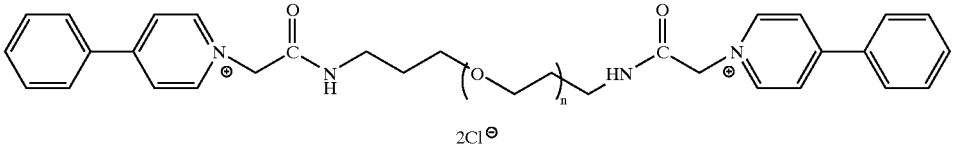

B-43 n = 1
B-44 n = 2
B-45 n = 3
B-46 n = 4
B-47 n = average 13
B-48 n = average 45

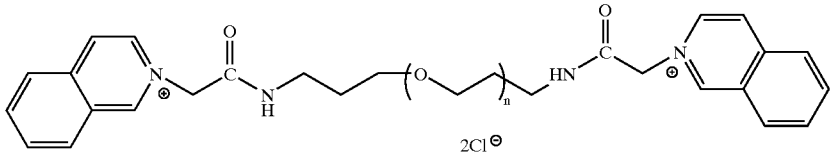

B-49 n = 1
B-50 n = 2
B-51 n = 3
B-52 n = 4

-continued
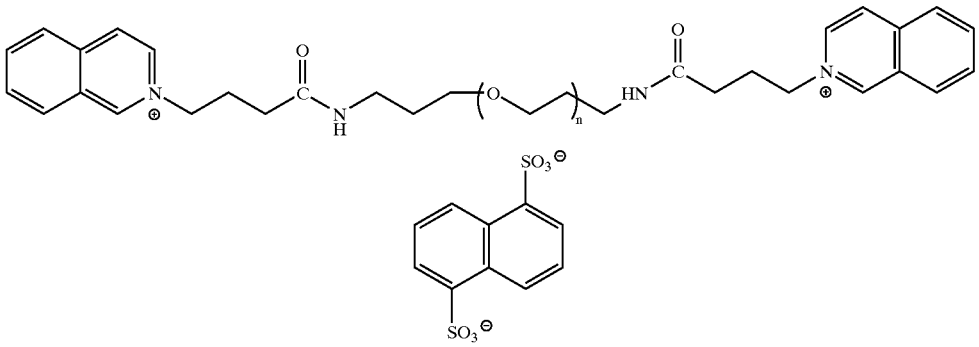
B-53 n = 1
B-54 n = 2
B-55 n = 3
B-56 n = 4
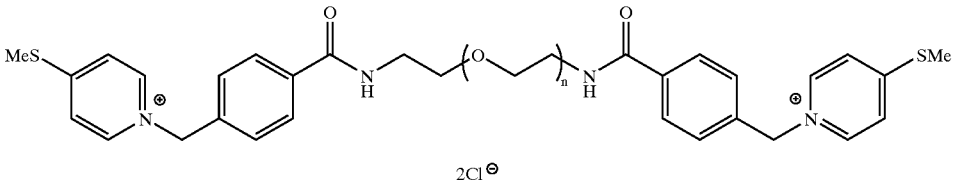
B-57 n = 1
B-58 n = 2
B-59 n = 3
B-60 n = 4
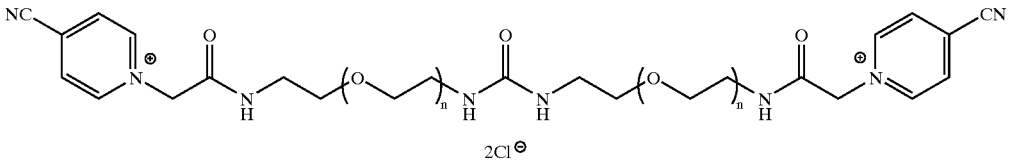
B-61 n = 1
B-62 n = 2
B-63 n = 3
B-64 n = 4
B-65
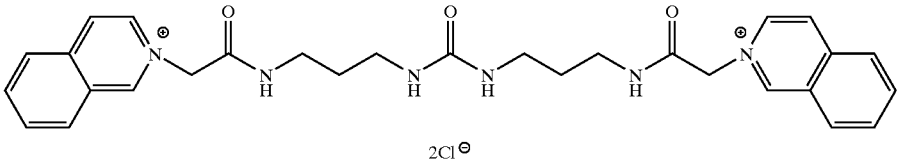
B-66
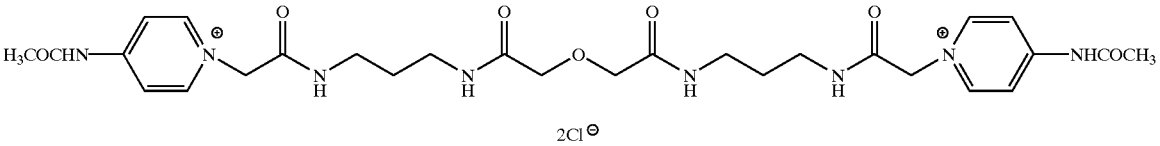
B-67
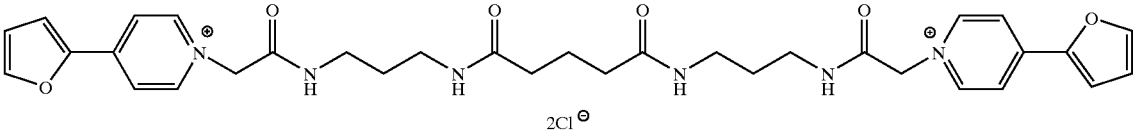
B-68
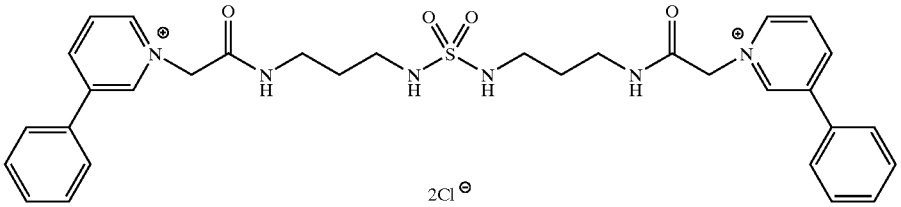
B-69
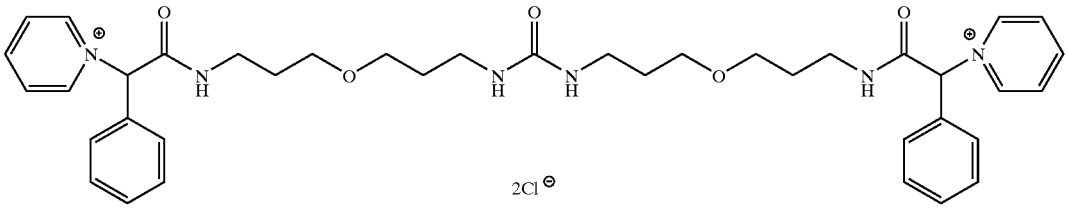

-continued
B-70
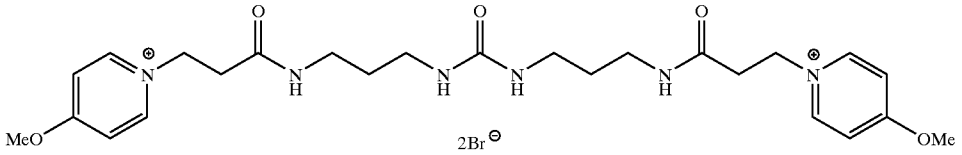
B-71
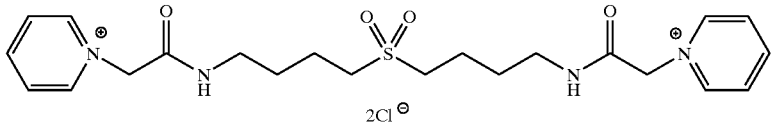
B-72
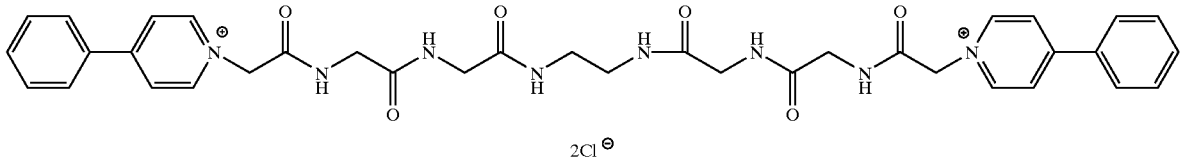
B-73
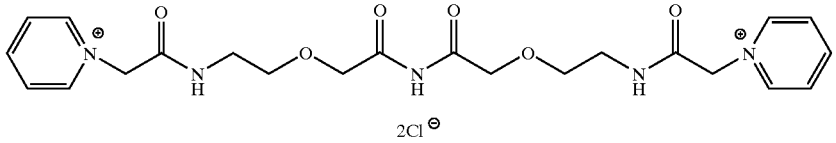
B-74
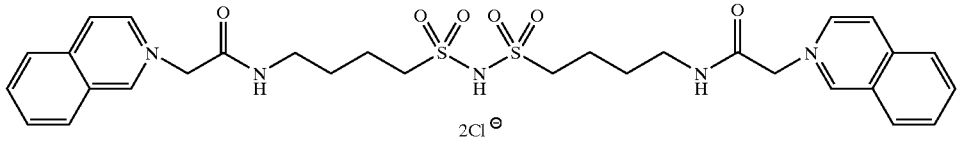
B-75
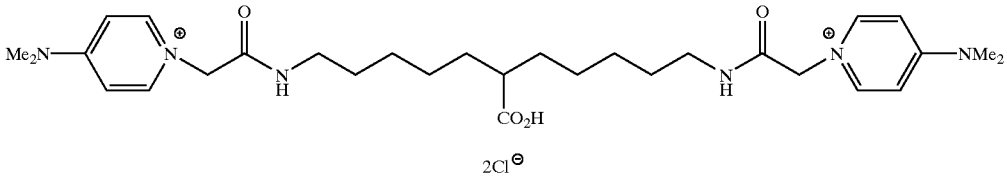
B-76
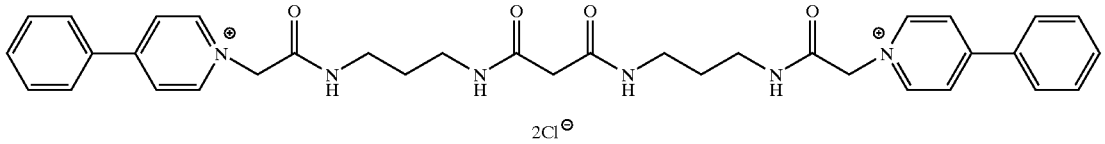
B-77
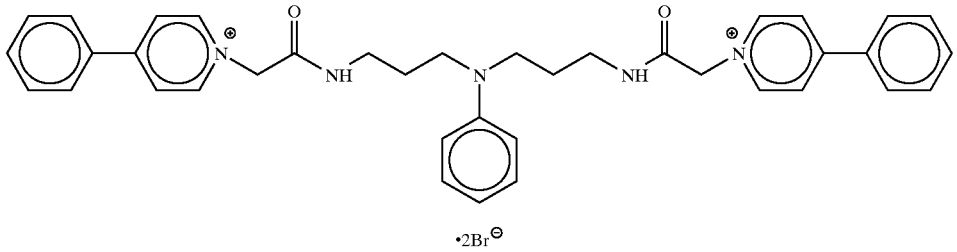

-continued

B-78

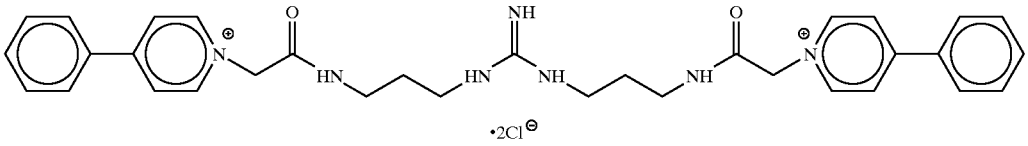

B-79

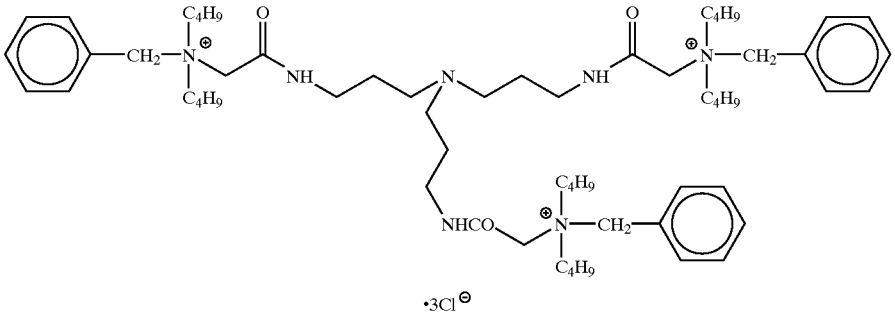

The quaternary salt compounds represented by formula (A) or (B) for use in the present invention can be synthesized by a known method. Specific examples of synthesis are described below.

Synthesis Example 4

(Synthesis of Exemplified A-32)

1,10-diamino-4,6-dioxadecane (17.6 g, 0.1 mol), potassium carbonate (27.6 g, 0.2 mol), ethyl acetate (100 ml) and water(50 ml) were vigorously agitated at a room temperature, and chloroacetyl chloride (34 g, 0.3 mol) was added dropwise thereto. The reaction solution was separated, and the separated ethyl acetate layer was dried with sodium sulfate, followed by concentration. As a result 1,10-bis (chloroacetylamino)-4,6-dioxadecane was obtained (23 g, yield 70%). 3.3 g of the thus-obtained compound and triphenylphosphine (7.9 g) were mixed and heated at 150° C. for 5 hours. The reaction mixture was cooled and then washed with ethyl acetate three times.

As a result, 5.4 g of exemplified compound A-32 was obtained as a brown and viscous liquid (yield 63%).

Synthesis Example 5

(Synthesis of Exemplified B-44)

Exemplified B-44 was synthesized thoroughly in the same manner as Synthesis Example 4 except for using 4-phenylpyridine in place of triphenyl phosphine in the Synthesis Example 4.

Synthesis Example 6

(Synthesis of Exemplified B-24)

Exemplified B-24 was synthesized thoroughly in the same manner as Synthesis Example 4 except for using 0,0'-bis (2-aminopropyl) polyethylene glycol 800 in place of 1,10-diamino-4, 6-dioxadecane, and further using 4-phenylpyridine in place of triphenyl phosphine in the Synthesis Example 4.

In the present invention, a nucleation accelerator that is already known in the past may be used in combination with the quaternary salt compound defined by the present invention. Examples of the nucleation accelerator include amine derivatives, onium salts, disulfide derivatives and hydroxymethyl derivatives.

Examples of the nucleation accelerator (nucleating accelerator) for use in the present invention include an amine derivative, an onium salt, a disulfide derivative, and a hydroxymethyl derivative. Specific examples thereof are described below: compounds described in JP-A-7-77783, page 48, lines 2 to 37; specifically, Compounds A-1) to A-73) described on pages 49 to 58; compounds represented by (Chemical formula 21), (Chemical formula 22), and (Chemical formula 23) described in JP-A-7-84331; specifically, compounds described on pages 6 to 8 of the publication; compounds represented by formulae [Na] and [Nb] described in JP-A-7-104426; specifically, Compounds Na-1 to Na-22 and Compounds Nb-1 to Nb-12 described on pages 16 to 20 of the publication; compounds represented by formula (1), formula (2), formula (3), formula (4), formula (5), formula (6), and formula (7) described in JP-A-8-272023; specifically, compounds 1-1 to 1-19, 2-1 to 2-22, 3-1 to 3-36, 4-1 to 4-5, 5-1 to 5-41, 6-1 to 6-58, and 7-1 to 7-38, described in this publication; nucleation accelerator described in JP-A-9-297377, page 55, column 108, line 8 to page 69, column 136, line 44.

The quaternary salt compound and nucleation accelerator in the present invention may be used after it is dissolved in a proper water-miscible organic solvent such as alcohols (methanol, ethanol, propanol or fluorinated alcohol), ketones (acetone or methyl ethyl ketone), dimethylformamide, dimethylsulfoxide or methyl cellosolve.

Also, the nucleation accelerator may be used after it is dissolved using an auxiliary solvent such as dibutylphthalate, tricresyl phosphate, an oil such as glyceryl triacetate or diethyl phthalate, ethyl acetate, or cyclohexanone according to an already well-known emulsion-dispersion method to produce an emulsion-dispersion mechanically. Alternatively, the nucleation accelerator may be used by dispersing a powder of the nucleation accelerator in water by using a ball mill, colloid mill or ultrasonic waves.

In the present invention, although the nucleation accelerator may be added to any layer of the silver halide emulsion layer and other hydrophilic colloidal layers on the side of the silver halide emulsion layer with respect to a support, it is preferably added to the silver halide emulsion layer or a hydrophilic layer adjacent to the silver halide emulsion layer.

In the present invention, the amount of the nucleation accelerator to be added is preferably $1\times10^{-6}$ to $2\times10^{-2}$ mol more preferably $1\times10^{-5}$ to $2\times10^{-2}$ mol and most preferably $2\times10^{-5}$ to $1\times10^{-2}$ mol. These nucleation accelerators may be used in combinations of two or more.

In the present invention, it is preferable to contain at least one kind of hydrazine derivatives as a nucleating agent. More preferable hydrazine derivative is represented by the formula (D).

formula (D)

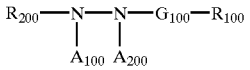

wherein $R_{200}$ represents an aliphatic group, an aromatic group, or a heterocyclic group; $R_{100}$ represents a hydrogen atom or a blocking group; $G_{100}$ represents a —CO—, —COCO—, —C(=S)—, —$SO_2$—, —SO—, or —PO($R_{300}$)— group (in which $R_{300}$ is selected from the same range of groups for $R_{100}$ as defined below, and $R_{300}$ and $R_{100}$ is the same or different), or an iminomethylene group; $A_{100}$ and $A_{200}$ each represent a hydrogen atom, or one of them is a hydrogen atom and the other is a substituted or unsubstituted alkylsulfonyl group, a substituted or unsubstituted arylsulfonyl group, or a substituted or unsubstituted acyl group.

In formula (D), the aliphatic group represented by $R_{200}$ is preferably a substituted or unsubstituted straight-chain, branched-chain, or cyclic alkyl, alkenyl, or alkynyl group, each having 1 to 30 carbon atoms.

In formula (D), the aromatic group represented by $R_{200}$ is a monocyclic or condensed-ring aryl group. Examples of the ring include a benzene ring and a naphthalene ring. The heterocyclic group represented by $R_{200}$ is a monocyclic or condensed-ring, saturated or unsaturated, aromatic or non-aromatic heterocyclic group. Examples of the ring include a pyridine, a pyrimidine, an imidazole, a pyrazole, a quinoline, an isoquinoline, a benzimidazole, a thiazole, a benzothiazole, a piperidine, and a triazine ring. $R_{200}$ is preferably an aryl group, and especially preferably a phenyl group.

$R_{200}$ may be substituted with a substituent. Typical examples of the substituent include a halogen atom (fluorine, chlorine, bromine, or iodine), an alkyl group, which includes an aralkyl group, a cycloalkyl group, and an active methine group; an alkenyl group, an alkynyl group, an aryl group, a heterocyclic group, a quaternary nitrogen atom-containing heterocyclic group (e.g. a pyridinio group), an acyl group, an alkoxycarbonyl group, an aryloxycarbonyl group, a carbamoyl group, a carboxyl group or a salt thereof, a sulfonylcarbamoyl group, an acylcarbamoyl group, a sulfamoylcarbamoyl group, a carbazoyl group, an oxalyl group, an oxamoyl group, a cyano group, a thiocarbamoyl group, a hydroxy group; an alkoxy group, which group contains a group containing a repeating unit of an ethyleneoxy group or a propyleneoxy group; an aryloxy group, a heterocyclic oxy group, an acyloxy group, an (alkoxy or aryloxy)carbonyloxy group, a carbamoyloxy group, a sulfonyloxy group, an amino group, an (alkyl, aryl, or heterocyclic)amino group, an N-substituted nitrogen-containing heterocyclic group, an acylamino group, a sulfonamide group, a ureido group, a thioureido group, an isothioureido group, an imido group, an (alkoxy or aryloxy)-carbonylamino group, a sulfamoylamino group, a semicarbazido group, a thiosemicarbazido group, a hydrazino group, a quaternary ammonio group, an oxamoyl amino group, an (alkyl or aryl)sulfonylureido group, an acylureido group, an N-acylsulfamoylamino group, a nitro group, a mercapto group, an (alkyl, aryl, or heterocyclic)-thio group, an (alkyl or aryl)sulfonyl group, an (alkyl or aryl)sulfinyl group, a sulfo group or a salt thereof, a sulfamoyl group, an acylsulfamoyl group, a sulfonylsulfamoyl group or a salt thereof, and a group having a phosphonamide or phosphate structure.

These substitutes may be further substituted by any of the above substituents.

Preferable examples of the substituent that $R_{200}$ may have include an alkyl group having 1 to 30 carbon atoms, wherein an active methylene group is included; an aralkyl group, a heterocyclic group, a substituted amino group, an acrylamino group, a sulfonamide group, a ureido group, a sulfamoylamino group, an imido group, a thioureido group, a phosphonamide group, a hydroxyl group, an alkoxy group, an aryloxy group, an acyloxy group, an acyl group, an alkoxycarbonyl group, an aryloxycarbonyl group, a carbamoyl group, a carboxyl group or a salt thereof, an (alkyl, aryl, or heterocyclic)thio group, a sulfo group or a salt thereof, a sulfamoyl group, a halogen atom, a cyano group, and a nitro group.

In formula (D), $R_{100}$ represents a hydrogen atom or a blocking group, and specific examples of the blocking group include an alkyl group, an alkenyl group, an alkynyl group, an aryl group, a heterocyclic group, an alkoxy group, an aryloxy group, an amino group, and a hydrazino group.

The alkyl group represented by $R_{100}$ is preferably an alkyl group having 1 to 10 carbon atoms. Specific examples of the alkyl group include a methyl group, a trifluoromethyl group, a difluoromethyl group, a 2-carboxytetrafluoroethyl group, a pyridiniomethyl group, a difluoromethoxymethyl group, a difluorocarboxymethyl group, a 3-hydroxypropyl group, a methanesulfonamidomethyl group, a benzenesulfonamidomethyl group, a hydroxymethyl group, a methoxymethyl group, a methylthiomethyl group, a phenylsulfonylmethyl group, and an o-hydroxybenzyl group. The alkenyl group is preferably an alkenyl group having 1 to 10 carbon atoms. Examples of the alkenyl group include a vinyl group, a 2,2-dicyanovinyl group, a 2-ethoxycarbonylvinyl group, and a 2-trifluoro-2-methoxycarbonylvinyl group. The alkynyl group is preferably an alkynyl group having 1 to 10 carbon atoms. Examples of the alkynyl group include an ethynyl group and a 2-methoxycarbonylethynyl group. The aryl group is preferably a monocyclic or condensed-ring aryl group, and especially preferably an aryl group containing a benzene ring. Examples of the aryl group include a phenyl group, a 3,5-dichlorophenyl group, a 2-methanesulfonamidephenyl group, a 2-carbamoylphenyl group, a 4-cyanophenyl group, and a 2-hydroxymethylphenyl group.

The heterocyclic group is preferably a 5- or 6-membered, saturated or unsaturated, monocyclic or condensed-ring heterocyclic group that contains at least one nitrogen, oxygen, or sulfur atom. Examples of the heterocyclic group include a morpholino group, a piperidino group (N-substituted), a piperazino group, an imidazolyl group, an indazolyl group (e.g. a 4-nitroindazolyl group), a pyrazolyl group, a triazolyl group, a benzimidazolyl group, a tetrazolyl group, a pyridyl group, a pyridinio group (e.g. a N-methyl-3-pyridinio group), a quinolinio group, and a quinolyl group. Among these, especially preferred are a morpholino group, a piperidino group, a pyridyl group, and a pyridinio group.

The alkoxy group is preferably an alkoxy group having 1 to 8 carbon atoms. Examples of the alkoxy group include a methoxy group, a 2-hydroxyethoxy group, and a benzyloxy group. The aryloxy group is preferably a phenyloxy group. The amino group is preferably an unsubstituted amino group, an alkylamino group having 1 to 10 carbon atoms, an arylamino group, or a saturated or unsaturated heterocyclic amino group, wherein a quaternary nitrogen atom-containing heterocyclic group is included. Examples of the amino group include a 2,2,6,6-tetramethylpiperidine-4-ylamino group, a propylamino group, a 2-hydroxyethylamino group, an anilino group, an o-hydroxyanilino group, a 5-benzotriazolylamino group, and an N-benzyl-3-piridinioamino group. The hydrazino group is especially preferably a substituted or unsubstituted hydrazino group, or a substituted or unsubstituted phenylhydrazino group (e.g. a 4-benzenesulfonamidophenylhydrazino group).

These groups represented by $R_{100}$ may be substituted with a substituent. Preferable examples of the substituent are the same as those mentioned as the substituent of $R_{200}$.

In formula (D), $R_{100}$ may be an atomic group capable of splitting a part of $G_{100}$—$R_{100}$ from the residual molecule, and subsequently of taking place cyclization reaction by which a cyclic structure containing atoms of the —$G_{100}$—$R_{100}$ part is formed. Examples of the atomic groups include those described, for example, in JP-A-63-29751.

The hydrazine derivatives represented by formula (D) may contain an adsorptive group capable of being adsorbed onto the silver halide. Examples of the absorbing group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these adsorptive groups onto the silver halide may be modified into a precursor thereof. Examples of the precursor include those groups described in JP-A-2-285344.

$R_{100}$ or $R_{200}$ of formula (D) may contain a polymer or a ballasting group that is usually used for immobile photographic additives, such as a coupler. The ballasting group in the present invention has 6 or more carbon atoms, and it is a group relatively inactive to photographic properties. The ballasting group can be selected from a straight-chain or branched, alkyl group (or alkylene group), alkoxy group (or alkyleneoxy group), alkylamino group (or alkyleneamino group), or alkylthio group, or a group having these groups as its partial structure. It is more preferable that the ballasting group is, having 7 or more but 24 or less carbon atoms, a straight-chain or branched, alkyl group (or alkylene group), alkoxy group (or alkyleneoxy group), alkylamino group (or alkyleneamino group), or alkylthio group, or a group having these groups as its partial structure. Examples of the polymer include those described, for example, in JP-A-1-100530.

$R_{100}$ or $R_{200}$ of formula (D) may contain a plurality of hydrazino groups as a substituent. At this time, the compound represented by formula (D) is a multimer of the hydrazino group. Specific examples of the compound include those described, for example, in JP-A-64-86134, JP-A-4-16938, JP-A-5-197091, WO95-32452, WO95-32453, JP-A-9-179229, JP-A-9-235264, JP-A-9-235265, JP-A-9-235266, and JP-A-9-235267.

$R_{100}$ or $R_{200}$ in the formula (D) may contain a cationic group (specifically, a group containing a quaternary ammonio group, a group containing a quaternary phosphorous atom or a nitrogen-containing heterocyclic group having a quaternary nitrogen atom), a group containing a repeating unit of an ethyleneoxy group or propyleneoxy group, an (alkyl, aryl or heterocyclic)thio group or a dissociating group (which means a group, or a partial structure, having a proton(s) of such low acidity that the proton is dissociable by an alkaline developer, or a salt of such a group or structure, specifically, for example, carboxy group/—COOH, sulfo group/—$SO_3H$, phosphonic acid group/—$PO_3H$, phosphoric acid group/—$OPO_3H$, hydroxy group/—OH, mercapto group/—SH, —$SO_2NH_2$, N-substituted sulfonamide group/—$SO_2NH$—, —$CONHSO_2$—, —$CONHSO_2NH$—, —$NHCONHSO_2$—, —$SO_2NHSO_2$—, —CONHCO—, an activated methylene group, —NH— inherent in a nitrogen-containing heterocyclic group, or salts of these groups).

Examples of containing these groups include compounds described in JP-A-7-234471, JP-A-5-333466, JP-A-6-19032, JP-A-6-19031, JP-A-5-45761, U.S. Pat. Nos. 4,994,365, 4,988,604, JP-A-7-259240, JP-A-7-5610, JP-A-7-244348, German Patent No. 4,006,032, JP-A-11-7093.

In formula (D), $A_{100}$ and $A_{200}$ each represent a hydrogen atom or an alkyl or arylsulfonyl group having 20 or less carbon atoms (preferably, a phenylsulfonyl group, or a phenyl sulfonyl group substituted with a substituent(s) so that the total of the Hammett substituent constant of the substituent becomes −0.5 or more), or an acyl group having 20 or less carbon atoms (preferably, a benzoyl group, a benzoyl group substituted with a substituent(s) so that the total of the Hammett substituent constant of the substituent becomes −0.5 or more, or a straight-chain, branched, or cyclic, substituted or unsubstituted, aliphatic acyl group, wherein examples of the substituent include a halogen atom, an ether group, a sulfonamide group, a carbonamide group, a hydroxyl group, a carboxyl group, and a sulfo group). $A_{100}$ and $A_{200}$ each are most preferably a hydrogen atom.

Next, in the present invention, a particularly preferable hydrazine derivative will be explained.

As $R_{200}$, a substituted phenyl group is particularly preferably. As the substituent, a sulfonamide group, acylamino group, ureido group, carbamoyl group, thioureido group, isothioureido group, sulfamoylamino group or N-acylsulfamoylamino group is particularly preferable. A sulfonamide group or ureido group is more preferable and a sulfonamide group is most preferable.

In the hydrazine derivatives represented by the formula (D) , $R_{200}$ or $R_{100}$ is particularly preferably substituted directly or indirectly with, as the substituent, at least one of the ballast group, the group adsorptive onto the silver halide, the group containing the quaternary ammonio group, the nitrogen-containing heterocyclic group having a quaternary nitrogen atom, the group containing a repeating unit of an ethyleneoxy group, the (alkyl, aryl or heterocyclic)thio group, the dissociating group dissociable by an alkaline developer, and the hydrazino group that can form a multimer (e.g., the group represented by —NHNH—$G_{100}$—$R_{100}$, wherein $G_{100}$ and $R_{100}$ have the same meanings as those in the formula (D), respectively). Further $R_{200}$ preferably has at least one of the aforementioned groups as its substituent directly or indirectly. Most preferably, $R_{200}$ represents a phenyl group substituted with a benzenesulfonamide group, and the benzenesulfonamide group has any one of the aforementioned groups as the substituent on its benzene ring, directly or indirectly.

Among those groups represented by $R_{100}$ when $G_{100}$ is a —CO— group, preferred are a hydrogen atom, an alkyl group, an alkenyl group, an alkynyl group, an aryl group, ora heterocyclic group, and more preferably a hydrogen atom, an alkyl group, or a substituted aryl group, wherein the substituent is especially preferably an electron-withdrawing group or an o-hydroxymethyl group. A hydrogen atom or an alkyl group is most preferred.

When $G_{100}$ is a —COCO— group, an alkoxy group, an aryloxy group, and an amino group are preferred. Further, a substituted amino group, specifically an alkylamino group, an arylamino group, and a saturated or unsaturated heterocyclic amino group, is especially preferred.

Further, when $G_{100}$ is a —$SO_2$— group, $R_{100}$ is preferably an alkyl group, an aryl group, or a substituted amino group.

In formula (D), $G_{100}$ is preferably a —CO— group or a —COCO— group and especially preferably a —CO— group.

Next, specific examples of the compound represented by formula (D) are illustrated below, but they are not intended to restrict the scope of the invention.

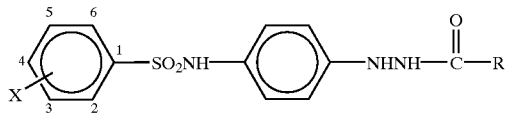

| | X = | R = —H | —$C_2F_4$—COOH (or —$C_2F_4$—$COO^{\ominus}K^{\oplus}$) | 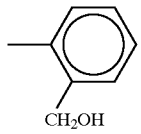 | 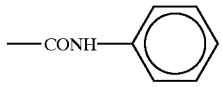 |
|---|---|---|---|---|---|
| D-1 | 3-$NHCOC_9H_{19}$(n) | 1 a | 1 b | 1 c | 1 d |
| D-2 | 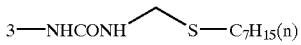 | 2 a | 2 b | 2 c | 2 d |
| D-3 | 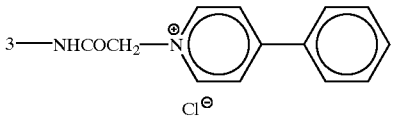 | 3 a | 3 b | 3 c | 3 d |
| D-4 | 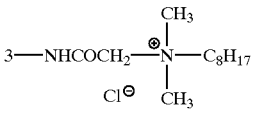 | 4 a | 4 b | 4 c | 4 d |
| D-5 | 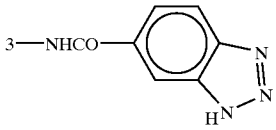 | 5 a | 5 b | 5 c | 5 d |
| D-6 | 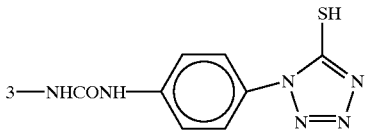 | 6 a | 6 b | 6 c | 6 d |
| D-7 | 2,4-$(CH_3)_2$-3-$SC_2H_4$(—$OC_2H_4$)$_4$—$OC_8H_{17}$ | 7 a | 7 b | 7 c | 7 d |

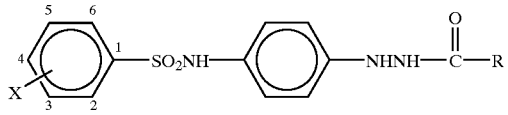
| | X = | R = —H | —$CF_2H$ | 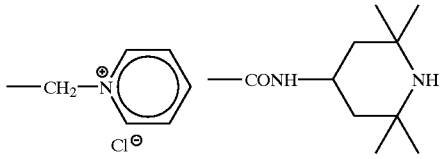 | |
|---|---|---|---|---|---|
| D-8 | 3—$CONHCH_2CH(C_2H_5)$—$C_4H_9$ | 8 a | 8 e | 8 f | 8 g |
| D-9 | 6—$OCH_3$—3—$C_5H_{11}$(t) | 9 a | 9 e | 9 f | 9 g |
| D-10 | 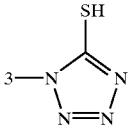 | 10 a | 10 e | 10 f | 10 g |
| D-11 | 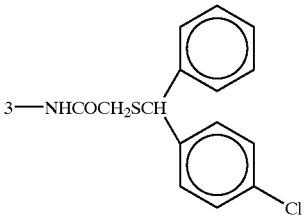 | 11 a | 11 e | 11 f | 11 g |
| D-12 | 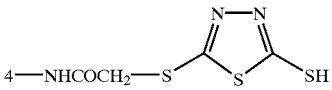 | 12 a | 12 e | 12 f | 12 g |
| D-13 | 3—$NHCOCH(CH_2COOH)$—$C_8H_{17}$ | 13 a | 13 e | 13 f | 13 g |
| D-14 | 3, 5—$(CONHCH_2CH(C_2H_5)$—$C_4H_9)_2$ | 14 a | 14 e | 14 f | 14 g |
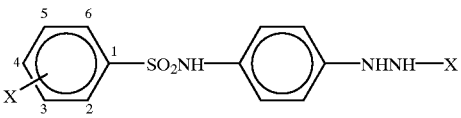
| | Y = | X = —CHO | —$COCF_3$ | —$SO_2CH_3$ | —$P(=O)(OC_2H_5)_2$ |
|---|---|---|---|---|---|
| D-15 | 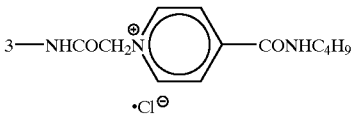 | 15 a | 15 h | 15 i | 15 j |

-continued
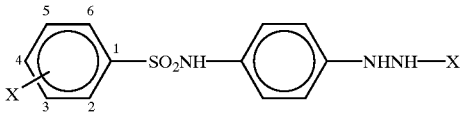
| | Y = | X = —CHO | —$COCF_3$ | —$SO_2CH_3$ | —$P(=O)(OC_2H_5)_2$ |
|---|---|---|---|---|---|
| D-16 | 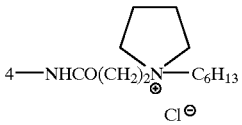 | 16 a | 16 h | 16 i | 16 j |
| D-17 | 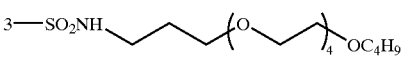 | 17 a | 17 h | 17 i | 17 j |
| D-18 | 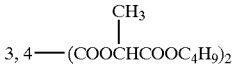 | 18 a | 18 h | 18 i | 18 j |
| D-19 | 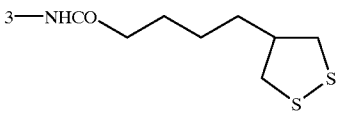 | 19 a | 19 h | 19 i | 19 j |
| D-20 | 3-$NHSO_2NH$—$C_8H_{17}$ | 20 a | 20 h | 20 i | 20 j |
| D-21 | 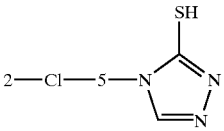 | 21 a | 21 h | 21 i | 21 j |

| | | R = | | | |
|---|---|---|---|---|---|
| | | —H | —$CF_2H$ | 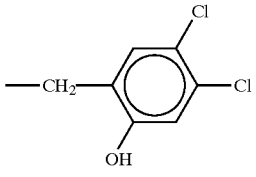 | —$CONHC_3H_7$ |
| D-22 | 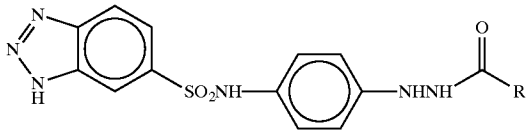 | 22 a | 22 e | 22 k | 22 l |
| D-23 | 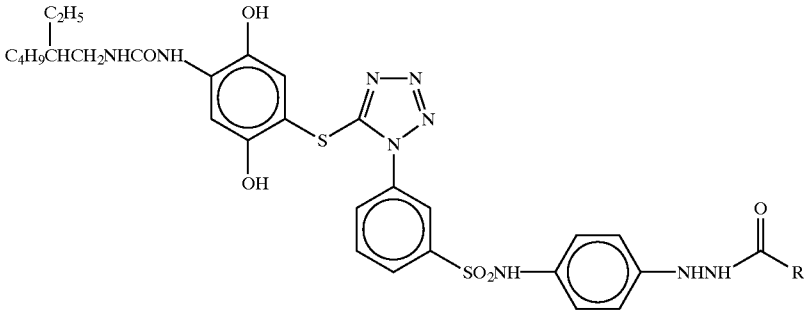 | 23 a | 23 e | 23 k | 23 l |
| D-24 | 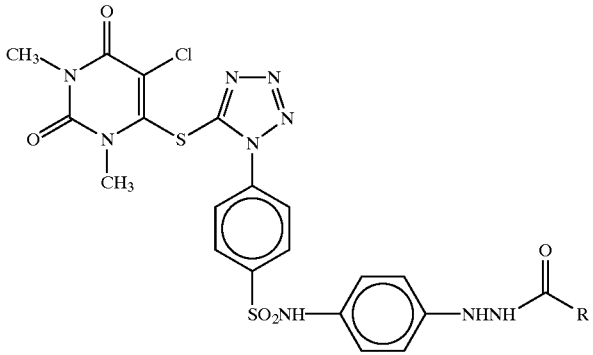 | 24 a | 24 e | 24 k | 24 l |

-continued
| | | R = | | | |
|---|---|---|---|---|---|
| | | —H | —$CF_2H$ | 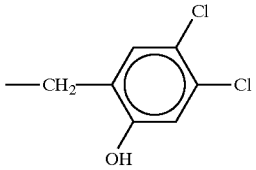 | —$CONHC_3H_7$ |
| D-25 | 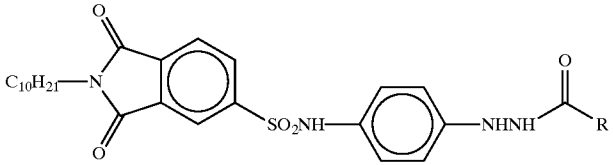 | 25 a | 25 e | 25 k | 25 l |
| D-26 | 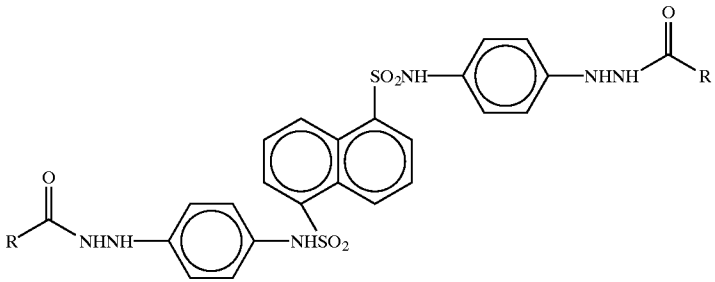 | 26 a | 26 e | 26 k | 26 l |
| D-27 | 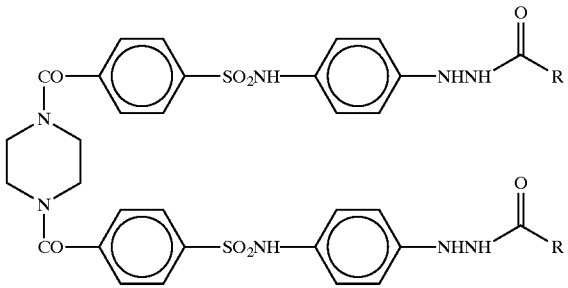 | 27 a | 27 e | 27 k | 27 l |

-continued
| | | R = | | | |
|---|---|---|---|---|---|
| | | —H | —$CF_2H$ | 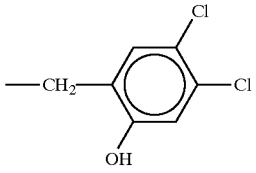 | —$CONHC_3H_7$ |
| D-28 | 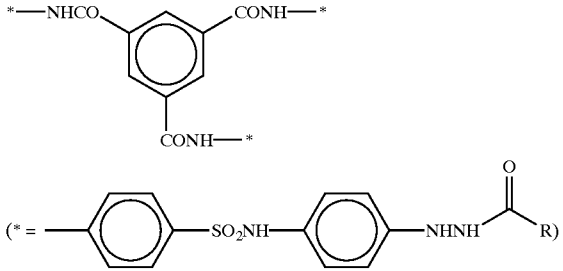 | 28 a | 28 e | 28 k | 28 l |

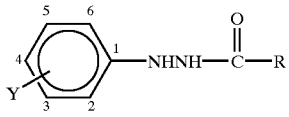
| | Y = | R = —H | —$CH_2OCH_3$ | 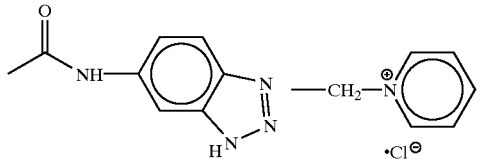 | |
|---|---|---|---|---|---|
| D-29 | 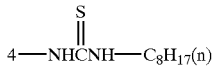 | 29 a | 29 m | 29 n | 29 f |
| D-30 | 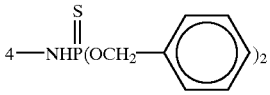 | 30 a | 30 m | 30 n | 30 f |
| D-31 | 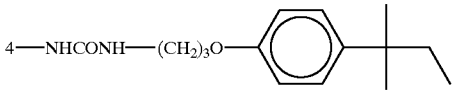 | 31 a | 31 m | 31 n | 31 f |
| D-32 | 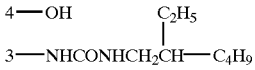 | 32 a | 32 m | 32 n | 32 f |
| D-33 | 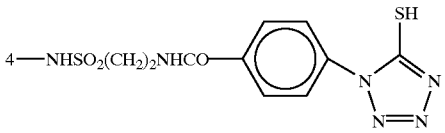 | 33 a | 33 m | 33 n | 33 f |
| D-34 | 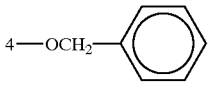 | 34 a | 34 m | 34 n | 34 f |
| D-35 | 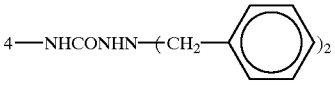 | 35 a | 35 m | 35 n | 35 f |

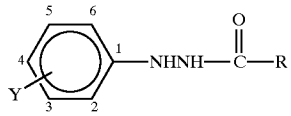
| | Y = | R = —H | —$C_3F_6$—COOH | —$CONHCH_3$ | 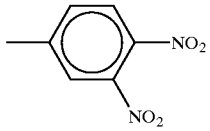 |
|---|---|---|---|---|---|
| D-36 | 2-$NHSO_2CH_3$— 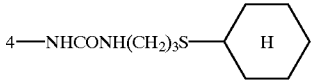 | 36 a | 36 o | 36 p | 36 q |
| D-37 | 2-$OCH_3$— 4-$NHSO_2C_{12}H_{25}$ | 37 a | 37 o | 37 p | 37 q |
| D-38 | 3-$NHCOC_{11}H_{23}$— 4-$NHSO_2CF_3$ | 38 a | 38 o | 38 p | 38 q |
| D-39 | 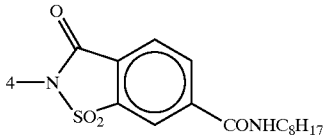 | 39 a | 39 o | 39 p | 39 q |
| D-40 | 4-$OCO(CH_2)_2COOC_6H_{13}$ | 40 a | 40 o | 40 p | 40 q |
| D-41 | 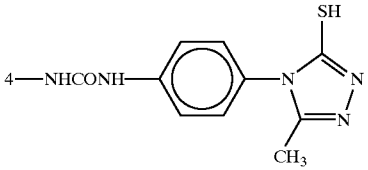 | 41 a | 41 o | 41 p | 41 q |

-continued
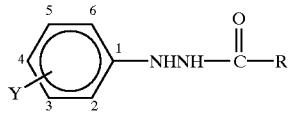
| | Y = | R = —H | —$C_3F_6$—COOH | —$CONHCH_3$ | 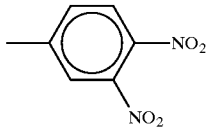 |
|---|---|---|---|---|---|
| D-42 | 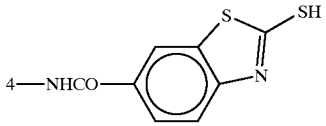 | 42 a | 42 o | 42 p | 42 q |
| D-43 | 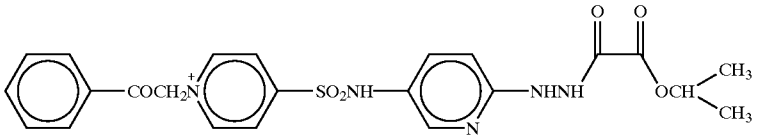 | | | | |
| D-44 | 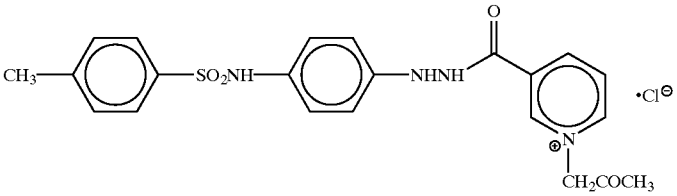 | | | | |
| D-45 | 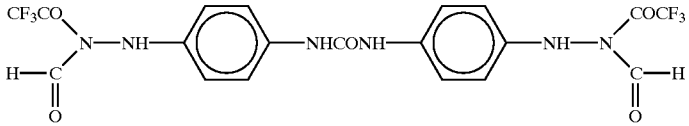 | | | | |

-continued
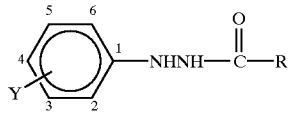
| Y = | R = | | | |
|---|---|---|---|---|
| | —H | —$C_3F_6$—COOH | —$CONHCH_3$ | 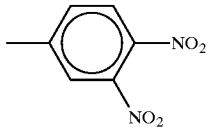 |
D-46
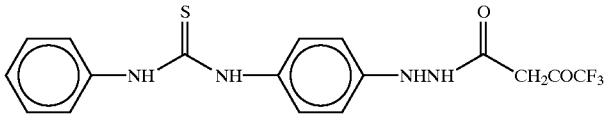
D-47
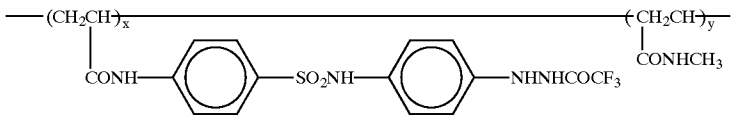
average molecular weight ≒ a hundred thousand
x:y = 3:97
D-48
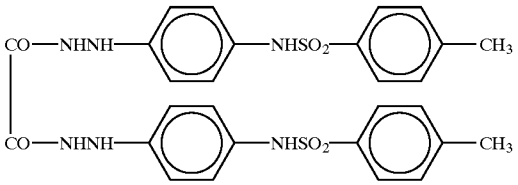
D-49
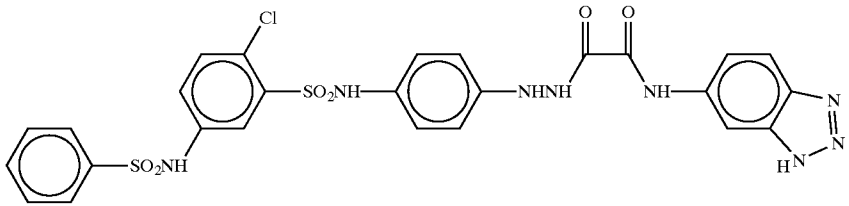

| No. | |
|---|---|
| D-50 | 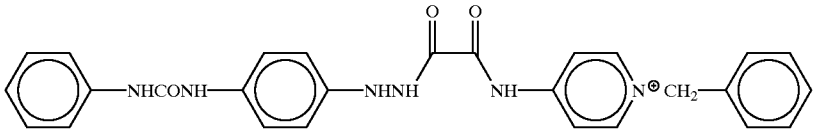 |
| D-51 | 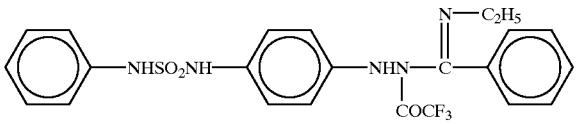 |
| D-52 | 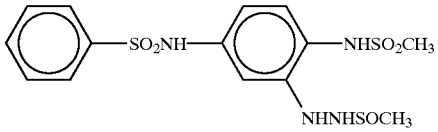 |
| D-53 | 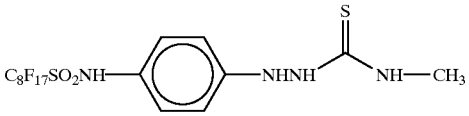 |
| D-54 | 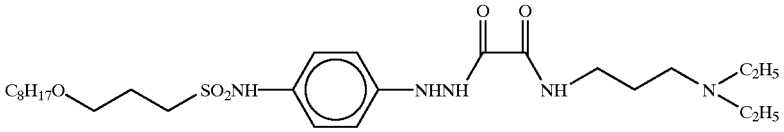 |
| D-55 | 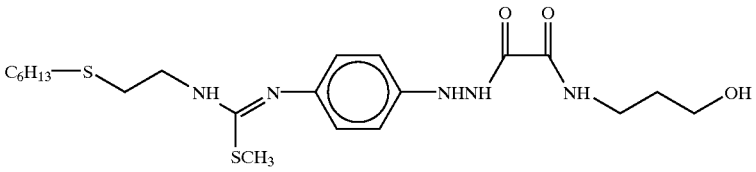 |
| D-56 | 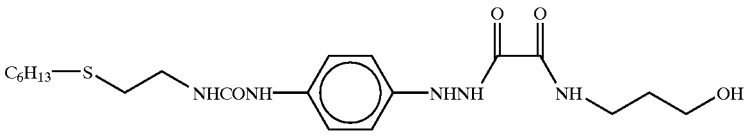 |
| D-57 | 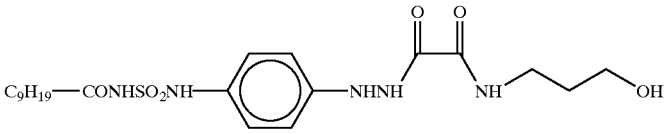 |
| D-58 | 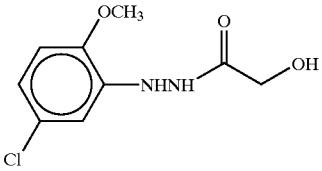 |
| D-59 | 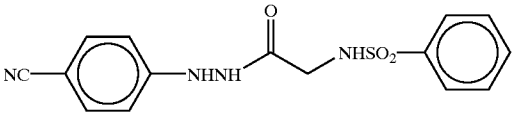 |

-continued
| No. | |
|---|---|
| D-60 | 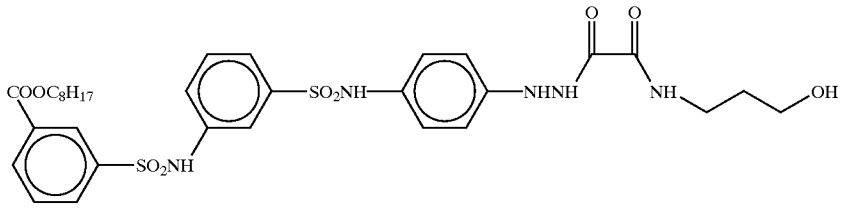 |
| D-61 | 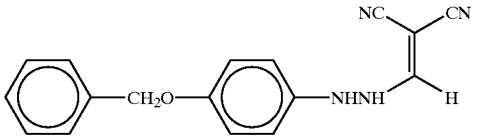 |
| D-62 | 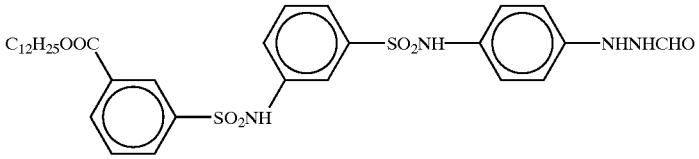 |
| D-63 | 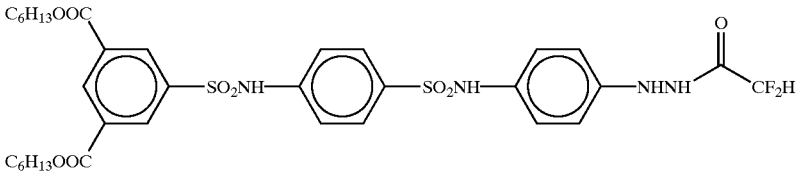 |
| D-64 | 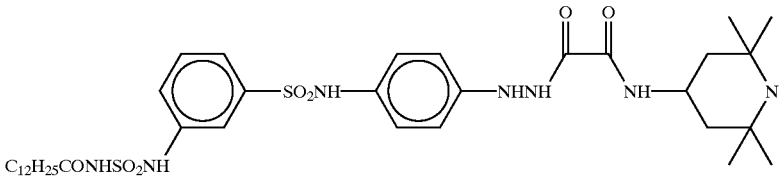 |
| D-65 | 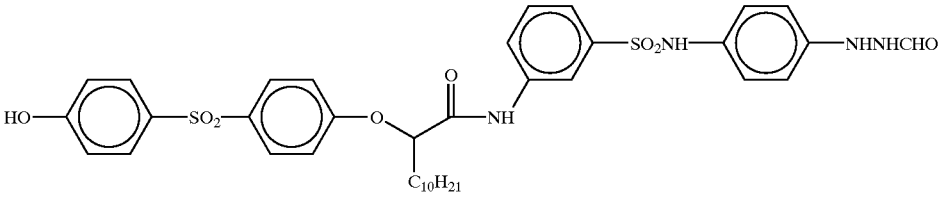 |
| D-66 | 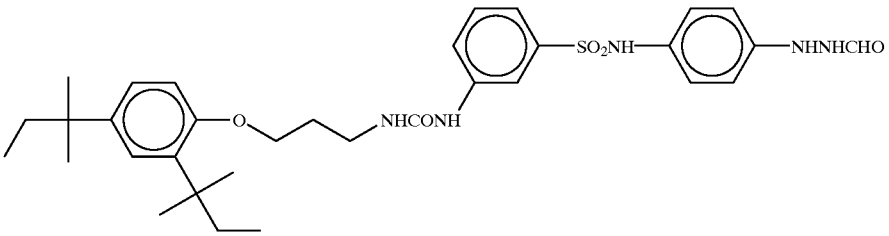 |

-continued

| No. | |
|---|---|
| D-67 | 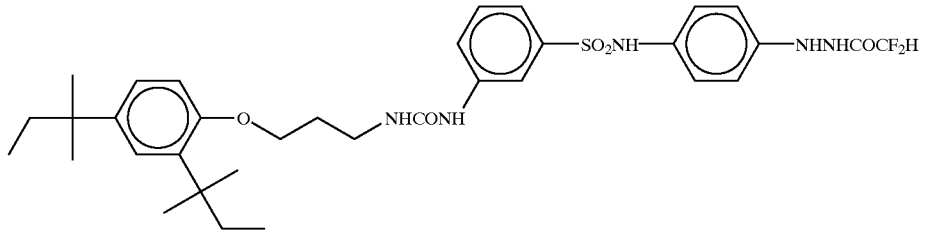 |

As the hydrazine derivatives for use in the present invention, in addition to the above, the following hydrazine derivatives can also preferably be used. The hydrazine derivatives for use in the present invention can be synthesized by various methods described in the following patents: compounds represented by (Chemical formula 1) described in JP-B-6-77138 ("JP-B" means examined Japanese patent publication); specifically, compounds described on pages 3 and 4 of the publication; compounds represented by formula (I) described in JP-B-6-93082; specifically, Compounds 1 to 38 described on pages 8 to 18 of the publication; compounds represented by formulae (4), (5), and (6) described in JP-A-6-230497; specifically, Compound 4-1 to Compound 4-10 described on pages 25 and 26, Compound 5-1 to Compound 5-42 described on pages 28 to 36, and Compound 6-1 to Compound 6-7 described on pages 39 and 40 of the publication, respectively; compounds represented by formulae (1) and (2) described in JP-A-6-289520; specifically, Compounds 1—1) to 1–17) and 2-1) described on pages 5 to 7 of the publication; compounds represented by (Chemical formula 2) and (Chemical formula 3) described in JP-A-6-313936; specifically, compounds described on pages 6 to 19 of the publication; compounds represented by (Chemical formula 1) described in JP-A-6-313951; specifically, compounds described on pages 3 to 5 of the publication; compounds represented by formula (I) described in JP-A-7-5610; specifically, Compounds I-1 to I-38 described on pages 5 to 10 of the publication; compounds represented by formula (II) described in JP-A-7-77783; specifically, Compounds II-1 to II-102 described on pages 10 to 27 of the publication; compounds represented by formulae (H) and (Ha) described in JP-A-7-104426; specifically, Compounds H-1 to H-44 described on pages 8 to 15 of the publication; compounds that have an anionic group in the vicinity of the hydrazine group or a nonionic group for forming an intramolecular hydrogen bond with the hydrogen atom of the hydrazine; and especially, compounds represented by formulae (A), (B), (C), (D), (E), and (F), described in JP-A-9-22082; specifically, Compounds N-1 to N-30 described in the specification thereof; and compounds represented by formula (1) described in JP-A-9-22082; specifically, Compounds D-1 to D-55 described in the specification thereof.

Besides, hydrazine derivatives described in WO 95-32452, WO 95-32453, JP-A-9-179229, JP-A-9-235264, JP-A-9-235265, JP-A-9-235266, JP-A-9-235267, JP-A-9-319019, JP-A-9-319020, JP-A-10-130275, JP-A-11-7093, JP-A-6-332096, JP-A-7-209789, JP-A-8-6193, JP-A-8-248549, JP-A-8-248550, JP-A-8-262609, JP-A-8-314044, JP-A-8-328184, JP-A-9-80667, JP-A-9-127632, JP-A-9-146208, JP-A-9-160156, JP-A-10-161260, JP-A-10-221800, JP-A-10-213871, JP-A-10-254082, JP-A-10-254088, JP-A-7-120864, JP-A-7-244348, JP-A-7-333773, JP-A-8-36232, JP-A-8-36233, JP-A-8-36234, JP-A-8-36235, JP-A-8-272022, JP-A-9-22083, JP-A-9-22084, JP-A-9-54381 and JP-A-10-175946.

The hydrazine-series nucleating agent for use in the present invention may be dissolved in an appropriate water-miscible organic solvent, such as an alcohol (e.g. methanol, ethanol, propanol, fluorinated alcohol), a ketone (e.g. acetone, methyl ethyl ketone), dimethylformamide, dimethylsulfoxide, or methyl cellosolve, before use.

Also, the hydrazine-series nucleating agent for use in the present invention may be dissolved using an oil, such as dibutyl phthalate, tricresyl phosphate, glyceryl triacetate, or diethyl phthalate; or using or an auxiliary solvent, such as ethyl acetate or cyclohexanone, by a conventionally well-known emulsion dispersion method, and mechanically processed into an emulsion dispersion before use. Alternatively, the hydrazine derivative powder may be dispersed in water by means of a ball mill, a colloid mill, or ultrasonic waves, according to a method known as a solid dispersion method, and used.

The hydrazine nucleating agent for use in the present invention may be added to a silver halide emulsion layer or to any of other hydrophilic colloid layers on the silver halide emulsion layer side of a support, but it is preferably added to the above-described silver halide emulsion layer or to a hydrophilic colloid layer adjacent thereto. Also, two or more kinds hydrazine-series nucleating agent may be used together.

The addition amount of the nucleating agent for use in the present invention is preferably from $1\times10^{-5}$ to $1\times10^{-2}$ mol, more preferably from $1\times10^{-5}$ to $5\times10^{-3}$ mol, and most preferably from $2\times10^{-5}$ to $5\times10^{-3}$ mol, per mol of silver halide.

In the present invention, at least one kind of redox compound capable of releasing a development inhibitor by oxidization may be incorporated.

As a redox group of the redox compound capable of releasing a development inhibitor by oxidization (e.g., being subjected to oxidization), that can be used in the present invention, hydroquinone, catechols, naphthohydroquinones, aminophenols, pyrazolidones, hydrazines, hydroxylamines and reductones are preferred, and hydrazines are more preferred.

Preferably, hydrazines that are used as a redox compound capable of releasing a development inhibitor by oxidization according to the present invention, are represented by formulae (1), (2) and (3). Among them, compounds represented by formula (1) are especially preferred.

formula (1)

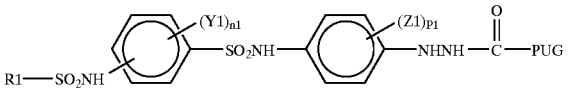

formula (2)

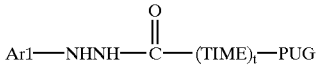

formula (3)

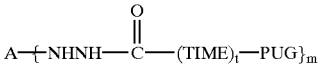

In the formula (1), (2), and (3), PUG represents a group to give a development inhibitor, TIME represents a timing group and t represents 0 or 1.

In the formula (1), R1 represents an aliphatic group, an aromatic group, or a heterocyclic group, and Y1 and Z1 each represent a substituent which is substitutable on a benzene ring, and n1 and p1 each represent an integer from 0 to 4.

In the formula (2), Ar1 represents an aryl group or an aromatic heterocyclic group. The group represented by Ar1 is substituted with at least one dissociating group directly or indirectly.

In the formula (3), A represents a connecting group, and m represents an integer from 2 to 6.

Next, the redox compound represented by the formula (1), (2), and (3) in the present invention will be explained in detail.

Examples of the development inhibitor given by the group represented by PUG in formula (1), (2), and (3) include known development inhibitors having a heteroatom and combined directly with —C(=O)-(TIME)$_t$—via the heteroatom. Specific examples of the development inhibitor may include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetrazaindenes, triazaindenes and mercaptoaryls. The development inhibitor represented by PUG is preferably a compound that restrains nuclei formation-infectious development. Specific examples of the compound include compounds having at least one or more nitro group or nitroso group, nitrogen-containing heterocyclic compounds such as pyridine, pyrazine, quinoline, quinoxaline and phenazine, and compounds adsorptive onto silver halide particles having an anionic charge group. Particularly, the compounds having a nitro group are preferable. These development inhibitors represented by PUG may have an optional substituent. More detailed explanations and specific examples concerning PUG include those described in Japanese Patent No. 2632056, page 11, column 22, line 38 to page 14, column 27, line 15, Japanese Patent No. 2676439, page 4, column 8, line 41 to page 5, column 10, line 10 and JP-A-9-269553, page 25, column 48, line 47 to page 26, column 50, line 17.

As the development inhibitor represented by PUG, benzimidazoles, indazoles, benzotriazoles, mercaptotetrazoles, mercaptobenzimidazoles, mercaptobenzothiazoles, mercaptobenzoxazoles, mercaptothiadiazoles, mercaptotriazoles and pyrazoles having a nitro group are preferred. Among them, indazoles are especially preferred.

The timing group represented by TIME in the formula (2) and (3) represents a divalent connecting group which can release the group represented by (TIME)$_t$-PUG by a hydrolysis reaction of a developer in succession after the compound represented by the formula (2) and (3) is oxidized during developing, and further can releases PUG from the group represented by (TIME)$_t$-PUG through reactions run in one or more stages.

Detailed explanations and specific examples concerning the timing group represented by TIME include in Japanese Patent No. 2632056, page 4, column 8, line 10 to page 11, column 22, line 35, Japanese Patent No. 2676439, page 4, column 7, line 39 to page 4, column 8, line 40 and JP-A-9-269553, page 47, column 47, line 45 to page 47, column 48, line 46.

As the timing group represented by TIME, timing groups represented by the formulae (T-1), (T-2) and (T-3) described in Japanese Patent No. 2632056 are preferable and the timing groups represented by the formula (T-1) are particularly preferable.

In the formula (2) and (3), t is more preferably 0.

R1 in the formula (1) represents an aliphatic group, an aromatic group, or a heterocyclic group. The aliphatic group is preferably a substituted or unsubstituted, straight chain, branched chain or cyclic alkyl group, alkenyl group, or alkynyl group, having 1 to 30 carbon atoms. It is preferable that the aromatic group is a monocyclic or condensed aryl group including, for example, a group composed of a benzene ring or a naphthalene ring.

The term "heterocyclic group" is employed to embrace a monocyclic or condensed, saturated or unsaturated, aromatic or non-aromatic heterocyclic group. Examples of the heterocyclic group include groups containing a pyridine, pyrimidine, imidazole, pyrazole, quinoline, iso quinoline, benzimidazole, thiazole, benzothiazole, piperidine and triazine rings. However, R1 does not have 4 or more of recurring units of the ethyleneoxy group. R1 is preferably the aryl group or the heterocyclic group, more preferably the aryl group.

The group represented by R1 may have optional substituents. In the present invention, examples of the optional substituent include a halogen atom (a fluorine atom, chlorine atom, bromine atom or iodine atom), alkyl group (including an aralkyl group, cycloalkyl group, active methine group and the like), alkenyl group, alkynyl group, aryl group, heterocyclic group, heterocyclic group containing a quaternary nitrogen atom (e.g., pyridinio group), acyl group, alkoxycarbonyl group, aryloxycarbonyl group, carbamoyl group, carboxy group or its salts, sulfonylcarbamoyl group, acylcarbamoyl group, sulfamoylcarbamoyl group, carbazoyl group, oxalyl group, oxamoyl group, cyano group, thiocarbamoyl group, hydroxy group, alkoxy group, aryloxy group, heterocyclic oxy group, acyloxy group, (alkoxy or aryloxy-)carbonyloxy group, carbamoyloxy group, sulfonyloxy group, amino group, (alkyl, aryl or heterocyclic)amino group, nitrogen-containing heterocyclic group substituted with N, acylamino group, sulfonamide group, ureido group, thioureido group, imide group, (alkoxy or aryloxy)carbonylamino group, sulfamoylamino group, semicarbazide group, thiosemicarbazide group, hydrazino group, quaternary ammonio group, oxamoylamino group, (alkyl or aryl)sulfonylureide group, acylureido group, acylsulfamoylamino group, nitro group, mercapto group, (alkyl, aryl or heterocyclic)thio group, (alkyl or aryl)sulfonyl group, (alkyl or aryl)sulfinyl group, sulfo group or its salts, sulfamoyl group, acylsulfamoyl group, sulfonylsulfamoyl group or its salts and groups containing a phosphoric acid amide or phosphate structure. These substituents may be further substituted with these substituents.

R1 in the formula (1) represents a phenyl, having at least one electron-attracting group as a substituent. The electron-attracting group means a substituent of which the Hammett's substituent constant σp has a positive value in the case of substituents disposed at the ortho or para position or a substituent of which the value σm has a positive value in the case of substituents disposed at the meta position. Here, specific examples of the substituent whose σp has a positive value include a halogen atom, acyl group, alkoxycarbonyl group, aryloxycarbonyl group, carbamoyl group, carboxyl group or its salts, cyano group, (alkyl or aryl)sulfonyl group, sulfo group or its salts, sulfamoyl group, nitro group, thioureido group, sulfonamide group, imide group and alkyl group substituted with plural halogen atoms (e.g., —$CF_3$ group). Examples of the substituent of which the value σm has a positive value include, besides the same groups as those given as examples of the substituent of which the value σp has a positive value, an acylamino group, ureido group, (alkoxy or aryloxy)carbonylamino group, sulfamoylamino group, (alkyl, aryl or heterocyclic)thio group, alkoxy group and aryloxy group.

In formula (1), when R1 represents a phenyl group substituted with at least one electron-withdrawing group, said electron-withdrawing group is preferably a halogen atom (especially chlorine), an alkoxycarbonyl group, a carbamoyl group, a sulfonamide group, a thioureido group, a sulfonyl group, a m-acylamino group and a m-ureido group.

Y1 and Z1 in the formula (1) represent substituents that are substitutable on a benzene ring. Examples of Y1 and Z1 include the same substituents as those which the above R1 may have. Preferable examples of $Y_1$ and $Z_1$ include the alkyl group, acylamino group, sulfonamide group, ureido group, sulfamoylamino group, imide group, thioureido group, phosphoric acid amide group, hydroxy group, alkoxy group, aryloxy group, acyloxy group, acyl group, alkoxycarbonyl group, aryloxycarbonyl group, (alkyl, aryl or heterocyclic)thio group, sulfamoyl group, halogen atom, cyano group, nitro group, and carbamoyl group. Further Preferable examples of $Y_1$ and $Z_1$ include the halogen atom, alkoxy group, aryloxy group, alkoxycarbonyl group, alkyl group, acylamino group, sulfonamide group, ureido group, and carbamoyl group.

n1 and $p_1$ in the formula (1) each represents an integer from 0 to 4. When $n_1$ and p1 respectively are 2 or more, plural Y1 and Z1 may respectively be the same or different.

$n_1$ is preferably an integer from 0 to 2, further preferably 0 or 1. p1 is preferably 0.

One of the preferable redox compounds represented by the formula (1) for use in the present invention includes a compound into which a ballast group, which is commonly used in immobile photographic additives such as a coupler, is incorporated. The ballast group in the present invention represents a straight-chain or branched alkyl (or alkylene), alkoxy(or alkylenoxy), alkylamino(or alkyleneamino) or alkylthio group, having 6 or more carbon atoms, or a group having these groups as a partial structure, and more preferably a straight-chain or branched alkyl (or alkylene), alkoxy(or alkyleneoxy), alkylamino(or alkyleneamino) or alkylthio group, having 7 or more but 24 or less carbon atoms, or a group having these groups as a partial structure.

Although the ballast group may be a substituent of any group of R1, Y1, Z1, and PUG in the formula (1), it is preferably a substituent of the group represented by Y1 or R1. More preferably, the group represented by R1 is substituted indirectly with the ballast group.

In formula (1), $R_1SO_2NH$— may bond to any substitution position on the benzene ring. However, m- or p- position of the sulfonamido group is preferred.

When Ar1 in the formula (2) represents an aryl group, the aryl group is a monocyclic or dicyclic aryl group, specifically, a phenyl group and a naphthyl group. When Ar1 represents an aromatic heterocyclic group, the aromatic heterocyclic group is a monocyclic or dicyclic aromatic heterocyclic group including at least one nitrogen atom, oxygen atom or sulfur atom. Specific examples of the aromatic heterocyclic group include groups having a pyridine ring, quinoline ring, isoquinoline ring, pyrrole ring, furan ring, thiophene ring, thiazole ring and indole ring.

The aryl or aromatic heterocyclic group represented by Ar1 in the formula (2) may have an optional substituent.

The group represented by Ar1 in the formula (2) is preferably an aryl group and more preferably a phenyl group.

The group represented by Ar1 in the formula (2) is substituted with at least one dissociating group directly or indirectly. Here, the dissociating group is a group or partial structure having a low acidic dissociating proton in an alkaline developer or its salts. Specific examples of the dissociating group include a carboxy group/(—COOH), sulfo group/(—$SO_3H$), phosphonic acid group/(—$PO_3H$), phosphoric acid group/(—$OPO_3H$—), —$SO_2NH_2$, —$CONHSO_2$—, —$CONHSO_2NH$—, —$NHCONHSO_2$—, —$SO_2NHSO_2$—, —CONHCO— and activated methylene group, or salts of these groups. However, a mercapto group (—SH), —NH— present in a nitrogen-containing heterocyclic group, —OH, and N— substituted sulfonamide group (—$SO_2NH$—) are excluded from the dissociating group. Here, the activated methylene group means a methylene or methine group sandwiched between two or three electron-attracting groups. The electron-attracting group is an atomic group of which the Hammett's substituent constant σp can have a positive value. Specific examples of the electron-attracting group include a carbonyl group, sulfonyl group, phosphonyl group, or groups including these atomic groups (e.g., an oxycarbonyl group, carbamoyl group, sulfamoyl group, and formyl group), imino group, cyano group and nitro group. Two of these electron-attracting groups may be combined to form a ring structure.

When the dissociating group represents a sulfo group or its salt, the group represented by Ar1 in the formula (2) never has a pyridinio group as a substituent. Also, when the dissociating group represents —COOH, it is necessary that t is 0, or the —COOH be connected to the Ar1 group via a sulfonamide group (—$SO_2NH$—) when t is 1.

In the present invention, examples of the salts of the dissociating group include salts comprising alkali metal ions, alkali earth metal ions, organic ammonium ions and organic phosphonium ions, such as a sodium cation, potassium cation, lithium cation, magnesium cation and tetrabutylammonium cation.

Among the compounds represented by the formula (2), more preferable compounds are represented by the following formula (2-a).

formula (2-a)

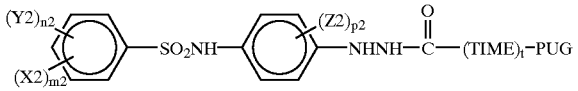

TIME, t and PUG in the formula (2-a) are the same as those in the formula (2) and each preferable range of them is also the same as that in the formula (2).

X2 represents a dissociating group or a substituent having at least one dissociating group. Y2 and Z2 respectively represent a substituent that can be substituted on a benzene ring. m2 represents an integer from 1 to 5 and n2 and p2 represent integers from 0 to 4, provided that the sum of m2 and n2 never exceeds 5. When m2, n2 or p2 is an integer of 2 or more, a plurality of X2, Y2 or Z2 may be the same or different. When the dissociating group represents a sulfo group (—$SO_3H$), or a salt thereof, the case where the group represented by X2 has a pyridinio group, as a substituent, is excluded. Y2 and Z2 in the formula (2-a) are the same meanings as Y1 and Z1 in the formula (1) respectively, and each preferable range of them is also the same as that in the formula (1).

In the formula (2-a), p2 is preferably 0, n2 is preferably 0 or 1 and m2 is preferably 1 or 2.

In the formula (2-a), X2 is preferably groups having the following dissociating group (or its salt). Specifically, preferable examples of X2 include groups having —O—L—COOH, —S—L—COOH, —CONH—L—COOH, —COO—L—COOH, —NHCO—L—COOH, —NHCONH—L—COOH, —NHCON(—L—COOH)$_2$, —NHCONR10—L—COOH, —$NHSO_2$—L—COOH, —NHP(=O) (O—L—COOH)$_2$, —$SO_2NH$—L—COOH, —L—COOH, —$SO_3H$, —O—L—$SO_3H$, —S—L—$SO_3H$, —CONH—L—$SO_3H$, —CONH—L—$SO_2NH_2$, —COO—L—$SO_3H$, —COO—L—$SO_2NH_2$, —NHCO—L—$SO_3H$, —NHCONH—L—$SO_3H$, —NHCONH—L—$SO_2NH_2$, —NHCON(—L—$SO_3H$)$_2$, —NHCONR10—L—$SO_3H$, —NHCONR10—L—$SO_2NH_2$, —$NHSO_2$—L—$SO_3H$, —NHP(=O)(O—L—$SO_3H$)$_2$, —$SO_2NH$—L—$SO_3H$, —L—$SO_3H$, —CONHCO—R10, —$CONHSO_2$—R10, —$CONHSO_2NH$—R10, —$NHCONHSO_2$—R10, —$NHSO_2NHSO_2$—R10, —$SO_2NHSO_2$—R10 or salts of these groups.

Here, L represents a divalent connecting group having at least one alkylene group (preferably 1 to 20 carbon atoms) or a phenylene group and may contain one of or a combination of —O—, —NR11—, —S—, —C(=O)—, —$SO_2$—, —C(=S)—, —SO— and —PO—. Also, L may have an optional substituent. These substituents may be dissociating groups. R10 represents a monovalent aliphatic group (preferably 1–20 carbon atoms), aromatic group (preferably 6 to 20 carbon atoms) or heterocyclic group (preferably five- to seven-membered rings having at least one nitrogen atom, sulfur atom or oxygen atom).

Preferably, R10 represents a monovalent substituted or unsubstituted alkyl group, a monovalent substituted or unsubstituted phenyl group, a monovalent substituted or unsubstituted heterocyclic group. R11 represents a hydrogen atom, monovalent aliphatic group (preferably 1–20 carbon atoms), monovalent aromatic group (preferably 6 to 20 carbon atoms) or monovalent heterocyclic group (preferably five- to seven-membered rings having at least one nitrogen atom, sulfur atom or oxygen atom), and preferably R11 represents a hydrogen atom.

More preferable examples of X2 in the formula (2-a) include groups having —O—L—COOH, —CONH—L—COOH, —COO—L—COOH, —NHCO—L—COOH, —NHCONH—L—COOH, —NHCONR10—L—COOH, —CONH—L—$SO_3H$, —COO—L—$SO_3H$, —NHCONH—L—$SO_3H$, —NHCONR10—L—$SO_3H$, —CONHCO—R10, —$CONHSO_2$—R10, —$CONHSO_2NH$—R10, —$NHCONHSO_2$—R10, —$NHSO_2NHSO_2$—R10, —$SO_2NHSO_2$—R10 or salts of these groups.

One of the preferable redox compounds represented by the formula (2) or (2-a) for use in the present invention includes a compound into which a ballast group which is commonly used in immobile photographic additives such as a coupler is incorporated.

Although the ballast group may be a substituent of any group of Ar1, TIME and PUG in the formula (2), it is preferably a substituent of the group represented by Ar1. More preferably, the ballast group is substituted on the group represented by Ar1 indirectly. Further more preferable is the case where at least one of the groups represented by X2 or Y2 is the ballast group or a group substituted with the ballast group.

The redox compound represented by the formula (2) or (2-a) and containing an (alkyl, aryl or heterocyclic)thio group is among those that may be preferably used in the present invention. When an (alkyl, aryl or heterocyclic)thio group is contained in the redox compound represented by the formula (2), the thio group is preferably substituted on the group represented by Ar1 directly or indirectly. More preferably, the (alkyl, aryl or heterocyclic)thio group is substituted on the group represented by X2 or Y2 in the formula (2-a).

The connecting group represented by A in the formula (3) shows m-valent connecting groups comprising singly or in combinations of, groups such as an alkylene group (preferably 1 to 20 carbon atoms), arylene group (preferably 6 to 20 carbon atoms), heterocyclic group (preferably five- to seven-membered ring having at least one nitrogen atom, sulfur atom or oxygen atom, which may be a condensate), single bond, —O—, —NR12—, —S—, —C(=O)—, —$SO_2$—, —C(=S)—, —SO—and —PO—. Here, R12 represents a hydrogen atom, monovalent aliphatic group (preferably 1 to 20 carbon atoms), monovalent aromatic group (preferably 6 to 20 carbon atoms) or monovalent heterocyclic group (preferably five- to seven-membered ring having at least one nitrogen atom, sulfur atom or oxygen atom). The connecting group represented by A may have an optional substituent.

The connecting group represented by A in the formula (3) is preferably a connecting group having at least two arylene groups, and more preferably a connecting group at least two arylene groups and at least two sulfonamide groups. A connecting group having at least three arylene groups and at least two sulfonamide groups is most preferable. In the formula (3), m represents a integer of 2 to 6, and m is preferably 2.

Among the compounds represented by the formula (3), more preferable compounds are represented by the following formula (3-a) or (3-b).

formula (3-a)

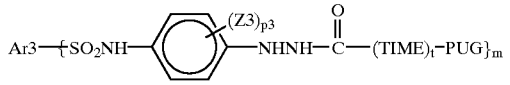

formula (3-b)

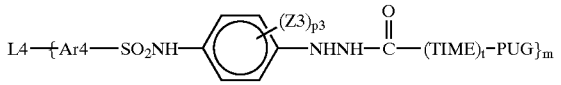

In the formula (3-a) and (3-b), Ar3 and Ar4 respectively represent an aromatic or aromatic heterocyclic group. Ar3 is an m-valent group and Ar4 is a divalent group. L4 represents an m-valent connecting group.

In the formula (3-a) and (3-b), TIME, t, PUG and m have the same meanings as those in the formula (3) and each preferable range is also the same. Z3 represents a substituent and p3 represents an integer from 0 to 4.

In the formula (3-a) and (3-b) Z3 have the same meanings as those in the formula (1) and each preferable range is also the same. p3 is preferably 1 or 0 and more preferably 0.

In the formula (3-a), as the aromatic group or aromatic heterocyclic group represented by Ar3, a phenylene group, naphthylene group or six- or five-membered aromatic heterocyclic group (specifically, groups having a pyridine ring, pyrimidine ring, triazine ring, quinoline ring, isoquinoline ring or the like) is preferable. Ar3 is particularly preferably a phenylene group or a naphthylene group.

As Ar4 in the formula (3-b), a phenylene group is particularly preferable.

The m-valent connecting group represented by L4 in the formula (3-b) shows connecting groups comprising singly, or in combinations, groups such as an alkylene group, arylene group, polyvalent heterocyclic group, single bond, —O—, —NR13—, —S—, —C(═O)—, —$SO_2$—and —C(═S)—. Here, R13 represents a hydrogen atom, monovalent aliphatic group or monovalent aromatic group.

When L4 includes an arylene group, a phenylene group or a naphthylene group is preferable as the arylene group. Also, when L4 includes a polyvalent heterocyclic group, the heterocyclic group may be an aromatic or non-aromatic heterocyclic group, specifically, a nitrogen-containing heterocyclic group containing a quaternary nitrogen atom such as a pyridinio group. Specific examples of the heterocyclic group include 1,4-dioxane ring, piperazine ring, 2,4,8,10-tetraoxaspiro-(5,5)undecane ring, biphthalimide ring, 1,2,4,5-benzenetetracarboxydiimide ring, triazine ring and pyridine ring. Also, when L4 has an alkylene group, the alkylene group may be a cycloalkylene group. Examples of the cycloalkylene group include groups including a cyclopropane ring, cyclohexane ring, bicyclohexane ring, decaline ring, or norbornane ring. L4 may have an optional substituent.

A particularly preferable L4 in the formula (3-b) is an m-valent connecting group having at least one alkylene group, arylene group, divalent heterocyclic group or single bond.

The redox compound represented by the formula (3) may be those into which the same ballast group or polymer as the ballast group or polymer which may be commonly used in immobile photographic additives such as a coupler. The ballast group in the formula (3) is preferably substituted on the group represented by A directly or indirectly. Further, in the formula (3-a) or (3-b), the ballast group is preferably substituted on Ar3 or Ar4 directly or indirectly. Examples of the polymer include those described in JP-A-1-100530, etc.

The redox compound represented by the formula (1), (2), or (3) may contain an adsorptive group that adsorbs onto the silver halide. Examples of the adsorbing group include an alkylthio group, an arylthio group, a thiourea group, a thioamide group, a mercapto heterocyclic group, and a triazole group, described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246. Further, these groups capable of being adsorbed onto the silver halide may be modified into a precursor thereof. Examples of the precursor include those groups described in JP-A-2-285344.

The redox compound represented by the formula (1), (2), or (3) may contain a cationic group (specifically, for example, a group containing a quaternary ammonio group, group containing a quaternary phosphorus atom or a nitrogen-containing heterocyclic group containing a quaternary nitrogen atom), group containing a repeating unit of an ethyleneoxy group or a propyleneoxy group or (alkyl, aryl or heterocyclic)thio group. Examples of the compounds containing these groups include those described, for example, in JP-A-7-234471, JP-A-5-333466, JP-A-6-19032, JP-A-6-19031, JP-A-5-45761, U.S. Pat. Nos. 4,994,365 and 4,988,604, JP-A-7-259240, JP-A-7-5610, JP-A-7-244348, and German Patent No. 4006032.

Specific examples of the redox compounds for use in the present invention are shown below. However, these compounds are not intended to be limiting of the present invention.

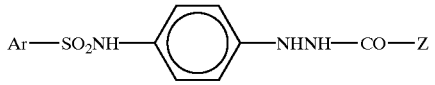

| No. | Ar = | Z = |
|---|---|---|
| 1 | 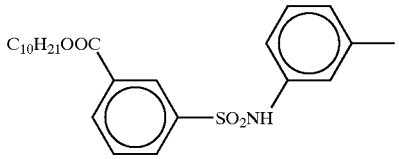 | 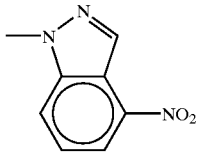 |
| 2 | 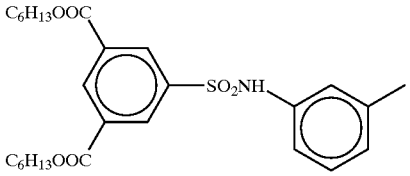 | 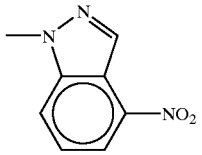 |

-continued
3
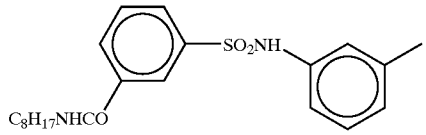
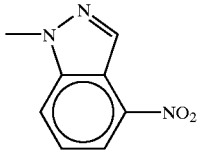
4
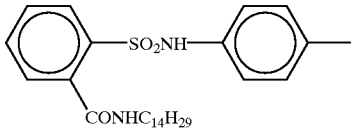
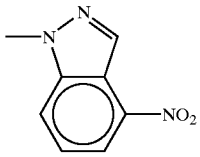
5
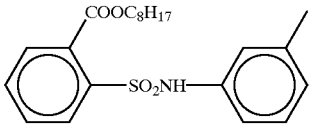
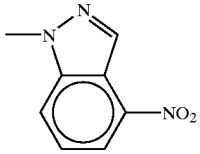
6
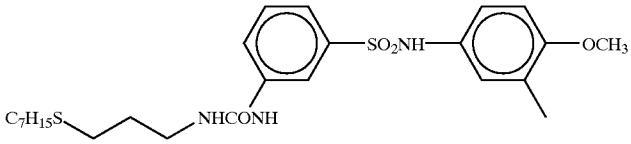
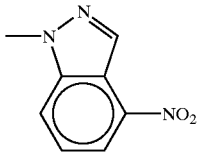
7
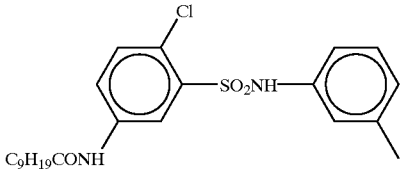
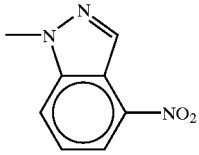
8
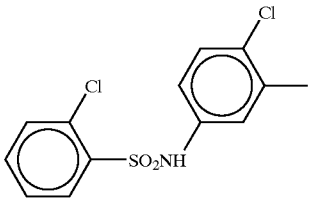
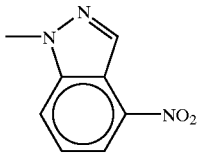
9
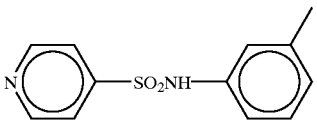
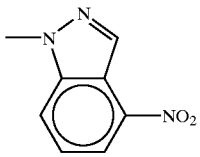
10
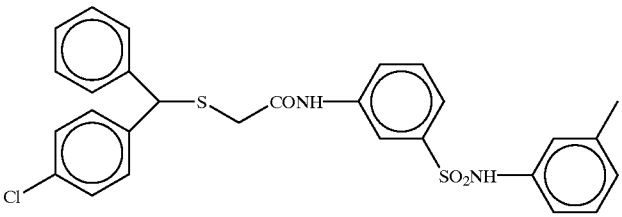
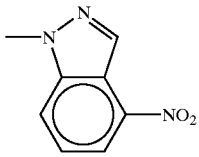

-continued
| | | |
|---|---|---|
| 11 | 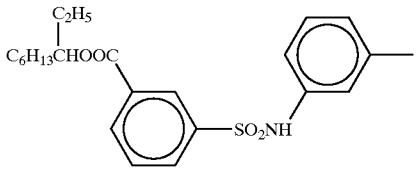 | 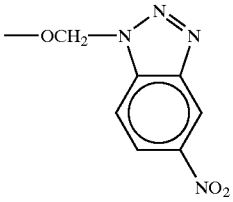 |
| 12 | 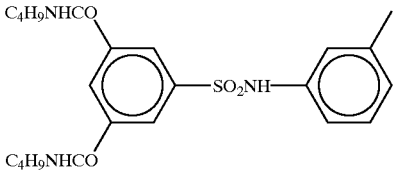 | 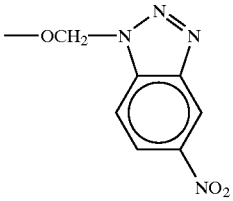 |
| 13 | 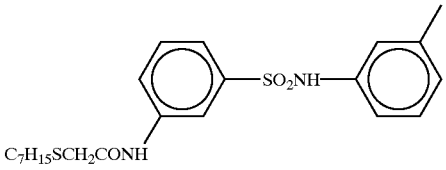 | 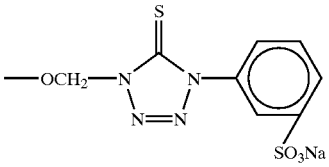 |
| 14 | 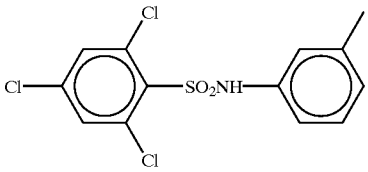 | 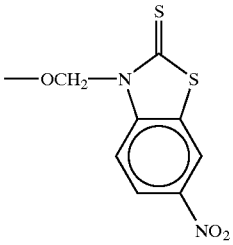 |
| 15 | 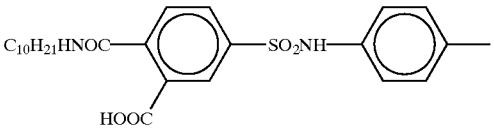 | 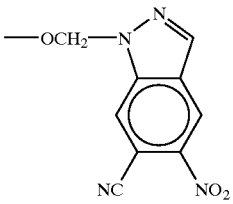 |
| 16 | 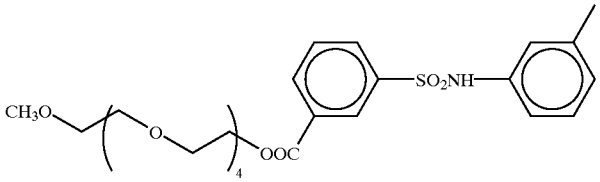 | 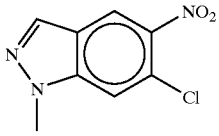 |
| 17 | 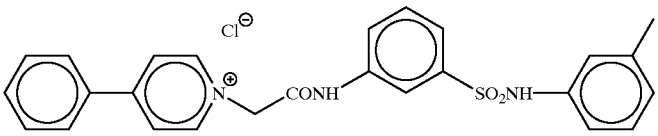 | 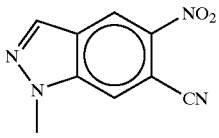 |
| 18 | 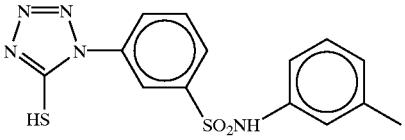 | 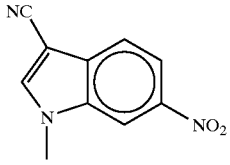 |

-continued
| | | |
|---|---|---|
| 19 | 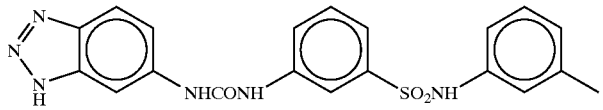 | 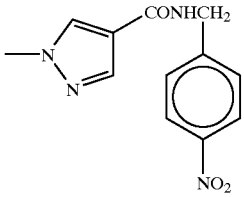 |
| 20 | 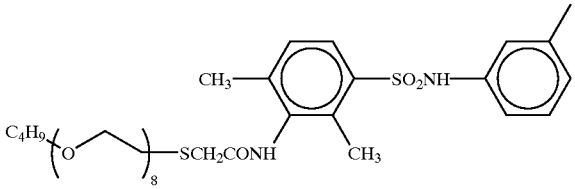 | 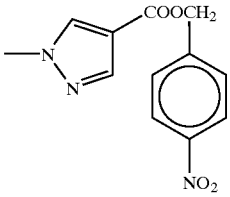 |
| 21 | 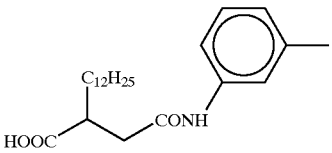 | 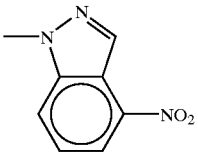 |
| 22 | 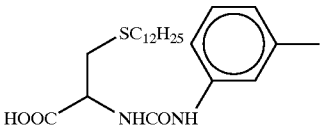 | 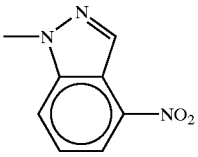 |
| 23 | 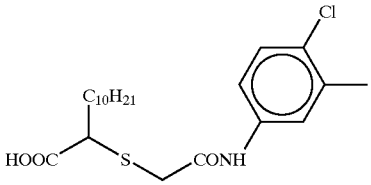 | 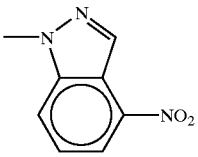 |
| 24 | 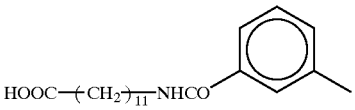 | 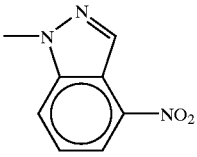 |
| 25 | 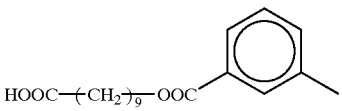 | 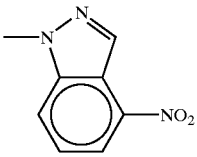 |
| 26 | 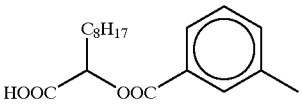 | 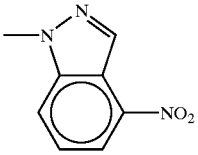 |
| 27 | 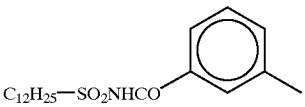 | 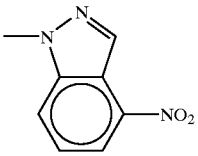 |

-continued
28
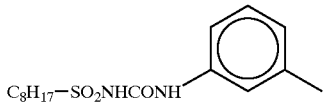
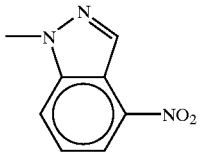
29
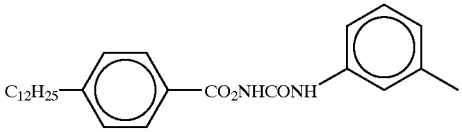
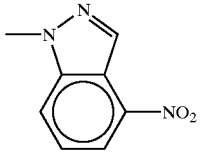
30
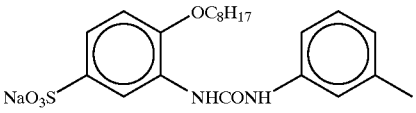
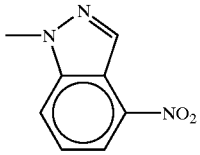
31
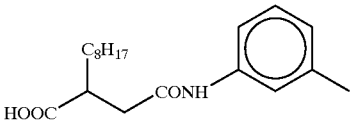
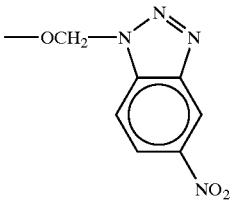
32
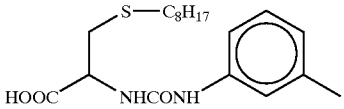
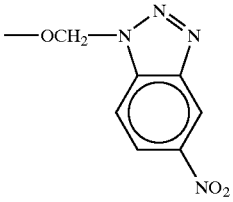
33
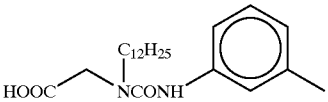
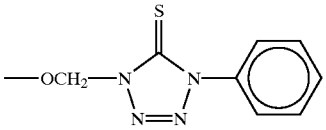
34
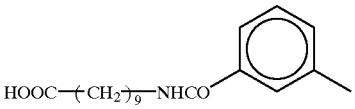
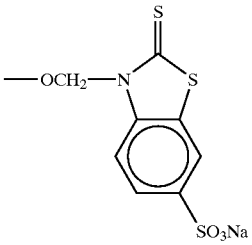
35
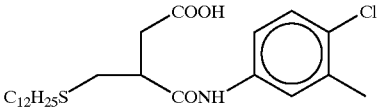
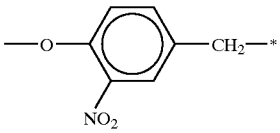
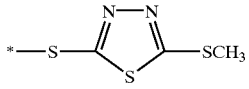

-continued
| | | |
|---|---|---|
| 36 | 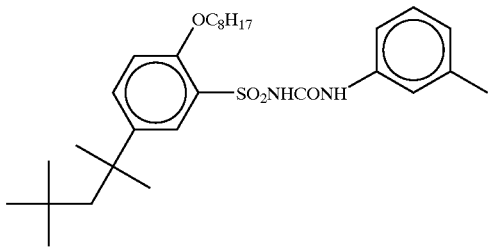 | 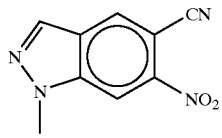 |
| 37 | 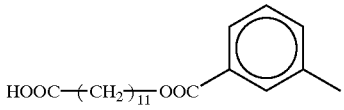 | 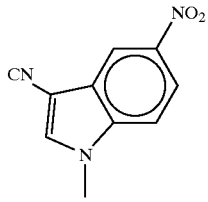 |
| 38 | 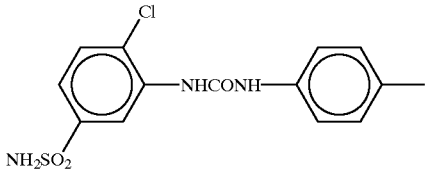 | 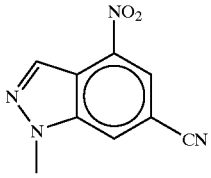 |
| 39 | 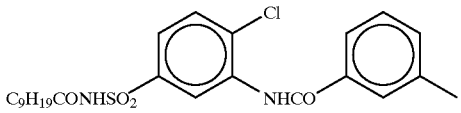 | 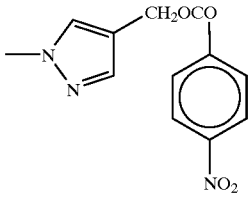 |
| 40 | 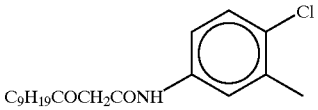 | 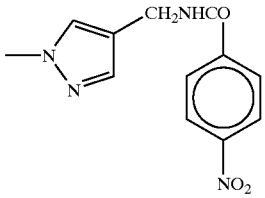 |
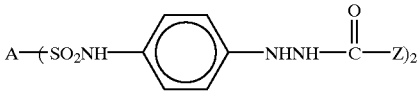
| No. | A = | Z = |
|---|---|---|
| 41 | 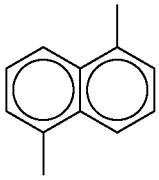 | 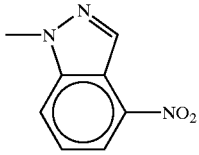 |
| 42 | 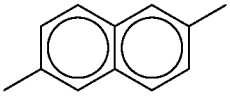 | 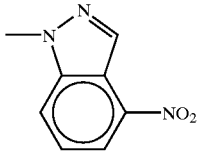 |

-continued
| | | |
|---|---|---|
| 43 | 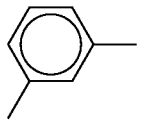 | 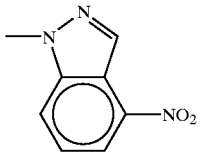 |
| 44 | 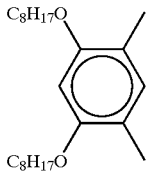 | 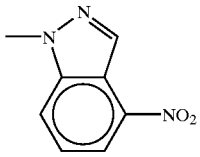 |
| 45 | 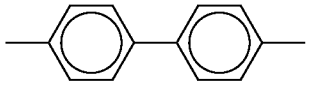 | 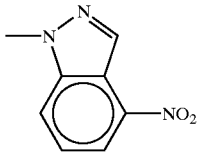 |
| 46 | 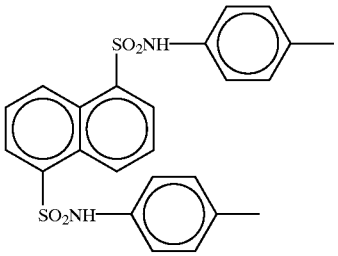 | 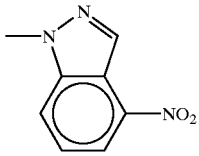 |
| 47 | 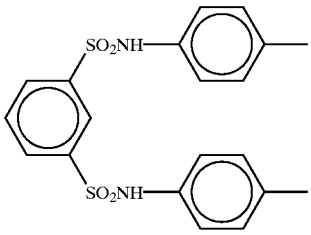 | 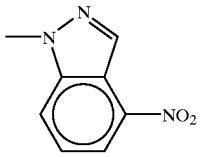 |
| 48 | 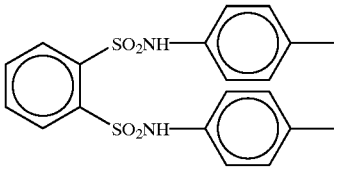 | 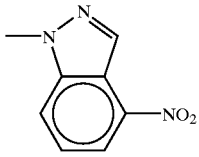 |
| 49 | 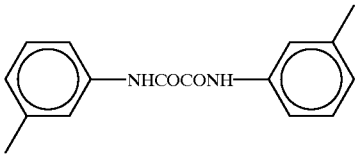 | 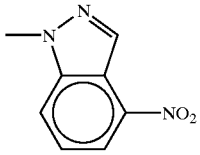 |
| 50 | 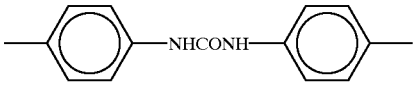 | 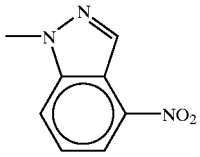 |

-continued
51
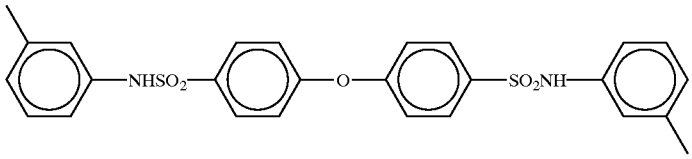
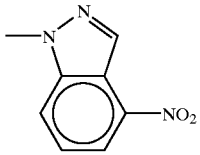
52
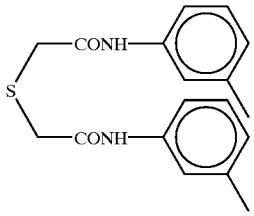
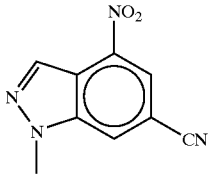
53
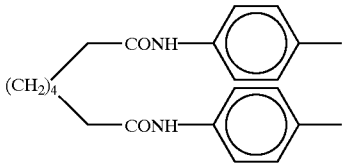
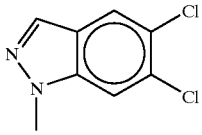
54
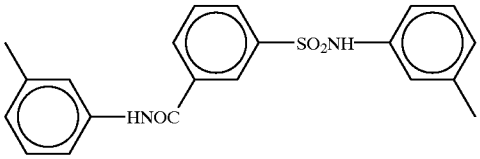
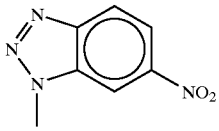
55
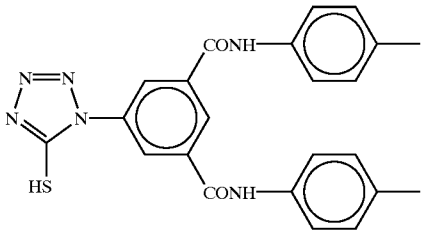
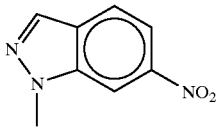
56
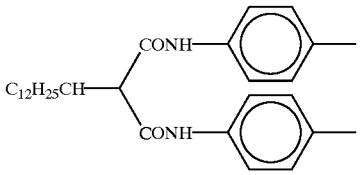
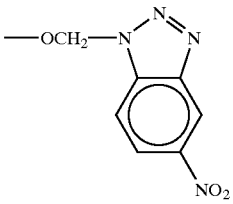
57
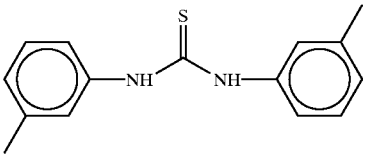
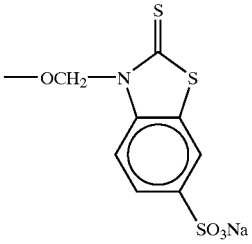

-continued
58
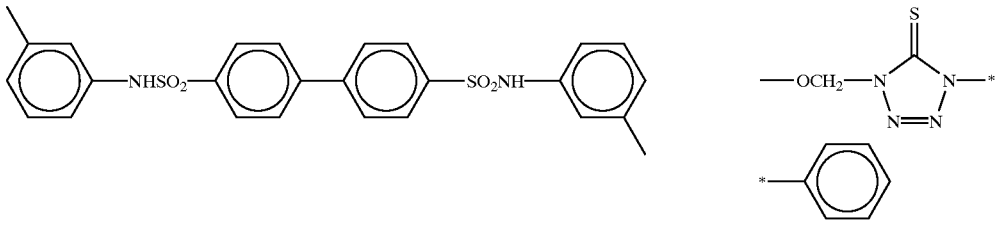
59
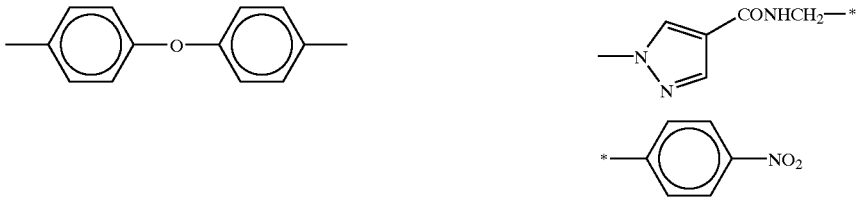
60
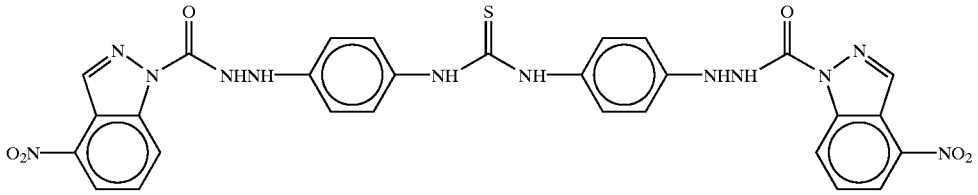
61
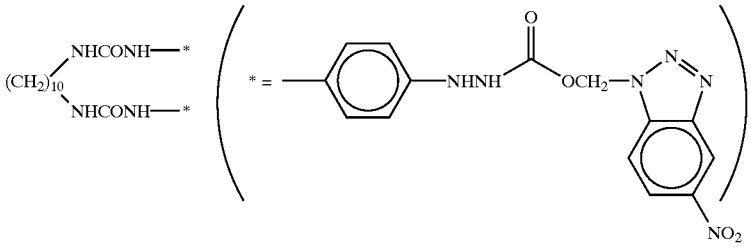
62
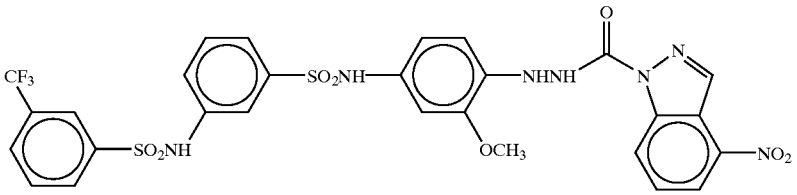
63
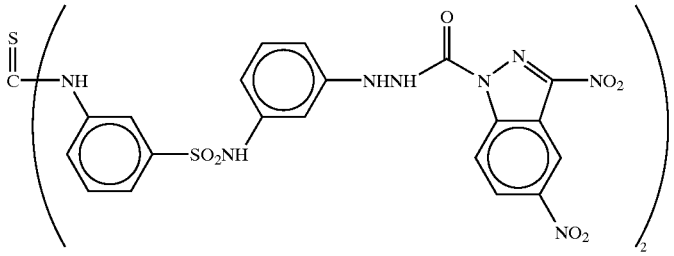
64
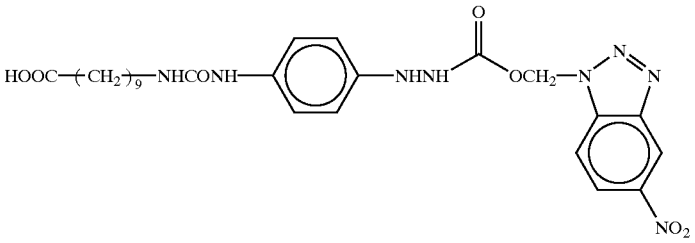

-continued

65

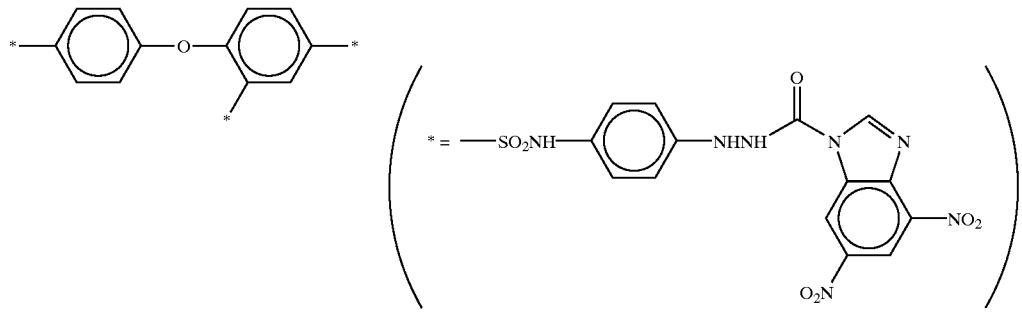

66

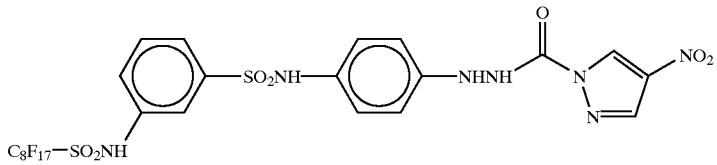

67

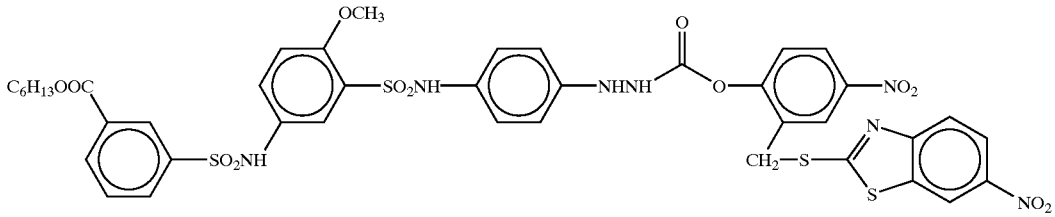

68

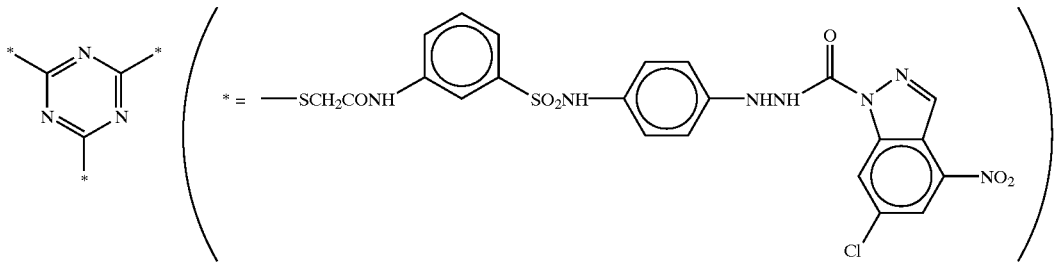

69

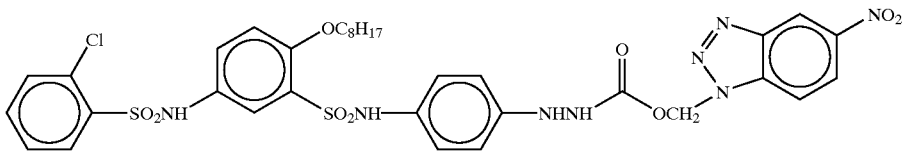

70

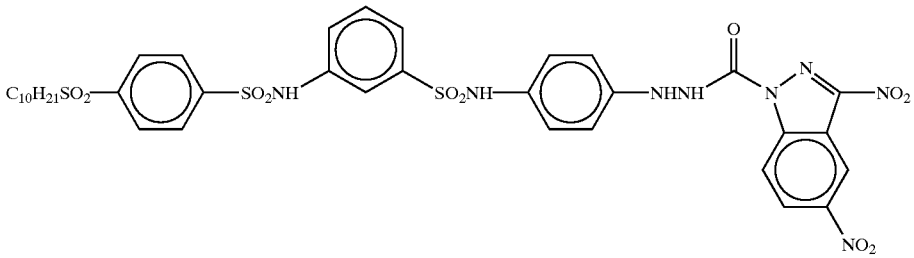

The redox compounds for use in the present invention can be easily synthesized by a known method. With regard to these synthetic methods may be synthesized on referring to, for example, the methods described in Japanese Patent No. 2632056 and Japanese Patent No. 2725088.

In the present invention, the redox compounds are each used in an amount ranging from $1\times10^{-6}$ to $5\times10^{-2}$ mol and more preferably from $1\times10^{-5}$ to $1\times10^{-2}$ mol based on 1 mol of silver halide in all emulsion contained in the light-sensitive material. Also, two or more redox compounds may be used together. In the present invention, each of the redox compounds may be dissolved in a proper water-miscible organic solvent, for example, alcohols (methanol, ethanol, propanol or fluorinated alcohol), ketones (acetone or methyl ethyl ketone), dimethylformamide, dimethyl sulfoxide or methyl cellosolve upon use.

The redox compound may be used in the form of an emulsified dispersion produced mechanically by dissolving it by using an auxiliary solvent such as dibutyl phthalate, tricresyl phosphate, oils such as glyceryl triacetate and diethyl phthalate, ethyl acetate or cyclohexanone according to a conventionally well-known emulsion dispersion method. Alternatively, a powder of the redox compound can be dispersed in water by using a ball mill, colloid mill or ultrasonic waves according to a method known as the solid dispersion method upon use.

In the present invention, the redox compounds are added to a silver halide emulsion layer or other hydrophilic colloidal layers. The redox compound may also be added to at least one of plural silver halide emulsion layers.

Several examples of the structure will be shown below. However, the present invention is not limited to these examples.

Structure Example 1

This structure has a silver halide emulsion layer containing the above redox compound and a protective layer on a support. The emulsion layer or the protective layer may contain the above-described hydrazine derivative as a nucleating agent.

Structure Example 2

This structure has a first silver halide emulsion layer and a second silver halide emulsion layer in this order on a support. The first silver halide emulsion layer or a hydrophilic colloidal layer adjacent thereto contains the hydrazine derivative, and the second silver halide emulsion layer or a hydrophilic colloidal layer adjacent thereto contains the redox compound.

Structure Example 3

This structure is the same as the Structure example 2) except that the order of two emulsion layers are reversed.

In the Structure examples 2) and 3), an intermediate layer containing a gelatin or a synthetic polymer (e.g., a polyvinyl acetate or a polyvinyl alcohol) may be provided between two light-sensitive emulsion layers.

Structure Example 4

This structure has a silver halide emulsion layer containing the hydrazine derivative on a support and a hydrophilic colloidal layer containing the redox compound either on the emulsion layer or between the support and the silver halide emulsion layer.

A particularly preferable structure is the Structure example 2) or 3).

No particular limitation is imposed on the silver halide of the silver halide emulsion for use in the silver halide photographic light-sensitive material of the present invention. As the silver halide, although silver chloride, silver chlorobromide, silver bromide, silver chlorobromoiodide or silver bromoiodide may be used, silver chlorobromide or silver chlorobromoiodide containing 50 mol % or more of silver chloride is preferable. The silver halide particle may have any form, e.g., a cubic, tetradecahedron, octahedron, undefined shape and plate shape with a cubic being desirable. The average particle diameter of the silver halide is preferably 0.1 $\mu$m to 0.7 $\mu$m and more preferably 0.1 to 0.5 $\mu$m. Silver halide particles whose coefficient of variation given by the formula {(standard deviation of particle diameter)/(average particle diameter)}×100 is generally 15% or less and preferably 10% or less and the silver halide particles having a narrow distribution of particle diameter are preferred.

The silver halide particle may have a structure in which the inside and the surface are made of either uniform phases or different phases. The silver halide particle may also have a localized layer different in halogen composition in the inside or on the surface of the particle.

The photographic emulsion for use in the present invention can be prepared using methods described, for example, by P. Glafkides, in *Chimie et Physiaue Photographique,* Paul Montel (1967); by G. F. Duffin, in *Photographic Emulsion Chemistry,* The Focal Press (1966); and by V. L. Zelikman et al., in *Making and Coating Photographic Emulsion,* The Focal Press (1964).

More specifically, either an acid process or a neutral process may be used. Further, a method of reacting a soluble silver salt and a soluble halogen salt may be carried out by any of a single jet method, a double jet method, and a combination thereof. A method of forming particles in the presence of excessive silver ion (the so-called reverse-mixing method) may also be used.

As one form of the double jet method, a method of maintaining the pAg constant in the liquid phase where silver halide is produced, namely, a so-called controlled double jet method, may be used. Further, it is preferred to form particles using a so-called silver halide solvent, such as ammonia, thioether, or tetra-substituted thiourea, more preferably using a tetra-substituted thiourea compound, and this is described in JP-A-53-82408 and JP-A-55-77737. Preferred examples of the thiourea compound include tetramethylthiourea and 1,3-dimethyl-2-imidazolidinethione. The amount of silver halide solvent added varies depending on the kind of the compound used or the particle size and the halogen composition expected, but it is preferably from $10^{-5}$ to $10^{-2}$ mol per mol of silver halide.

According to the controlled double jet method or the method of forming particles using a silver halide solvent, a silver halide emulsion comprising particles having a regular crystal form and a narrow particle size distribution can be easily prepared. These methods are useful means for preparing the silver halide emulsion for use in the present invention. In order to render the particle size uniform, it is preferred to rapidly grow particles within the range not exceeding the critical saturation degree, using a method of changing the addition rate of silver nitrate or alkali halide according to the particle growth rate, as described in British Patent No. 1,535,016, JP-B-48-36890, and JP-B-52-16364, or a method of changing the concentration of the aqueous solution, as described in British Patent No. 4,242,445 and JP-A-55-158124.

The silver halide emulsion for use in the present invention may contain a metal that belongs to the group VIII. It is especially preferred that a light-sensitive material suitable for a high intensity exposure such as a scanner exposure and a light-sensitive material for a line image photographing each contain such a metal compound as a rhodium compound, an iridium compound and a ruthenium compound, to thereby attain a high contrast and a low fog.

Meanwhile, the silver halide particles are advantageously doped with a metal complex hexacyanide such as $K_4[Fe(CN)_6]$, $K_4[Ru(CN)_6]$ or $K_3[Cr(CN)_6]$.

As a rhodium compound for use in the present invention, a water-soluble rhodium compound can be used. Examples of the rhodium compound include rhodium (III) halide compounds, or rhodium coordination complex salts having a halogen atom, amines, oxalato, or aqua, etc., as a ligand, such as a hexachloro rhodium (III) complex salt, a pentachloroaqua rhodium (III) complex salt, a tetrachlorodiaqua rhodium (III) complex salt, a hexabromo rhodium (III) complex salt, a hexamine rhodium (III) complex salt, and a trioxalato rhodium (III) complex salt. The above-described rhodium compound is dissolved in water or an appropriate solvent before use, and a method generally, commonly used for stabilizing a solution of the rhodium compound, namely, a method of adding an aqueous solution of hydrogen halogenide (e.g. hydrochloric acid, hydrobromine acid, hydrofluoric acid) or an alkali halide (e.g. KCl, NaCl, KBr, NaBr), may be used. It is also possible to add and dissolve separately prepared silver halide particles that are previously doped with rhodium, in place of a water-soluble rhodium compound, at the preparation of silver halide.

A rhenium, ruthenium, and osmium for use in the present invention can be added in the form of water-soluble complex salts of them, described in JP-A-63-2042, JP-A-1-285941, JP-A-2-20852, and JP-A-2-20855, etc. Among these, particularly preferred are hexa-coordination metal complexes represented by the following formula:

$$[ML_6]^{n-}$$

wherein M represents Ru, Re, or Os; L represents a ligand, and n represents 0, 1, 2, 3, or 4. A counter ion for the above-described complex may be any cation. Examples of the counter ion include an ammonium ion and an alkali metal ion. Further, preferable examples of the ligand include a halide ligand, a cyanide ligand, a cyanate ligand, a nitrosyl ligand, and a thionitrosyl ligand. Specific examples of the complex for use in the present invention are illustrated below, but they are not intended to limit the scope of the invention.

| | | |
|---|---|---|
| $[ReCl_6]^{3-}$ | $[ReBr_6]^{3-}$ | $[ReCl_5(NO)]^{2-}$ |
| $[Re(NS)Br_5]^{2-}$ | $[Re(NO)(CN)_5]^{2-}$ | $[Re(O)_2(CN)_4]^{2-}$ |
| $[RuCl_6]^{3-}$ | $[RuCl_4(H_2O)_2]^{1-}$ | $[RuCl_5(NO)]^{2-}$ |
| $[RuBr_5(NS)]^{2-}$ | $[Ru(CO)_3Cl_3]^{2-}$ | |
| $[Ru(CO)Cl_5]^{2-}$ | $[Ru(CO)Br_5]^{2-}$ | |
| $[OsCl_6]^{3-}$ | $(OsCl_5(NO)]^{2-}$ | $[Os(NO)(CN)_5]^{2-}$ |
| $[Os(NS)Br_5]^{2-}$ | $[Os(CN)_6]^{4-}$ | $[Os(O)_2(CN)_4]^{4-}$ |

The addition amount of these compounds is preferably from $1\times10^{-9}$ mol to $1\times10^{-5}$ mol, and especially preferably from $1\times10^{-8}$ mol to $1\times10^{-6}$ mol, per mol of silver halide.

Examples of the iridium compound for use in the present invention include hexachloro iridium, hexabromo iridium, hexaammine iridium, and pentachloro nitrosyl iridium. Examples of the iron compound for use in the present invention include potassium hexacyano ferrate (II) and ferrous thiocyanate.

The silver halide emulsion for use in the present invention is preferably subjected to chemical sensitization. The chemical sensitization may be performed using a known method, such as sulfur sensitization, selenium sensitization, tellurium sensitization, or noble metal sensitization, and these sensitization methods may be used individually or in combination. When these sensitization methods are used in combination, a combination of sulfur sensitization and gold sensitization; a combination of sulfur sensitization, selenium sensitization, and gold sensitization; and a combination of sulfur sensitization, tellurium sensitization, and gold sensitization, are preferred.

The sulfur sensitization for use in the present invention is usually performed by adding a sulfur sensitizer and stirring the emulsion at a high temperature of 40° C. or higher for a predetermined time. The sulfur sensitizer to be used may be a known compound, and examples thereof include, in addition to the sulfur compound contained in gelatin, various sulfur compounds, such as thiosulfates, thioureas, thiazoles, and rhodanines. Preferred sulfur compounds are a thiosulfate and a thiourea compound. The addition amount of the sulfur sensitizer varies depending on various conditions, such as the pH and the temperature at the time of chemical ripening and the size of silver halide particles, but it is preferably from $10^{-7}$ to $10^{-2}$ mol, more preferably from $10^{-5}$ to $10^{-3}$ mol, per mol of silver halide.

The selenium sensitizer for use in the present invention may be a known selenium compound. The selenium sensitization is generally performed by adding a labile and/or non-labile selenium compound and stirring the emulsion at a high temperature of 40° C. or higher for a predetermined time. Examples of the labile selenium compound include the compounds described in JP-B-44-15748, JP-B-43-13489, JP-A-4-109240, JP-A-4-324855, and among these, particularly preferred are the compounds represented by formula (VIII) or (IX) of JP-A-4-324855.

The tellurium sensitizer for use in the present invention is a compound for forming silver telluride, which is presumed to become a sensitization nucleus, on the surface of or inside a silver halide particle. The formation rate of silver telluride in a silver halide emulsion can be examined according to a method described in JP-A-5-313284.

Specific examples of the tellurium sensitizer to be used include the compounds described in U.S. Pat. Nos. 1,623,499, 3,320,069, and 3,772,031, British Patent Nos. 235,211, British Patent Nos. 1,121,496, British Patent Nos. 1,295,462, and British Patent Nos. 1,396,696, Canadian Patent No. 800,958, JP-A-4-204640, JP-A-4-271341, JP-A-4-333043, JP-A-5-303157, *J. Chem. Soc. Chem. Commun.,* 635(1980); ibid., 1102 (1979); ibid., 645 (1979); *J. Chem. Soc. Perkin. Trans.,* 1, 2191 (1980); S. Patai (compiler), *The Chemistry of Organic Serenium and Tellunium Compounds,* Vol. 1 (1986); and ibid., Vol. 2 (1987). The compounds represented by formulae (II), (III), and (IV) of JP-A-4-324855 are particularly preferred.

The amount to be used of the selenium sensitizer or the tellurium sensitizer for use in the present invention varies depending on the silver halide particles used or the chemical ripening conditions, but it is generally from in the order of $10^{-8}$ to $10^{-2}$ mol, preferably from $10^{-7}$ to $10^{-3}$ mol, per mol of silver halide. The conditions of chemical sensitization in the present invention are not particularly restricted, but the pH is generally from 5 to 8, the pAg is generally from 6 to 11, preferably from 7 to 10, and the temperature is generally from 40 to 95° C., preferably from 45 to 85° C.

Examples of the noble metal sensitizer for use in the present invention include gold, platinum, palladium, and iridium, and gold sensitization is particularly preferred. Specific examples of the gold sensitizer for use in the present invention include chloroauric acid, potassium chloroaurate, potassium auric thiocyanate, and gold sulfide. The gold sensitizer can be used in an amount of approximately from $10^{-7}$ to $10^{-2}$ mol per mol of silver halide.

In the silver halide emulsion for use in the present invention, a cadmium salt, a sulfite, a lead salt, or a thallium salt may be present together during formation or physical ripening of silver halide particles.

In the present invention, reduction sensitization may be used. Examples of the reduction sensitizer to be used include stannous salts, amines, formamidinesulfinic acid, and silane compounds.

To the silver halide emulsion for use in the present invention, a thiosulfonic acid compound may be added, according to the method described in European Unexamined Patent Publication (EP)-293,917.

As the silver halide emulsion in the light-sensitive material used in the present invention, only one type may be used or two or more types (for example, those different in average particle size, in halogen composition, in crystal habit or in the condition of chemical sensitization) may be used together. To obtain, particularly, high contrast, it is preferable to apply an emulsion with a higher sensitivity as the emulsion is closer to a support as described in JP-A-6-324426.

Although the light-sensitive silver halide emulsion for use in the present invention may be spectrally sensitized to blue light, green light, red light or infrared light having relatively long wavelengths, by a sensitizing dye preferably it is spectrally sensitized by a spectrally sensitizing dye having a maximum absorption wavelength ranging from 450 nm to 600 nm. As the sensitizing dye, the compounds of the formula [I] described in JP-A-55-45015 and the compounds of the formula [I] described in JP-A-9-160185 are preferable and the compounds of the formula [I] described in JP-A-9-160185 are particularly preferable. Specific examples include the compounds (1) to (19) described in JP-A-55-45015 and the compounds (I-1) to (I-40) and (I-56) to (I-85) described in JP-A-9-160185.

Examples of the sensitizing dye that can be used also include a cyanine dye, a merocyanine dye, a complex cyanine dye, a complex merocyanine dye, a holopolar cyanine dye, a styryl dye, a hemicyanine dye, an oxonol dye, and a hemioxonol dye.

Useful sensitizing dyes for use in the present invention are described, for example, in *Research Disclosure,* Item 17643, IV-A (December, 1978, page 23); ibid., Item 18341 X (August 1979, page 437), and publications cited therein.

In particular, sensitizing dyes having spectral sensitivity suitable for spectral characteristics of various light sources in a scanner, an image setter, or a photomechanical camera, can be advantageously selected.

For example, A) for an argon laser light source, Compounds (I)-1 to (I)-8 described in JP-A-60-162247, Compounds I-1 to I-28 described in JP-A-2-48653, Compounds I-1 to I-13 described in JP-A-4-330434, Compounds of Examples 1 to 14 described in U.S. Pat. No. 2,161,331, and Compounds 1 to 7 described in West Germany Patent No. 936,071; B) for a helium-neon laser light source, Compounds I-1 to I-38 described in JP-A-54-18726, Compounds I-1 to I-35 described in JP-A-6-75322, and Compounds I-1 to I-34 described in JP-A-7-287338; C) for an LED light source, Dyes 1 to 20 described in JP-B-55-39818, Compounds I-1 to I-37 described in JP-A-62-284343, and Compounds I-1 to I-34 described in JP-A-7-287338; D) for a semiconductor laser light source, Compounds I-1 to I-12 described in JP-A-59-191032, Compounds I-1 to I-22 described in JP-A-60-80841, Compounds I-1 to I-29 described in JP-A-4-335342, and Compounds I-1 to 1-18 described in JP-A-59-192242; and E) for a tungsten or xenon light source of a photomechanical camera, besides the above-described compounds, Compounds I-41 to I-55 and I-86 to I-97 described in JP-A-9-160185, Compounds 4-A to 4-S, 5-A to 5-Q, and 6-A to 6-T described in JP-A-6-242547, may be advantageously selected.

These sensitizing dyes may be used individually or in combination, and a combination of sensitizing dyes is often used for the purpose of, particularly, supersensitization. In combination with the sensitizing dye, a dye which itself has no spectral sensitization effect, or a material that absorbs substantially no visible light, but that exhibits supersensitization, may be incorporated into the emulsion.

Useful sensitizing dyes, combinations of dyes that exhibit supersensitization, and materials that show supersensitization are described, for example, in *Research Disclosure,* Vol. 176, 17643, page 23, Item IV-J (December 1978); JP-B-49-25500, JP-B-43-4933, JP-A-59-19032, and JP-A-59-192242.

The sensitizing dyes for use in the present invention may be used in a combination of two or more thereof. The sensitizing dye may be added to a silver halide emulsion by dispersing it directly in the emulsion, or by dissolving it in a sole or mixed solvent of such solvents of water, methanol, ethanol, propanol, acetone, methyl cellosolve, 2,2,3,3-tetrafluoropropanol, 2,2,2-trifluoroethanol, 3-methoxy-l-propanol, 3-methoxy-1-butanol, 1-methoxy-2-propanol or N,N-dimethylformamide, and then adding the solution to the emulsion.

Alternatively, the sensitizing dye may be added to the emulsion by a method disclosed in U.S. Pat. No. 3,469,987, in which a dye is dissolved in a volatile organic solvent, the solution is dispersed in water or a hydrophilic colloid, and the dispersion is added to the emulsion; a method disclosed, for example, in JP-B-44-23389, JP-B-44-27555, and JP-B-57-22091, in which a dye is dissolved in an acid, and the solution is added to the emulsion, or a dye is formed into an aqueous solution in the co-existence of an acid or base and then it is added to the emulsion; a method disclosed, for example, in U.S. Pat. Nos. 3,822,135 and 4,006,025, in which a dye is formed into an aqueous solution or a colloid dispersion in the presence of a surface-active agent together, and the solution or dispersion is added to the emulsion; a method disclosed in JP-A-53-102733 and JP-A-58-105141, in which a dye is directly dispersed in a hydrophilic colloid, and the dispersion is added to the emulsion; or a method disclosed in JP-A-51-74624, in which a dye is dissolved using a compound capable of red-shift, and the solution is added to the emulsion. Ultrasonic waves may also be used in the solution.

The sensitizing dye for use in the present invention may be added to a silver halide emulsion for use in the present invention at any step known to be useful during the preparation of a photographic emulsion. For example, the dye may be added at a step of formation of silver halide particles, and/or in a period before desalting, or at a step of desalting, and/or in a period between after desalting and before initiation of chemical ripening, as disclosed, for example, in U.S. Pat. Nos. 2,735,766, 3,628,960, 4,183,756, and 4,225,666, JP-A-58-184142, and JP-A-60-196749, or the dye may be added in any period or at any step before coating of the emulsion, such as immediately before or during chemical ripening, or in a period after chemical ripening but before coating, as disclosed, for example, in JP-A-58-113920. Also, a sole kind of compound alone, or compounds different in structure in combination, may be added in divided manner; for example, a part during particle formation, and the remaining during chemical ripening, or after completion of the chemical ripening; or a part before or during chemical ripening, and the remaining after completion of the chemical ripening, as disclosed, for example, in U.S. Pat. No. 4,225, 666 and JP-A-58-7629. The kind of compounds added in divided manner, or the kind of the combination of compounds, may be changed.

The addition amount of the sensitizing dye for use in the present invention varies depending upon the shape, size, the halogen composition of silver halide particles, the method and degree of chemical sensitization, the kind of antifoggant, and the like, but the addition amount can be from $4\times10^{-6}$ to $8\times10^{-3}$ mol per mol of silver halide. For example, when the silver halide particle size is from 0.2 to 1.3 $\mu$m, the addition amount is preferably from $2\times10^{-7}$ to $3.5\times10^{-6}$, more preferably from $6.5\times10^{-7}$ to $2.0\times10^{-6}$ mol, per m of the surface area of a silver halide particle.

Various additives for use in the light-sensitive material of the present invention are not particularly restricted, and, for example, those described in the following portions may be preferably used:

polyhydroxybenzene compounds described in JP-A-3-39948, from page 10, right lower column, line 11, to page 12, left lower column, line 5, specifically, Compound (III)-1 to 25 described in the publication;

Compounds represented by formula (I) and having substantially no maximum absorption in the visible region, described in JP-A-1-118832, specifically, Compounds I-1 to I-26 described in the publication;

antifogging agents described in JP-A-2-103536, page 17, right lower column, line 19, to page 18, right upper column, line 4;

polymer latexes described in JP-A-2-103536, page 18, left lower column, lines 12 to 20; polymer latexes having an activated methylene group represented by formula (I) described in JP-A-9-179228, specifically, Compounds I-1 to I-16 described in the specification thereof; polymer latexes having a core/shell structure described in JP-A-9-179228, specifically, Compounds P-1 to P-55 described in the specification thereof; An acidic polymer latex described in the publication of JP-A-7-104413, page 14, left column, line 1 to right column, line 30, specifically the compounds II-1) to II-9) described in the same publication, page 15;

matting agents, slipping agents, and plasticizers described in JP-A-2-103536, from page 19, left upper column, line 15, to right upper column, line 15;

hardening agents described in JP-A-2-103536, page 18, right upper column, lines 5 to 17;

compounds having an acid group described in JP-A-2-103536, from page 18, right lower column, line 6, to page 19, left upper column, line 1;

electrically conductive materials described in JP-A-2-18542, from page 2, left lower column, line 13, to page 3, right upper column, line 7, specifically, metal oxides described in the publication, page 2, right lower column, lines 2 to 10, and electrically conductive high-molecular compounds of Compounds P-1 to P-7 described in the publication;

water-soluble dyes described in JP-A-2-103536, from page 17, right lower column, lines 1 to page 17, right upper column, line 18;

solid dispersion dyes represented by formulae (FA), (FA1), (FA2), and (FA3) described in JP-A-9-179243, specifically, Compounds F1 to F34 in the specification thereof, and Compounds (II-2) to (II-24), (III-5) to (III-18), and (IV-2) to (IV-7) described in JP-A-7-152112; solid dispersion dyes described in JP-A-2-294638 and JP-A-5-11382;

surface-active agents described in JP-A-2-12236, from page 9, right upper column, line 7 to page 9, right lower column, line 3; PEG-series surface-active agents described in JP-A-2-103536, page 18, left lower column, lines 4 to 7; fluoro surface-active agents described in JP-A-3-39948, from page 12, left lower column, line 6, to page 13, right lower column, line 5, specifically, Compounds VI-1 to VI-15 described in the publication;

Binders described in the publication of JP-A-2-18542, page 3, right lower column, line 1 to line 20.

The degree of swelling of the hydrophilic colloid layers of the silver halide photographic light-sensitive material of the present invention, including a silver halide emulsion layer and a protective layer, is preferably from 80 to 150%, and more preferably from 90 to 140%. The degree of swelling of the hydrophilic colloid layers is obtained by measuring the thickness ($d_0$) of the hydrophilic colloid layers, including a silver halide emulsion layer and a protective layer, of the silver halide photographic light-sensitive material, measuring the swollen thickness ($\Delta d$) of the said silver halide photographic light-sensitive material after it has been dipped in distilled water at 25° C. for 1 minute, and following the calculating equation set forth below.

$$\text{Degree of swelling } (\%)=(\Delta d)\div d_0\times100$$

The pH of a film surface on the side to which the silver halide emulsion layer of the silver halide photographic light-sensitive material of the present invention is applied is in a range of 4.5 to 7.5, preferably 4.8 to 7.0 and particularly preferably 5.0 to 6.0.

Examples of the support (base) that can be used in practice of the present invention include a baryta paper, a polyethylene-laminated paper, a polypropylene synthetic paper, a glass plate, cellulose acetate, cellulose nitrate, and polyester films, such as polyethylene terephthalate. These supports are properly selected in accordance with the use purpose of each silver halide photographic light-sensitive material.

Also, a support comprising a styrene-series polymer having a syndiotactic structure described in JP-A-7-234478 and U.S. Pat. No. 558,979 is preferably used.

The processing agents, such as the developer and the fixing solution, and the processing method for use in the present invention are described below, but the invention is by no means limited to the following description and specific examples.

The development for use in the present invention may be performed by any known method, and a known development processing solution may be used.

According to the silver halide photographic light-sensitive material of the present invention, a stable developing solution having low pH value can be used in order to obtain image with photographic properties of ultra-high contrast of $\gamma$ value exceeding 10 and high sensitivity. Therefore, it is not necessary to process them with an alkaline developing solution having a high pH value of nearly pH 13, described in U.S. Pat. No. 2,419,975, etc.

It is preferable to use a developing solution containing 0.15 mol/l or more of sulfite ion and having a pH value of less than 11, more preferably 9.5 and more but less than 11.0.

The developing agent for use in the developer (the development-initiating solution and the development replenisher are collectively called a developer, hereinafter the same) used in the present invention is not particularly restricted, but it preferably contains a dihydroxybenzene compound, or a hydroquinone monosulfonate, individually or in combination. Particularly, it is preferable for the developing agent to comprise a combination of a dihydroxybenzene-series developing agent with an auxiliary developing agent that shows superadditivity. Examples of the combination include combinations of dihydroxybenzenes and/or ascorbic acid derivatives with p-aminophenol compound.

Examples of the dihydroxybenzene developing agent for use in the present invention include hydroquinone, chlorohydroquinone, isopropylhydroquinone, and methylhydroquinone, with hydroquinone being particularly preferred. As an ascorbic acid derivative-type developing agent, ascorbic acid or isoascorbic acid or its salts may be used. Particularly sodium erysorbate is preferable in view of material costs.

Examples of the 1-phenyl-3-pyrazolidones or derivatives thereof as the developing agent for use in the present invention include 1-phenyl-3-pyrazolidone, 1-phenyl-4,4-dimethyl-3-pyrazolidone, and 1-phenyl-4-methyl-4-hydroxymethyl-3-pyrazolidone.

Examples of the p-aminophenol-series developing agent for use in the present invention include N-methyl-p-aminophenol, p-aminophenol, N-(β-hydroxyphenyl)-p-aminophenol, N-(4-hydroxyphenyl)glycine, o-methoxy-p-(N,N-dimethylamino)phenol, and o-methoxy-p-(N-methylamino)phenol, with N-methyl-p-aminophenol and aminophenols, described in JP-A-9-297377, and JP-A-9-297378, being preferred.

The dihydroxybenzene-series developing agent is preferably used in an amount of generally from 0.05 to 0.8 mol/l. When a dihydroxybenzene compound and a 1-phenyl-3-pyrazolidone compound or a p-aminophenol compound are used in combination, the former is preferably used in an amount of from 0.05 to 0.6 mol/l, more preferably from 0.10 to 0.5 mol/l, and the latter is preferably used in an amount of 0.06 mol/l or less, more preferably from 0.03 to 0.003 mol/l.

The ascorbic acid derivative-type developing agent is used in an amount of generally 0.01 mol/l to 0.5 mol/l and more preferably 0.05 mol/l to 0.3 mol/l. When a combination of an ascorbic acid derivative and 1-phenyl-3-pyrazolidones or p-aminophenols is used, preferably the ascorbic acid derivative is used in an amount of 0.01 mol/l to 0.5 mol/l and 1-phenyl-3-pyrazolidones or p-aminophenols are used in an amount of 0.005 mol/l to 0.2 mol/l.

The developer used in processing the light-sensitive material of the present invention may contain additives (e.g. a developing agent, an alkali agent, a pH buffer, a preservative, a chelating agent) that are commonly used. Specific examples thereof are described below, but the present invention is by no means limited thereto.

Examples of the buffer for use in the developer used in development-processing the light-sensitive material of the present invention include carbonates, boric acids described in JP-A-62-186259, saccharides (e.g. saccharose) described in JP-A-60-93433, oximes (e.g. acetoxime), phenols (e.g. 5-sulfosalicylic acid), and tertiary phosphates (e.g. sodium salt and potassium salt), with carbonates and boric acids being preferred. The buffer, particularly the carbonate, is preferably used in an amount of 0.1 mol/l or more, particularly preferably from 0.2 to 1.5 mol/l.

Examples of the preservative for use in the present invention include sodium sulfite, potassium sulfite, lithium sulfite, ammonium sulfite, sodium bisulfite, sodium methabisulfite, and formaldehyde-sodium bisulfite. The sulfite is used in an amount of preferably 0.2 mol/l or more, particularly preferably 0.3 mol/l or more, but if it is added too excessively, silver staining in the developer is caused. Accordingly, the upper limit is preferably 1.2 mol/l. The amount is particularly preferably from 0.35 to 0.7 mol/l.

As a preservative for a dihydroxybenzene-series developing agent, the aforementioned ascorbic acid derivative may be used in a small amount together with a sulfite. Among these ascorbic derivatives, it is preferable to use sodium erysorbate in view of material costs. The amount of the ascorbic acid derivative in a range of preferably 0.03 to 0.12 and particularly preferably 0.05 to 0.10 in terms of mol ratio to dihydroxybenzene-series developing agent. When an ascorbic acid derivative is used as a preservative, it is not preferable that a boron compound is contained in the developer.

Examples of additives to be used other than those described above include a development inhibitor, such as sodium bromide and potassium bromide, an organic solvent, such as ethylene glycol, diethylene glycol, triethylene glycol, and dimethylformamide; a development accelerator, such as an alkanolamine including diethanolamine and triethanolamine, and an imidazole and derivatives thereof; and a physical development unevenness inhibitor, such as a heterocyclic mercapto compound (e.g. sodium 3-(5-mercaptotetrazol-1-yl)benzene sulfonate, 1-phenyl-5-mercaptotetrazole) and the compounds described in JP-A-62-212651.

Further, a mercapto-series compound, an indazole-series compound, a benzotriazole-series compound, or a benzimidazole-series compound may be added, as an antifoggant or a black spot (black pepper) inhibitor. Specific examples thereof include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-((2-mercapto-1,3,4-thiadiazol-2-yl)thio)butanesulfonate, 5-amino-1,3,4-thiadiazole-2-thiol, methylbenzotriazole, 5-methylbenzotriazole, and 2-mercaptobenzotriazole. The addition amount thereof is generally from 0.01 to 10 mmol, preferably from 0.1 to 2 mmol, per liter of the developer.

Further, various kinds of organic or inorganic chelating agents can be used individually or in combination in the developer for use in the present invention.

Examples of the inorganic chelating agent include sodium tetrapolyphosphate and sodium hexametaphosphate.

Examples of the organic chelating agent include organic carboxylic acid, aminopolycarboxylic acid, organic phosphonic acid, aminophosphonic acid, and organic phosphonocarboxylic acid.

Examples of the organic carboxylic acid include acrylic acid, oxalic acid, malonic acid, succinic acid, glutaric acid, gluconic acid, adipic acid, pimelic acid, azelaic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acid include iminodiacetic acid, nitrilotriacetic acid, nitrilotripropionic acid, ethylenediaminemonohydroxyethyltriacetic acid, ethylenediaminetetraacetic acid, glycolethertetraacetic acid, 1,2-diaminopropanetetraacetic acid, diethylenetriaminepentaacetic acid, triethylenetetraminehexaacetic acid, 1,3-diamino-2-propanoltetraacetic acid, glycoletherdiaminetetraacetic acid, and compounds described in JP-A-52-25632, JP-A-55-67747, JP-A-57-102624 and JP-B-53-40900.

Examples of the organic phosphonic acid include hydroxyalkylidene-diphosphonic acid, described in U.S. Pat. Nos. 3,214,454 and 3,794,591 and West German Patent Publication (OLS) No. 2,227,369, and the compounds described in *Research Disclosure,* Vol. 181, Item 18170 (May 1979).

Examples of the aminophosphonic acid include aminotris(methylenephosphonic acid), ethylenediamine tetramethylenephosphonic acid, aminotrimethylenephosphonic acid, and the compounds described in *Research Disclosure,* No. 18170 (supra), JP-A-57-208554, JP-A-54-61125, JP-A-55-29883, and JP-A-56-97347.

Examples of the organic phosphonocarboxylic acid include the compounds described in JP-A-52-102726, JP-A-53-42730, JP-A-54-121127, JP-A-55-4024, JP-A-55-4025, JP-A-55-126241, JP-A-55-65955, JP-A-55-65956, and *Research Disclosure,* No. 18170 (supra).

The organic and/or inorganic chelating agents are not limited to those described above. The organic and/or inorganic chelating agents may be used in the form of an alkali metal salt or an ammonium salt. The amount of the chelating agent added is preferably from $1\times10^{-4}$ to $1\times10^{-1}$ mol, more preferably from $1\times10^{-3}$ to $1\times10^{-2}$ mol, per liter of the developer.

Examples of the silver stain inhibitor added to the developer include the compounds described in JP-A-56-24347, JP-B-56-46585, JP-B-62-2849, JP-A-4-362942, and JP-A-8-6215; triazines having one or more mercapto groups (for example, the compounds described in JP-B-6-23830, JP-A-3-282457, and JP-A-7-175178); pyrimidines having one or more mercapto groups (e.g. 2-mercaptopyrimidine, 2,6-dimercaptopyrimidine, 2,4-dimercaptopyrimidine, 5,6-diamino-2,4-dimercaptopyrimidine, 2,4,6-trimercaptopyrimidine, compounds described in JP-A-9-274289); pyridines having one or more mercapto groups (e.g. 2-mercaptopyridine, 2,6-dimercaptopyridine, 3,5-dimercaptopyridine, 2,4,6-trimercaptopyridine, compounds described in JP-A-7-248587); pyrazines having one or more mercapto groups (e.g. 2-mercaptopyrazine, 2,6-dimercaptopyrazine, 2,3-dimercaptopyrazine, 2,3,5-trimercaptopyrazine); pyridazines having one or more mercapto groups (e.g. 3-mercaptopyridazine, 3,4-dimercaptopyridazine, 3,5-dimercaptopyridazine, 3,4,6-trimercaptopyridazine); the compounds described in JP-A-7-175177, and polyoxyalkylphosphates described in U.S. Pat. No. 5,457,011. These silver stain inhibitors may be used individually or in combination of two or more of these. The addition amount thereof is preferably from 0.05 to 10 mmol, more preferably from 0.1 to 5 mmol, per liter of the developer.

The developer may contain the compounds described in JP-A-61-267759, as a dissolution aid. Further, the developer may contain a color toner, a surface-active agent, a defoaming agent, or a hardening agent, if necessary.

With respect to the cation of the developer, potassium ion does not inhibit development but causes small indentations, called a fringe, on the periphery of the blacked portion, as compared with sodium ion. When the developer is stored as a concentrated solution, potassium salt is generally preferred, because of its higher solubility. However, since, in the fixing solution, potassium ion causes fixing inhibition on the same level as caused by silver ion, if the developer has a high potassium ion concentration, the developer is carried over by the light-sensitive material, to disadvantageously increase the potassium ion concentration in the fixing solution. Accordingly, the molar ratio of potassium ion to sodium ion in the developer is preferably between 20:80 and 80:20. The ratio of potassium ion to sodium ion can be freely controlled within the above-described range by a counter cation, such as a pH buffer, a pH-adjusting agent, a preservative, or a chelating agent.

The replenishing amount of the developer replenisher is generally 390 ml or less, preferably from 325 to 30 ml, and most preferably from 250 to 120 ml, per $m^2$ of the light-sensitive material. The developer replenisher may have the same composition and/or concentration as the development initiating solution, or it may have a different composition and/or concentration from the initiating solution.

Examples of the fixing agent in the fixing processing agent for use in the present invention include ammonium thiosulfate, sodium thiosulfate, and ammonium sodium thiosulfate. The amount to be used of the fixing agent may be varied appropriately, but it is generally from about 0.7 to about 3.0 mol/l.

The fixing solution for use in the present invention may contain a water-soluble aluminum salt or a water-soluble chromium salt, which acts as a hardening agent, and of these salts, a water-soluble aluminum salt is preferred. Examples thereof include aluminum chloride, aluminum sulfate, potassium alum, ammonium aluminum sulfate, aluminum nitrate, and aluminum lactate. These are each preferably contained, in terms of an aluminum ion concentration in the use solution, in an amount of from 0.01 to 0.15 mol/l.

When the fixing solution is stored as a concentrated solution or a solid agent, it may be constituted by a plurality of parts, preparing a hardening agent or the like as a separate part, or it may be constituted as a one-part agent containing all components.

The fixing processing agent may contain, if desired, a preservative (e.g. sulfite, bisulfite, metabisulfite; in an amount of generally 0.015 mol/l or more, preferably from 0.02 to 0.3 mol/l), a pH buffer (e.g. acetic acid, sodium acetate, sodium carbonate, sodium hydrogencarbonate, phosphoric acid, succinic acid, adipic acid; in an amount of generally from 0.1 to 1 mol/l, preferably from 0.2 to 0.7 mol/l), or a compound having aluminum-stabilizing ability or hard-water-softening ability (e.g. gluconic acid, iminodiacetic acid, 5-sulfosalicylic acid, glucoheptanoic acid, malic acid, tartaric acid, citric acid, oxalic acid, maleic acid, glycolic acid, benzoic acid, salicylic acid, Tiron, ascorbic acid, glutaric acid, aspartic acid, glycine, crysteine, ethylenediaminetetraacetic acid, nitrilotriacetic acid, and a derivative and salt thereof, saccharides, and boric acid; in an amount of generally from 0.001 to 0.5 mol/l, preferably from 0.005 to 0.3 mol/l).

In addition, the fixing processing agent may contain a compound described in JP-A-62-78551, a pH-adjusting agent (e.g. sodium hydroxide, ammonia, sulfuric acid), a surface-active agent, a wetting agent, or a fixing accelerator. Examples of the surface-active agent include anionic surface-active agents, such as sulfated products and sulfonated products; polyethylene-series surface-active agents, and amphoteric surface-active agents described in JP-A-57-6840. A known deforming agent may also be used. Examples of the wetting agent include alkanolamines and alkylene glycols. Examples of the fixing accelerator include alkyl- or aryl-substituted thiosulfonic acids and salts thereof described in JP-A-6-308681; thiourea derivatives described in JP-B-45-35754, JP-B-58-122535, and JP-B-58 -122536; alcohols having a triple bond within the molecule; thioether compounds described in U.S. Pat. No. 4,126,459; mercapto compounds described in JP-A-64-4739, JP-A-1-4739, JP-A-1-159645, and JP-A-3-101728; thiocyanates and meso-ionic compounds described in JP-A-4-170539.

The fixing solution for use in the present invention has a pH of preferably 4.0 or more, more preferably from 4.5 to 6.0. The pH of the fixing solution increases due to mingling of the developer upon processing, and in this case, the hardening fixing solution has a pH of generally 6.0 or less, preferably 5.7 or less, and the non-hardening fixing solution has a pH of generally 7.0 or less, preferably 6.7 or less.

The replenishing amount of the fixing solution is generally 500 ml or less, preferably 390 ml or less, more preferably from 320 to 80 ml, per 1 $m^2$ of the light-sensitive material. The replenisher may have the same composition and/or concentration as the initiating solution, or it may have a composition and/or a concentration different from the initiating solution.

The fixing solution may be regenerated and reused using a known fixing solution regenerating method, such as electrolytic silver recovery. Examples of the regeneration apparatus include Reclaim R-60, trade name, manufactured by Fuji Hunt KK.

It is also preferred to remove dyes or the like through an adsorption filter, such as activated carbon.

When the development and fixing processing agents are liquid agents, it is preferable to store these agents in packing material having low oxygen-permeability as described in, for example, JP-A-61-73147. Moreover, when these solutions are concentrated solutions, they are used after being diluted by adding water in a ratio of 0.2 to 3 parts to 1 part of the concentrated solution such that a given concentration is obtained.

Even if the development and fixing processing agents used in the present invention are solids, the same results as those of the liquid agents can be obtained. Descriptions concerning the solid processing agents will be shown hereinbelow.

For the solid agents in the present invention, known forms (e.g., a powder, particle, granule, block, tablet, compactor, briquette, plate, bar and paste) may be used. These solid agents may be coated with a water-soluble coating agent or film to separate components, which are mutually brought into contact and reacts, from each other, or may have a structure of plural layers to separate components, which mutually reacts, from each other. Also, these means may be combined.

As the coating agent and granulation auxiliary, known materials may be used and a polyvinylpyrrolidone, polyethylene glycol, polystyrenesulfonic acid or vinyl-series compound is preferable. Besides the above compounds, the description of JP-A-5-45805, column 2, line 48 to column 3, line 13 can be made to reference.

When a structure of plural layers is adopted, a material having a structure in which a component that is not reactive is interposed between components that react with each other when brought into contact, may be prepared and may be processed into a tablet or a briquette or the like. Also, components having known forms are used to make the above same layer structure, which is then packaged. These methods are shown in, for instance, JP-A-61-259921, JP-A-4-16841, JP-A-4-78848 and JP-A-5-93991.

The apparent density of the solid agent is preferably 0.5 to 6.0 g/$cm^3$, specifically, 1.0 to 5.0 g/$cm^3$ in the case of a tablet and 0.5 to 1.5 g/$cm^3$ in the case of a granule.

As the method of the production of the solid agent of the present invention, any known method may be used. For instance, methods described in JP-A-61-259921, JP-A-4-15641, JP-A-4-16841, JP-A-4-32837, JP-A-4-78848, JP-A-5-93991, JP-A-4-85533, JP-A-4-85534, JP-A-4-85535, JP-A-5-134362, JP-A-5-197070, JP-A-5-204098, JP-A-5-224361, JP-A-6-138604, JP-A-6-138605, JP-A-8-286329 and the like can be made to reference.

More specifically, a rolling granulation method, extrusion granulation method, compression granulation method, cracking granulation method, agitation granulation method, spray drying method, dissolution solidification method, briquetting method, roller compacting method, or the like may be used.

The solid agent of the present invention may be changed on surface conditions (e.g. smoothness and porousness) and thickness in part, or it may be made into a hollow donut shape, to control solubility. It is also possible to make the solid agents have plural shapes, in order to give plural granulated materials different solubilities, or to make materials having different solubilities accord with each other in solubility. Further, multilayer granulated materials in which the surface and the inside have different compositions may be used.

As the packing material for the solid agent, materials which have low oxygen and water permeability are preferable and as the shape of the package material, known shapes such as a bag form, cylinder form and box form may be used. A foldable form as disclosed in JP-A-6-242585 to JP-A-6-242588, JP-A-6-247432, JP-A-6-247448, JP-A-6-301189, JP-A-7-5664 and JP-A-7-5666 to JP-A-7-5669 is preferable to decrease a space required for storing discarded packings. These packing materials may be provided with a screw cap, pull-top, or aluminum seal at the take-off port or may be heat-sealed. Also, other known materials may be used and the packing materials are not particularly restricted. Moreover, it is preferable to recycle or reuse discarded packings in view of environmental safeguard.

There is no particular limitation to a method of dissolving and replenishing the solid agent of the present invention and known methods may be used. Examples of these methods include a method in which a fixed amount of solid agent is dissolved in a dissolving apparatus with a stirring function and replenished, a method in which the solid agent is dissolved in a dissolving apparatus comprising a dissolution section and a section for stocking a complete solution and is replenished from the stock section as disclosed in JP-A-9-80718, a method in which the processing agent is introduced into a circulatory system of an automatic developing machine to dissolve and replenish the processing agent as disclosed in JP-A-5-119454, JP-A-6- 19102 and JP-A-7-261357 and a method in which corresponding to the processing of a light-sensitive material the processing agent is introduced into and dissolved in an automatic developing machine with a built-in dissolving vessel. Also, any one of known methods besides the above methods may be used. Also, the processing agent may be introduced either by human hands or by opening the seal and introducing automatically by using a dissolution apparatus comprising a seal-opening mechanism as described in JP-A-9-138495 and using an automatic developing machine. The latter is preferable in view of working circumstance. Specifically, there are methods of breaking through, peeling off, cutting off and push-cutting the take-off port and methods described in JP-A-6-19102 and JP-A-6-95331.

The light-sensitive material processed through development and fixing is then subjected to water-washing or stabilization (hereinafter, unless otherwise specified, water-washing includes stabilization, and the solution for use therein is called water or washing water). The water for use in water-washing may be tap water, ion exchanged water, distilled water, or a stabilizing solution. The replenishing amount of the washing water is generally from about 17 to about 8 liter per $m^2$ of the light-sensitive material, but a replenishing amount lower than the above-described range may also be used. In particular, when the replenishing amount is 3 liter or less (including 0, namely, standing water washing), not only can the processing achieve water savings, it can also dispense with piping for installation of an automatic developing machine. When water-washing is performed with a small replenishing amount of water, a rinsing tank of a squeeze roller or a crossover roller, described in JP-A-63-18350 and JP-A-62-287252, is preferably provided. Alternatively, addition of various oxidizing agents (e.g. ozone, hydrogen peroxide, sodium hypochlorite, active halogen, chlorine dioxide, sodium carbonate hydrogen peroxide salt) or filter filtration may be combined, so as to reduce the pollution load, which is a problem incurred in the case of water-washing with a small amount of water, or for preventing water scale.

As the method for reducing the replenishing amount of washing water, a multi-stage countercurrent system (for example, two or three stages) has been known for a long time, and the replenishing amount of washing water is preferably from 200 to 50 ml per $m^2$ of the light-sensitive material. This effect can also be obtained similarly in the case of an independent multi-stage system (a method of not using a countercurrent system but supplying a new solution individually to the multi-stage water-washing tanks).

In the method in the present invention, a means for preventing water scale may be provided in the water-washing step. The water-scale-preventing means is not particularly restricted, and a known means may be used. Examples thereof include a method of adding a fungicide (a so-called water scale inhibitor), a method of passing electricity, a method of irradiating ultraviolet rays, infrared rays, or far infrared rays, a method of applying a magnetic field, a method of treating with ultrasonic waves, a method of applying heat, and a method of evacuating the tank on standing. The water-scale-preventing means may be applied according to the processing of the light-sensitive material; it may be applied at a predetermined interval irrespective of the use state, or it may be applied only in the period of non-processing time, such as nighttime. Further, the washing water may be previously treated with a water-scale-preventing means and then replenished. Further, in view of preventing generation of resistant microbes, it is preferred to perform different water-scale-preventing means at predetermined intervals.

The fungicide is not particularly restricted, and a known fungicide may be used. Examples thereof include, in addition to the above-described oxidizing agents, a glutaraldehyde, a chelating agent, such as aminopolycarboxylic acid, a cationic surface-active agent, and a mercaptopyridine oxide (e.g. 2-mercaptopyridine-N-oxide), and a sole fungicide may be used, or a plurality of fungicides may be used in combination.

The electricity may be passed according to the method described in JP-A-3-224685, JP-A-3-224687, JP-A-4-16280, or JP-A-4-18980.

In addition, a known water-soluble surface-active agent or defoaming agent may be added, so as to prevent uneven processing due to bubbling, or to prevent transfer of stains. Further, a dye adsorbent described in JP-A-63-163456 may be provided in the water-washing system, so as to prevent stains due to a dye dissolved out from the light-sensitive material.

The overflow solution from the water-washing step may be partly or wholly used by mixing it with the processing solution having fixing ability, as described in JP-A-60-235133. It is also preferred, in view of conservation of the natural environment, to reduce the biochemical oxygen demand (BOD), chemical oxygen demand (COD), or iodine consumption before discharge, by subjecting the solution to microorganism treatment (for example, sulfur oxidation bacteria or activated sludge treatment, or treatment with a filter comprising a porous carrier, such as activated carbon or ceramic, having carried thereon microorganisms) or oxidation treatment with an oxidizing agent or electrification, or to reduce the silver concentration in waste water by passing the solution through a filter, using a polymer having affinity for silver, or by adding a compound that forms a hardly soluble silver complex, such as trimercaptotriazine, to precipitate silver, and then passing the solution through a filter.

In some cases, stabilization may be performed subsequent to the water-washing, and as one example, a bath containing the compounds described in JP-A-2-201357, JP-A-2-132435, JP-A-1-102553, and JP-A-46-44446 may be used as a final bath of the light-sensitive material. This stabilization bath may also contain, if desired, an ammonium compound, a metal compound, such as Bi or Al, a fluorescent brightening agent, various chelating agents, a layer pH-adjusting agent, a hardening agent, a bactericide, a fungicide, an alkanolamine, or a surface-active agent.

The additives, such as a fungicide and the stabilizing agent added to the water-washing or stabilization bath, may be formed into a solid agent, similarly to the above-described development and fixing processing agents.

Wastewater of the developer, the fixing solution, the washing water, or the stabilizing solution for use in the present invention, is preferably burned for disposal. The wastewater can also be formed into a concentrated solution or a solid by a concentrating apparatus, as described, for example, in JP-B-7-83867 and U.S. Pat. No. 5,439,560, and then disposed.

When the replenishing amount of the processing agent is reduced, it is preferred to prevent evaporation or air oxidation of the solution, by reducing the contact area of the processing tank with air. A roller transportation-type automatic-developing machine is described, for example, in U.S. Pat. Nos. 3,025,779 and 3,545,971, and in the present specification, it is simply referred to as a roller transportation-type automatic processor. This automatic processor comprises four steps of development, fixing, water-washing, and drying, and it is most preferred to follow this four-step processing also in the present invention, though other steps (e.g. stopping step) are not excluded. Further, a rinsing bath may be provided between development and fixing, and/or between fixing and water-washing.

In the processing in the present invention, the dry-to-dry time is preferably from 25 to 160 seconds, the development time and the fixing time are each generally 40 seconds or less, preferably from 6 to 35 seconds, and the temperature of each solution is preferably from 25 to 50° C., more preferably from 30 to 40° C. The temperature and the time of water-washing are preferably from 0 to 50° C. and 40 seconds or less, respectively. According to the method in the present invention, the light-sensitive material after development, fixing, and water-washing may be passed through squeeze rollers, for squeezing washing water, and then dried. The drying is generally performed at a temperature of from about 40° C. to about 100° C. The drying time may be appropriately varied depending upon the ambient state. The drying method is not particularly restricted, and any known method may be used, but hot-air drying, and drying by far infrared rays or a heat roller as described in JP-A-4-15534, JP-A-5-2256, and JP-A-5-289294 may be used, and a plurality of drying methods may also be used in combination.

By the silver halide photographic light-sensitive material of the present invention, an ultrahigh contrast image in negative gradation can be formed. In addition, excellent image quality and good reproduction of an original are achieved. Further, fluctuation in photographic properties is less and generation of black spot is retrained, even though a processing solution having different pH, etc. from the initial one owing to running processing, is used.

Further, according to the processing method of the present invention, an extremely high contrast negative image can be formed and further generation of black spot is reduced, and furthermore the above-described excellent photographic properties can be maintained by the developing solution having a lower pH than the previous one.

EXAMPLE

The present invention will now be described in more detail with reference to the following examples.

Example 1

(Preparation of Silver Halide Emulsion A)

The aqueous solution (II) and the aqueous solution (III) were added to the solution (I) described below, while stirring by a double jet method to prepare silver chlorobromide particles having an average particle size of 0.20 $\mu$m and a silver chloride content of 70 mol %. Solution (I): an aqueous gelatin solution containing sodium chloride and 1,3-dimethyl-2-imidazolidinethione Solution (II): an aqueous silver nitrate solution Solution (III): an aqueous halogen salt solution containing potassium bromide, sodium chloride, $K_3IrCl_6$ corresponding to $4\times10^{-7}$ mol/mol-Ag and $K_2Rh(H_2O)Cl_5$ corresponding to $2\times10^{-7}$ mol/mol-Ag.

Further, an aqueous silver nitrate solution (IV) and an aqueous halogen salt solution (V) containing potassium bromide and sodium chloride were added by a double jet method.

Subsequently, an aqueous KI solution was added in an amount of $1\times10^{-3}$ mol per mol of Ag.

Thereafter, the emulsion was washed with water by flocculation according to a usual method, 40 g/mol-Ag of gelatin was added thereto, and then the pH and the pAg were adjusted to 6.0 and 7.5, respectively. Thereto, 7 mg/mol-Ag of sodium benzenethiosulfonate and 2 mg/mol-Ag of benzenesulfinic acid, 8 mg/mol-Ag of chloroauric acid and 3 mg/mol-Ag of sodium thiosulfate were further added. The resulting mixture was subjected to chemical sensitization at 60° C. for 50 minutes. Then, 150 mg of 4-hydroxy-6-methyl-1,3,3a, 7-tetraazaindene as a stabilizer and 100 mg of PROXEL (trade name, manufactured by ICI Co., Ltd.) as an antiseptic were added, to obtain silver halide emulsion A.

The thus-obtained emulsion was an emulsion composed of monodispersed silver iodochlorobromide cubic particles having an average particle size of 0.25 $\mu$m, a silver chloride content of 69.9% and a silver iodide content of 0.1% (coefficient of variation: 9.5.%).

(Preparation of Coated Samples)

On a polyethylene terephthalate film support undercoated by a moisture-proofing layer composed of vinylidene chloride, a UL, an EM layer, a PC layer and an OC layer were coated in this order from the support side to prepare a sample.

The preparation method and the coating amount are described below.

(UL Layer)

The UL layer was coated to have a gelatin coverage of 0.3 g/m$^2$ and a polyethylacrylate dispersion coverage of 0.25 g/m$^2$.

(EM Layer)

To the silver halide emulsion A prepared above, $7\times10^{-4}$ mol/mol-Ag of Compound (s) shown below was added as a sensitizing dye.

Further $3\times10^{-4}$ mol/mol-Ag of a mercapto compound (a), $4\times10^{-4}$ mol/mol-Ag of a mercapto compound (b), $4\times10^{-4}$ mol/mol-Ag of a triazine compound (c), $2\times10^{-3}$ mol/mol-Ag of 5-chloro-8-hydroquinoline and a hydrazine derivative (D) shown in Table 1 were added.

Further, quaternary onium salt compounds defined by the present invention and comparative compounds shown below as a development inhibitor were added to give a coated amount as shown in Table 1, respectively.

(S)

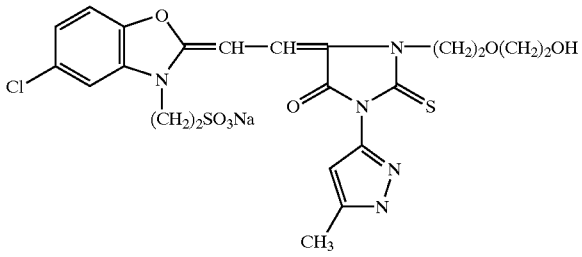

(a)

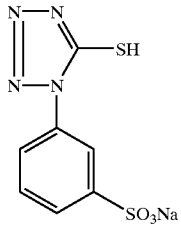

(b)

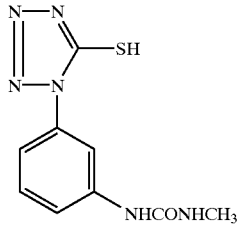

(c)

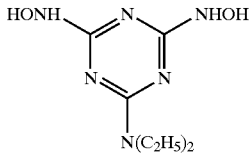

Comparative Compound (a)

(the compound B-14 described in JP-A-10-90841)

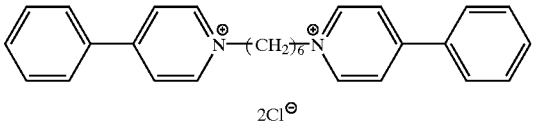

Comparative Compound (b)

(the compound B-25 described in JP-A-10-90841)

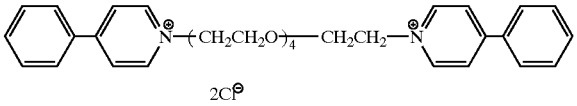

-continued

Comparative Compound (c)

(the compound IV-7 described in JP-A-10-39444)

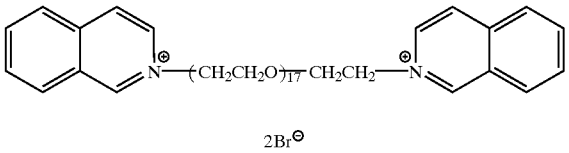

Further, 30 mg/m$^2$ of a sodium salt of N-oleyl-N-methyltaurine, 0.8 g/m$^2$ of a polyethylacrylate dispersion, 200 mg/m$^2$ of colloidal silica having an average particle size of 0.02 $\mu$m, and 100 mg/m$^2$ of 1,2-bis (vinylsulfonylacetamido)ethane as a hardening agent were added. The resulting solution was adjusted to have a pH of 5.8 using an acetic acid.

Then, the solution was coated to have a coated silver amount of 3.5 g/m$^2$.

(PC Layer)

The PC layer was provided by coating 0.5 g/m$^2$ of gelatin, 0.2 g/m$^2$ of a polyethylacrylate dispersion, 5 mg/m$^2$ of sodium ethylthiosulfonate, and 100 mg/m$^2$ of hydroquinone.

(OC Layer)

The OC layer was provided by coating 0.3 g/m$^2$ of gelatin, 50 mg/m$^2$ of an amorphous $SiO_2$ matting agent having an average particle size of 3.5 $\mu$m, 60 mg/m$^2$ of colloidal silica having an average particle size of 0.02 $\mu$m, 30 mg/m$^2$ of liquid paraffin, and as a coating aids, 100 mg/m$^2$ of sodium p-dodecylbenzene sulfonate and 5 mg/m$^2$ of a fluorine surface active agent shown by the Compound (e).

(e)

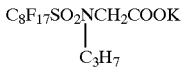

The thus-obtained coating samples each had a back layer and a back protective layer having the following compositions.

(Back Layer)

| | |
|---|---|
| Gelatin | 2.6 g/m$^2$ |
| Polyethylacrylate dispersion | 2.0 g/m$^2$ |
| Sodium p-dodecylbenzene sulfonate | 40 mg/m$^2$ |
| 1,2-Bis (vinylsulfonylacetamide) ethane | 100 mg/m$^2$ |
| Dye (f-1) | 50 mg/m$^2$ |
| Dye (f-2) | 20 mg/m$^2$ |
| Dye (f-3) | 20 mg/m$^2$ |
| Dye (f-4) | 30 mg/m$^2$ |
| (Back Protective Layer) | |
| Gelatin | 0.8 g/m$^2$ |
| Polymethylmethacrylate matting agent (average particle size: 4.5 $\mu$m) | 20 mg/m$^2$ |
| Sodium p-dodecylbenzene sulfonate | 15 mg/m$^2$ |
| Sodium dihexyl-α-sulfosuccinate | 15 mg/m$^2$ |
| Sodium acetate | 15 mg/m$^2$ |

-continued (f-1)

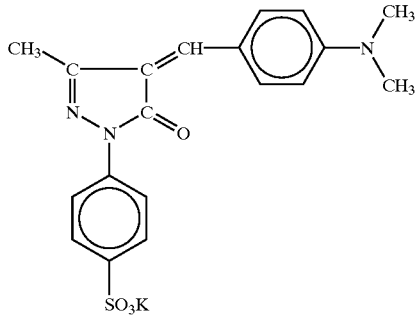

(f-2)

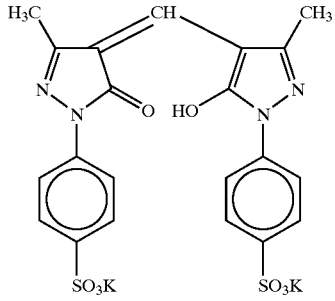

(f-3)

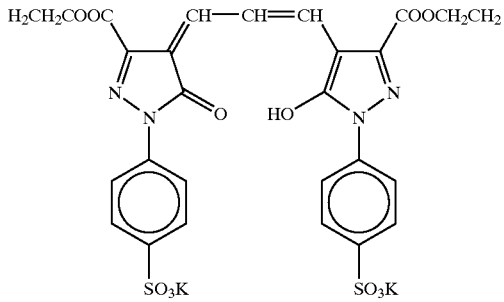

(f-4)

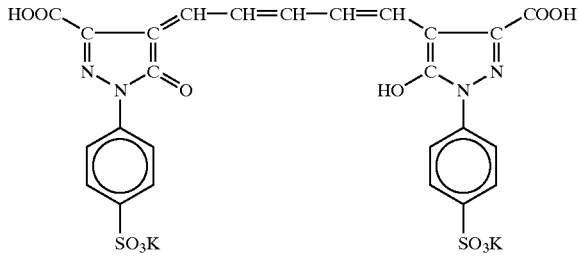

Samples 1 to 28 shown in Table 1 were prepared as described below.

TABLE 1

| Sample No. | Quaternary onium salt compound Kind | Addition amount ($mol/m^2$) | Hydrazine derivative Kind | Addition amount ($mol/m^2$) | Remarks |
|---|---|---|---|---|---|
| 1 | None | 0 | D-66 | $8.5 \times 10^{-5}$ | Comparative example |
| 2 | Comparative compound (a) | $1.2 \times 10^{-5}$ | D-66 | $8.5 \times 10^{-5}$ | Comparative example |
| 3 | Comparative compound (b) | $1.2 \times 10^{-5}$ | D-66 | $8.5 \times 10^{-5}$ | Comparative example |
| 4 | Comparative compound (c) | $1.2 \times 10^{-5}$ | D-66 | $8.5 \times 10^{-5}$ | Comparative example |
| 5 | I-31 | $0.6 \times 10^{-5}$ | D-66 | $8.5 \times 10^{-5}$ | This invention |
| 6 | I-31 | $1.2 \times 10^{-5}$ | D-66 | $8.5 \times 10^{-5}$ | This invention |
| 7 | I-32 | $0.6 \times 10^{-5}$ | D-66 | $8.5 \times 10^{-5}$ | This invention |
| 8 | I-32 | $1.2 \times 10^{-5}$ | D-66 | $8.5 \times 10^{-5}$ | This invention |
| 9 | I-33 | $0.6 \times 10^{-5}$ | D-66 | $8.5 \times 10^{-5}$ | This invention |
| 10 | I-33 | $1.2 \times 10^{-5}$ | D-66 | $8.5 \times 10^{-5}$ | This invention |
| 11 | I-58 | $0.6 \times 10^{-5}$ | D-66 | $8.5 \times 10^{-5}$ | This invention |
| 12 | I-58 | $1.2 \times 10^{-5}$ | D-66 | $8.5 \times 10^{-5}$ | This invention |
| 13 | II-39 | $0.6 \times 10^{-5}$ | D-66 | $8.5 \times 10^{-5}$ | This invention |
| 14 | II-39 | $1.2 \times 10^{-5}$ | D-66 | $8.5 \times 10^{-5}$ | This invention |
| 15 | None | 0 | D-67 | $2.0 \times 10^{-5}$ | Comparative example |
| 16 | Comparative compound (a) | $1.2 \times 10^{-5}$ | D-67 | $2.0 \times 10^{-5}$ | Comparative exampte |
| 17 | Comparative compound (b) | $1.2 \times 10^{-5}$ | D-67 | $2.0 \times 10^{-5}$ | Comparative example |
| 18 | Comparative compound (c) | $1.2 \times 10^{-5}$ | D-67 | $2.0 \times 10^{-5}$ | Comparative example |
| 19 | I-31 | $0.6 \times 10^{-5}$ | D-67 | $2.0 \times 10^{-5}$ | This invention |
| 20 | I-31 | $1.2 \times 10^{-5}$ | D-67 | $2.0 \times 10^{-5}$ | This invention |
| 21 | I-32 | $0.6 \times 10^{-5}$ | D-67 | $2.0 \times 10^{-5}$ | This invention |
| 22 | I-32 | $1.2 \times 10^{-5}$ | D-67 | $2.0 \times 10^{-5}$ | This invention |
| 23 | I-33 | $0.6 \times 10^{-5}$ | D-67 | $2.0 \times 10^{-5}$ | This invention |
| 24 | I-33 | $1.2 \times 10^{-5}$ | D-67 | $2.0 \times 10^{-5}$ | This invention |
| 25 | I-58 | $0.6 \times 10^{-5}$ | D-67 | $2.0 \times 10^{-5}$ | This invention |
| 26 | I-58 | $1.2 \times 10^{-5}$ | D-67 | $2.0 \times 10^{-5}$ | This invention |
| 27 | II-39 | $0.6 \times 10^{-5}$ | D-67 | $2.0 \times 10^{-5}$ | This invention |
| 28 | II-39 | $1.2 \times 10^{-5}$ | D-67 | $2.0 \times 10^{-5}$ | This invention |

The thus-prepared samples each were exposed to a tungsten light source through a step wedge for a sensitometry and then developed with Developer (1) having the following composition at 34° C. for 30 seconds (Condition-1).

The processing was carried out using an automatic developing machine FG-710 F (trade name) manufactured by Fuji Photo Film Com., Ltd. Fixing was performed using a fixing solution having the following formation.

| Developer (1) | |
|---|---|
| Potassium hydroxide | 40.0 g |
| Diethylenetriamine pentaacetic acid | 2.0 g |
| Potassium carbonate | 60.0 g |
| Potassium methabisulfite | 70.0 g |
| Potassium bromide | 6.0 g |
| Hydroquinone | 40.0 g |
| 5-Methylbenzotriazole | 0.35 g |
| 4-Hydroxymethyl-4-methyl-1-phenyl-3-pyrazolidone | 1.5 g |
| Sodium 2-mercaptobenzimidazole-5-sulfonate | 0.3 g |
| Sodium erythorbate | 6.0 g |
| Diethyleneglycol | 5.0 g |
| water to make | 1 liter |
| pH adjusted to 10.6 | |
| Composition of Fixing Solution | |
| Ammonium thiosulfate | 120 g |
| Disodium ethylenediamine tetraacetate dihydrate | 0.03 g |

-continued

| | |
|---|---|
| Sodium thiosulfate pentahydrate | 11 g |
| Sodium methabisulfate | 18 g |
| Sodium hydroxide | 12.5 g |
| Acetic acid (100%) | 30 g |
| Tartaric acid | 3 g |
| Sodium gluconate | 2 g |
| Aluminium sulfate | 8.5 g |
| water to make | 1 liter |
| pH adjusted to 4.8 | |

Beside, the automatic developing machine having the developing solution of the foregoing composition (1) put therein was operated in the stand—by condition without processing. The solution for 8 hours per day at 35° C. was allowed to stand for 1 week, while replenishing only the evaporation loss. Thereafter, each of the samples was similarly processed with the above-mentioned solution (Condition-2).

The results that were obtained are shown in Table 2.

TABLE 2

| Sample No. | Condition-1 Sensitivity | Condition-1 γ | Condition-1 Black spots | Condition-2 Sensitivity | Condition-2 γ | Condition-2 Black spots | Remarks |
|---|---|---|---|---|---|---|---|
| 1 | 100 | 9.0 | 5 | 95 | 8.5 | 5 | Comparative example (No nucleating agent) |
| 2 | 115 | 10.8 | 5 | 120 | 10.8 | 3 | Comparative example |
| 3 | 130 | 13.5 | 4 | 140 | 14.2 | 3 | Comparative example |
| 4 | 120 | 12.3 | 5 | 130 | 13.5 | 3 | Comparative example |
| 5 | 180 | 15.0 | 5 | 180 | 15.9 | 5 | This invention |
| 6 | 210 | 15.9 | 5 | 220 | 15.9 | 4 | This invention |
| 7 | 200 | 15.0 | 5 | 210 | 15.0 | 5 | This invention |
| 8 | 230 | 16.9 | 5 | 230 | 15.9 | 5 | This invention |
| 9 | 210 | 15.9 | 5 | 220 | 16.9 | 5 | This invention |
| 10 | 240 | 18.0 | 5 | 250 | 18.0 | 5 | This invention |
| 11 | 190 | 15.0 | 5 | 200 | 15.9 | 5 | This invention |
| 12 | 200 | 15.9 | 5 | 215 | 16.9 | 5 | This invention |
| 13 | 160 | 14.2 | 5 | 170 | 15.0 | 5 | This invention |
| 14 | 180 | 15.0 | 5 | 190 | 15.9 | 4 | This invention |
| 15 | 110 | 9.0 | 5 | 110 | 9.0 | 5 | Comparative example (No nucleating agent) |
| 16 | 130 | 10.8 | 5 | 140 | 11.7 | 3 | Comparative example |
| 17 | 140 | 13.5 | 4 | 150 | 14.2 | 2 | Comparative example |
| 18 | 130 | 13.5 | 5 | 130 | 14.2 | 3 | Comparative example |
| 19 | 200 | 15.9 | 5 | 210 | 15.0 | 5 | This invention |
| 20 | 220 | 15.9 | 5 | 220 | 15.9 | 4 | This invention |
| 21 | 220 | 15.9 | 5 | 220 | 16.9 | 5 | This invention |
| 22 | 240 | 18.0 | 5 | 250 | 19.3 | 4 | This invention |
| 23 | 220 | 15.9 | 5 | 230 | 16.9 | 5 | This invention |
| 24 | 250 | 19.3 | 5 | 250 | 19.3 | 4 | This invention |
| 25 | 200 | 15.9 | 5 | 200 | 15.9 | 5 | This invention |
| 26 | 220 | 16.9 | 5 | 220 | 18.0 | 4 | This invention |
| 27 | 180 | 15.0 | 5 | 190 | 15.0 | 4 | This invention |
| 28 | 210 | 15.0 | 4 | 220 | 15.9 | 4 | This invention |

The photographic sensitivity was expressed by a reciprocal of the exposure amount necessary for giving a density of 1.5, and shown by a relative value obtained by assuming the sensitivity of sample No. 1 at the Condition 1 being 100. With respect to the index (γ) for showing the contrast of an image, a point giving fog+density of 0.3 and a point giving fog +density of 3.0 on a characteristic curve were connected by a straight line and the gradient of the straight line was shown by the γ value.

The black spot was evaluated according to the five step evaluation system by observing with a loupe the non-image portion that is not an exposed area when the samples were processed at 35° C. for 30 seconds. The step 5 indicates no generation of the black spot and therefore the excellent level. In contrast, the step 1 indicates remarkable generation of the black spot and hence the worst level. The step 3 indicates a limit level at which generation of the black spot is allowable in a practical use.

The results in Table 2 show that according to the samples containing the quaternary salt compounds of the present invention as a nucleating agent, an ultrahigh contrast image having a γ value of 10 or more can be formed by processing with Developer (1) and further generation of the black spot reaches an excellent level even in the processing of Condition-2.

Example 2

(Preparation of Silver Halide Emulsion B)

An aqueous silver nitrate solution and an aqueous halogen salt solution containing potassium bromide, sodium chloride, $K_3IrCl_6$ corresponding to $1\times10^{-7}$ mol/mol-Ag and $(NH_4)_2Rh(H_2O)Cl_5$ corresponding to $4\times10^{-7}$ mol/mol-Ag were added to an aqueous solution containing sodium chloride and 1,3-dimethyl-2-imidazolidinethione, while stirring by a double jet method to prepare silver chlorobromide particles having an average particle size of 0.20 μm, and a silver chloride content of 70 mol %. Thus, a nucleation was performed. Continuously, an aqueous silver nitrate solution and an aqueous halogen salt solution containing potassium bromide, and sodium chloride were added by a double jet method in the same manner as the above.

Thereafter, a $1\times10^{-3}$ mol/mol-Ag of KI solution was added to perform conversion, and then the emulsion was washed with water by flocculation. 40 g/mol-Ag of gelatin was added thereto, then the pH and the pAg were adjusted to 6.0 and 7.5, respectively. Thereto, 7 mg/mol-Ag of sodium benzenethiosulfonate and 2 mg/mol-Ag of sodium benzenesulfinate, 8 mg/mol-Ag of chloroauric acid and 5 mg/mol-Ag of sodium thiosulfate were further added. The resulting mixture was subjected to chemical sensitization at 60° C. for 60 minutes. Then, 200 mg of 4-hydroxy-6-methyl-1,3,3a, 7-tetraazaindene as a stabilizer and 100 mg of PROXEL as an antiseptic were added to obtain Emulsion B. The resulting particles were silver iodochlorobromide cubic particles having an average particle size of 0.26 μm, a silver chloride content of 69.9% (coefficient of variation: 10%).

(Preparation of Coating Solution for Redox Compound-containing Layer Emulsion)

To Emulsion B prepared above, $4\times10^{-4}$ mol of the foregoing sensitizing dye (s) was added, per mol-Ag in the redox compound-containing layer emulsion. Further a triazine compound consisting of $5\times10^{-4}$ mol of the foregoing compound (a) and $2\times10^{-4}$ mol of the foregoing compound (c) were added, per mol-Ag in the redox compound-containing Layer emulsion, respectively. Further thereto, a dispersion of polyethyl acrylate and as a hardening agent 1,2-bis (vinylsulfonylacetoamido) ethane were added so as to give a coated amount of 100 mg/m$^2$ and 50 mg/m$^2$, respectively.

Then, an emulsified redox compound (1) was added to give an amount of $4.3\times10^{-3}$ mol/mol-Ag, in terms of the total silver amount in the light-sensitive material. Thus, a coating solution for the redox compound-containing layer emulsion was prepared. The resulting solution was adjusted to have a pH of 5.6.

(Preparation of Coating Solution for Interlayer)

To an aqueous gelatin solution, 5 mg /$m^2$ of sodium ethane thio sulfonate, 50 mg/$m^2$ of dye represented by the following (g), 100 mg/$m^2$ of hydroquinone, 10 mg/$m^2$ of 5-chloro-8-hydroxyquinoline and 100 mg/$m^2$ of a dispersion of polyethyl acrylate were added in terms of a coated amount to prepare a coating solution for an interlayer. Then, the resulting solution was adjusted to have a pH of 7.0.

(g)

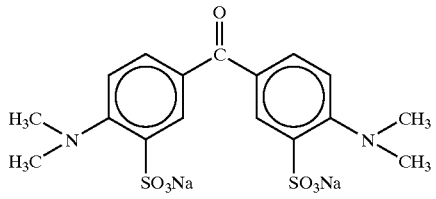

(Preparation of Samples)

On a polyethylene terephthalate film support undercoated by a moisture-proofing layer composed of vinylidene chloride, five layers composed of the UL layer of Example 1; the EM layer identical to the emulsion layer of Example 1, except for containing $8\times10^{-5}$ mol/$m^2$ hydrazine derivative (D-66) and a quaternary salt compound in the coated amount shown in Table 3 (Ag 3.4 g/$m^2$); the interlayer formed by coating the foregoing coating solution for the interlayer; the redox compound-containing layer formed by coating the foregoing coating solution for the redox compound-containing layer emulsion (Ag 0.3 g/$m^2$); and the foregoing OC layer of Example 1 were coated in this order from the support side to prepare samples.

Further, the same back layer as in Example 1 was used. Thus, samples shown in Table 3 were prepared.

The resulting samples were exposed to the light emitted from a tungsten light source through a step wedge in such a condition that a 150 lines/inch contact screen gray scanner negative No. 2 (trade name, manufactured by Dainippon Screen Mfg. Co., Ltd.) was brought into contact with the emulsion surface intimately.

Then, using the Developer (1) and the Fixing Solution, of Example 1, the samples were treated at 35° C. for 30 seconds in terms of a developing time with a FG-710F automatic developing machine (trade name, manufactured by Fuji Photo Film Co., Ltd.).

The dot gradation (logarithmic notation of the ratio of an exposure value giving a 95% dot area to an exposure value giving a 5% dot area) of the resulting dot image was measured. The larger the value is, the wider the latitude to exposure is and the better the reproducibility of the image is.

In addition, the dot was observed by a magnifier with a magnifying power of 100 to evaluate the quality of the formed dot.

The level "5" shows that the density of the dot is high and the sharpness of its edge is better whereas the level "1" shows that the dot is deteriorated in contrast and sharpness. The level "3" is a level of a dot quality practicablly accetable as for an original of a photomechanical process.

Table 3 shows that a dot image that is in long gradation and excels in dot quality itself, can be obtained by the samples of the present invention.

Example 3

Samples 1 to 28 shown in Table 4 were prepared in the same manner as in Example 1, except that as a hydrazine derivative $2.5\times10^{-3}$ mol of (D-66) was added, and that as a development accelerator, quaternary onium salt compounds represented by formula (A) or (B), or comparative compounds shown below (the Comparative compounds (a) and (b) in Table 4, are the same compounds as those used in Example 1, respectively) were added so as to give the coated amount shown in Table 4.

Comparative Compound (d)

(The Compound I-52 Described in JP-A-5-232615)

TABLE 3

| | Quaternary onium salt compound | | | | |
|---|---|---|---|---|---|
| Sample No. | Kinds | Addition amount (mol/$m^2$) | Dot gradation | Dot Quality | Remarks |
| 2-1 | None | 0 | 1.20 | 2 | Comparative example |
| 2-2 | Comparative Compound (a) | $1.2\times10^{-5}$ | 1.25 | 3 | Comparative example |
| 2-3 | Comparative Compound (b) | $1.2\times10^{-5}$ | 1.18 | 4 | Comparative example |
| 2-4 | Comparative Compound (c) | $1.2\times10^{-5}$ | 1.28 | 3 | Comparative example |
| 2-5 | I-31 | $1.2\times10^{-5}$ | 1.33 | 4 | This invention |
| 2-6 | I-32 | $1.2\times10^{-5}$ | 1.35 | 5 | This invention |
| 2-7 | I-33 | $1.2\times10^{-5}$ | 1.42 | 5 | This invention |
| 2-8 | 1-34 | $1.2\times10^{-5}$ | 1.39 | 4 | This invention |
| 2-9 | I-57 | $1.2\times10^{-5}$ | 1.33 | 4 | This invention |
| 2-10 | I-58 | $1.2\times10^{-5}$ | 1.38 | 5 | This invention |
| 2-11 | Il -39 | $1.2\times10^{-5}$ | 1.34 | 4 | This invention |
| 2-12 | I-31 | $0.6\times10^{-5}$ | 1.31 | 4 | This invention |
| 2-13 | I-32 | $0.6\times10^{-5}$ | 1.33 | 5 | This invention |
| 2-14 | I-33 | $0.6\times10^{-5}$ | 1.40 | 5 | This invention |
| 2-15 | I-58 | $0.6\times10^{-5}$ | 1.34 | 4 | This invention |

TABLE 4

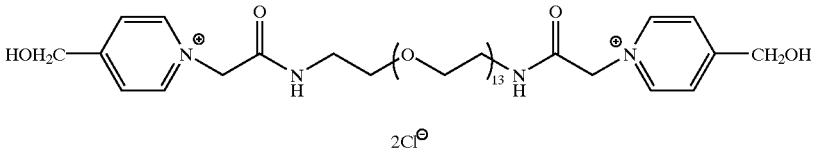

| Sample No. | Quaternary onium salt compound: Kinds | Quaternary onium salt compound: Addition amount (mol/m$^2$) | Remarks |
|---|---|---|---|
| 1 | None | 0 | Comparative example |
| 2 | Comparative compound (a) | $1.2 \times 10^{-5}$ | Comparative example |
| 3 | Comparative compound (b) | $1.2 \times 10^{-5}$ | Comparative example |
| 4 | Comparative compound (d) | $1.2 \times 10^{-5}$ | Comparative example |
| 5 | B-23 | $0.6 \times 10^{-5}$ | This invention |
| 6 | B-23 | $1.2 \times 10^{-5}$ | This invention |
| 7 | B-43 | $0.6 \times 10^{-5}$ | This invention |
| 8 | B-43 | $1.2 \times 10^{-5}$ | This invention |
| 9 | B-44 | $0.6 \times 10^{-5}$ | This invention |
| 10 | B-44 | $1.2 \times 10^{-5}$ | This invention |
| 11 | B-45 | $0.6 \times 10^{-5}$ | This invention |
| 12 | B-45 | $1.2 \times 10^{-5}$ | This invention |
| 13 | B-47 | $0.6 \times 10^{-5}$ | This invention |
| 14 | B-47 | $1.2 \times 10^{-5}$ | This invention |
| 15 | B-49 | $0.6 \times 10^{-5}$ | This invention |
| 16 | B-49 | $1.2 \times 10^{-5}$ | This invention |
| 17 | B-50 | $0.6 \times 10^{-5}$ | This invention |
| 18 | B-50 | $1.2 \times 10^{-5}$ | This invention |
| 19 | B-9 | $0.6 \times 10^{-5}$ | This invention |
| 20 | B-9 | $1.2 \times 10^{-5}$ | This invention |
| 21 | B-65 | $0.6 \times 10^{-5}$ | This invention |
| 22 | B-65 | $1.2 \times 10^{-5}$ | This invention |
| 23 | B-72 | $0.6 \times 10^{-5}$ | This invention |
| 24 | B-72 | $1.2 \times 10^{-5}$ | This invention |
| 25 | A-33 | $0.6 \times 10^{-5}$ | This invention |
| 26 | A-33 | $1.2 \times 10^{-5}$ | This invention |
| 27 | A-25 | $0.6 \times 10^{-5}$ | This invention |
| 28 | A-25 | $1.2 \times 10^{-5}$ | This invention |

Similarly to the foregoing Example 1, each of the samples thus prepared was subjected to exposure and processing (the same processing as in Example 1 according to the condition-1 and condition-2). Evaluation was also conducted in the same manner as in Example 1.

The results that were obtained are shown in Table 5.

TABLE 5

| Sample No. | Condition-1: Sensitivity | Condition-1: γ | Condition-1: Black spots | Condition-2: Sensitivity | Condition-2: γ | Condition-2: Black spots | Remarks |
|---|---|---|---|---|---|---|---|
| 1 | 100 | 9.0 | 5 | 95 | 8.5 | 5 | Comparative example (No nucleating agent) |
| 2 | 115 | 10.8 | 5 | 120 | 10.8 | 3 | Comparative example |
| 3 | 130 | 13.5 | 4 | 140 | 14.2 | 3 | Comparative example |
| 4 | 120 | 12.3 | 5 | 130 | 13.5 | 3 | Comparative example |
| 5 | 180 | 15.0 | 5 | 180 | 15.9 | 5 | This invention |
| 6 | 210 | 15.9 | 5 | 230 | 16.9 | 4 | This invention |
| 7 | 210 | 15.9 | 5 | 210 | 15.9 | 5 | This invention |
| 8 | 220 | 15.9 | 5 | 230 | 15.9 | 5 | This invention |
| 9 | 220 | 15.9 | 5 | 230 | 16.9 | 5 | This invention |
| 10 | 230 | 16.9 | 5 | 250 | 18.0 | 5 | This invention |
| 11 | 220 | 15.9 | 5 | 220 | 15.9 | 5 | This invention |
| 12 | 230 | 16.9 | 5 | 240 | 18.0 | 5 | This invention |
| 13 | 210 | 15.0 | 5 | 220 | 15.9 | 5 | This invention |
| 14 | 220 | 15.9 | 5 | 230 | 16.9 | 4 | This invention |
| 15 | 210 | 15.9 | 5 | 220 | 16.9 | 5 | This invention |
| 16 | 220 | 16.9 | 5 | 230 | 16.9 | 5 | This invention |
| 17 | 180 | 15.0 | 4 | 200 | 15.9 | 4 | This invention |
| 18 | 200 | 15.9 | 5 | 220 | 16.9 | 5 | This invention |
| 19 | 180 | 15.0 | 5 | 210 | 15.9 | 5 | This invention |
| 20 | 210 | 15.0 | 5 | 220 | 15.9 | 4 | This invention |

TABLE 5-continued

| Sample No. | Condition-1 Sensitivity | Condition-1 γ | Condition-1 Black spots | Condition-2 Sensitivity | Condition-2 γ | Condition-2 Black spots | Remarks |
|---|---|---|---|---|---|---|---|
| 21 | 200 | 15.9 | 5 | 220 | 16.9 | 5 | This invention |
| 22 | 210 | 15.9 | 5 | 230 | 15.9 | 4 | This invention |
| 23 | 180 | 15.0 | 5 | 200 | 15.9 | 5 | This invention |
| 24 | 200 | 15.9 | 5 | 220 | 16.9 | 4 | This invention |
| 25 | 190 | 15.9 | 5 | 200 | 15.9 | 5 | This invention |
| 26 | 200 | 15.9 | 5 | 220 | 18.0 | 4 | This invention |
| 27 | 180 | 15.0 | 5 | 190 | 15.0 | 4 | This invention |
| 28 | 210 | 15.0 | 4 | 220 | 15.9 | 4 | This invention |

The results in Table 5 show that according to the samples of the present invention containing a quaternary salt compounds represented by formula (A) or (B) as a nucleating agent, an ultrahigh contrast image having a γ value of 10 or more can be formed by processing with Developer (1) and further generation of the black spot reaches an excellent level even in the processing of Condition-2.

Example 4

Samples as shown in Table 6 were prepared in the same manner as in Example 2, except for using the quaternary onium salt as shown in Table 6. Evaluation was also conducted in the same manner as in Example 2.

TABLE 6

| Sample No. | Quaternary onium salt compound Kinds | Quaternary onium salt compound Addition amount (mol/m$^2$) | Dot gradation | Dot quality | Remarks |
|---|---|---|---|---|---|
| 2-1 | None | 0 | 1.20 | 2 | Comparative example |
| 2-2 | Comparative compound (a) | $1.2 \times 10^{-5}$ | 1.25 | 3 | Comparative example |
| 2-3 | Comparative compound (b) | $1.2 \times 10^{-5}$ | 1.18 | 4 | Comparative example |
| 2-4 | Comparative compound (c) | $1.2 \times 10^{-5}$ | 1.28 | 3 | Comparative example |
| 2-5 | B-43 | $1.2 \times 10^{-5}$ | 1.33 | 4 | This invention |
| 2-6 | B-44 | $1.2 \times 10^{-5}$ | 1.35 | 5 | This invention |
| 2-7 | B-45 | $1.2 \times 10^{-5}$ | 1.42 | 5 | This invention |
| 2-8 | B-47 | $1.2 \times 10^{-5}$ | 1.39 | 4 | This invention |
| 2-9 | B-49 | $1.2 \times 10^{-5}$ | 1.33 | 4 | This invention |
| 2-10 | B-51 | $1.2 \times 10^{-5}$ | 1.38 | 5 | This invention |
| 2-11 | B-9 | $1.2 \times 10^{-5}$ | 1.34 | 4 | This invention |
| 2-12 | B-65 | $0.6 \times 10^{-5}$ | 1.31 | 4 | This invention |
| 2-13 | B-23 | $0.6 \times 10^{-5}$ | 1.33 | 5 | This invention |
| 2-14 | A-33 | $0.6 \times 10^{-5}$ | 1.40 | 5 | This invention |
| 2-15 | A-25 | $0.6 \times 10^{-5}$ | 1.34 | 4 | This invention |

Table 6 shows that a dot image that is in long gradation and excels in dot quality itself, can be obtained by the samples of the present invention.

Having described our invention as related to the present embodiments, it is our intention that the invention not be limited by any of the details of the description, unless otherwise specified, but rather be construed broadly within its spirit and scope as set out in the accompanying claims.

What we claim is:

1. A silver halide photographic light-sensitive material comprising at least a light-sensitive silver halide emulsion layer applied on a support, wherein said emulsion layer or another hydrophilic colloidal layer comprises at least one kind of compounds selected from a group consisting of a quaternary nitrogen or phosphorus salt compound, having 20 or more of total recurring units consisting of an ethyleneoxy group and/or a propyleneoxy group in a molecule; a quaternary salt compound represented by the following formula (A); and a quaternary salt compound represented by the following formula (B):

formula (A)

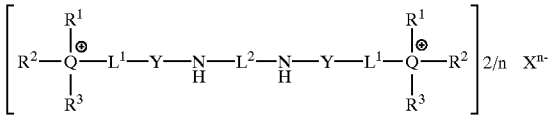

wherein Q represents a nitrogen atom or a phosphorus atom, $R^1$, $R^2$ and $R^3$ each independently represent an alkyl group, an aryl group, an alkenyl group, an alkynyl group, or a heterocyclic group, $L^1$ represents an alkylene group, Y represents —C (=O) or —$SO_2$—, $L^2$ represents a divalent connecting group having at least one hydrophilic group, $X^{n-}$ represents an n-valent counter anion, and n represents an integer of 1 to 3, provided that $X^{n-}$ can be omitted when another anionic group exists in a molecule and forms an intramolecular salt with $P^+$ or a quaternary nitrogen atom, formula (B)

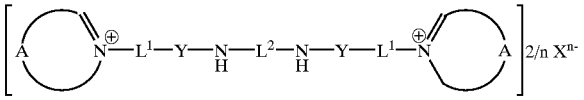

wherein A represents an organic moiety necessary to complete a nitrogen-containing aromatic heterocyclic ring, provided that the nitrogen-containing aromatic heterocyclic ring formed by A may have a substituent, but the substituent having thereon a primary hydroxyl group is excluded, $L^2$ represents a divalent connecting group having at least one hydrophilic group that divides $L^2$ into parts, and $L^1$, Y and $X^{n-}$ each have the same meanings as those of the formula (A).

2. The silver halide photographic light-sensitive material as claimed in claim 1, wherein the nitrogen-containing aromatic heterocyclic ring formed by A in the quaternary salt compound represented by formula (B) is 4-phenylpyridine, quinoline or isoquinoline.

3. A silver halide photographic light-sensitive material comprising at least a light-sensitive silver halide emulsion layer applied on a support, wherein said emulsion layer or another hydrophilic colloidal layer comprises at least one kind of compounds selected from a group consisting of a quaternary nitrogen or phosphorus salt compound, having 20 or more of total recurring units consisting of an ethyleneoxy group and/or a propyleneoxy group in a molecule; a quaternary salt compound represented by the following formula (A); and a quaternary salt compound represented by the following formula (B):

formula (A)

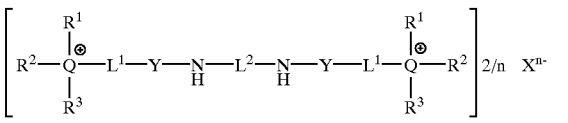

wherein Q represents a nitrogen atom or a phosphorus atom, $R^1$, $R^2$ and $R^3$ each independently represent an alkyl group, an aryl group, an alkenyl group, an alkynyl group, or a heterocyclic group, $L^1$ represents an alkylene group, Y represents —C (=O) or —$SO_2$—, $L^2$ represents a divalent connecting group having at least one hydrophilic group, $X^{n-}$ represents an n-valent counter anion, and n represents an integer of 1 to 3, provided that $X^{n-}$ can be omitted when another anionic group exists in a molecule and forms an intramolecular salt with $P^+$ or a quaternary nitrogen atom, formula (B)

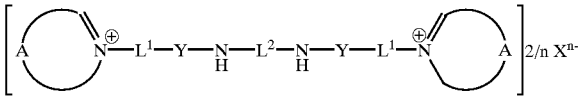

wherein A represents an organic moiety necessary to complete a nitrogen-containing aromatic heterocyclic ring, provided that the nitrogen-containing aromatic heterocyclic ring formed by A may have a substituent, but the substituent having thereon a primary hydroxyl group is excluded, and $L^1$, Y, $L^2$ and $X^{n-}$ each have the same meanings as those of the formula (A), wherein the quaternary nitrogen or phosphorus salt compound having the total of 20 or more recurring units consisting of an ethyleneoxy group and/or a propyleneoxy group in a molecule, is represented by any one of the following formulae (I) to (IV):

(I)

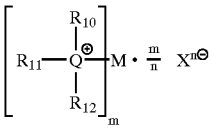

(II)

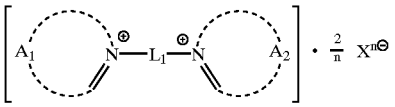

(III)

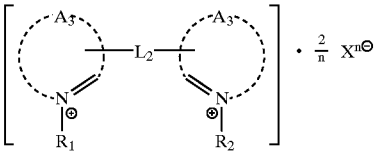

(IV)

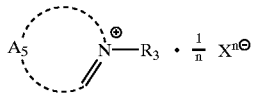

in formula (I), Q represents a nitrogen atom or a phosphorus atom, $R_{10}$, $R_{11}$ and $R_{12}$ each represent an aliphatic group, an aromatic group, or a heterocyclic group, these groups may combine with each other to form a ring structure, M represents an m-valent organic group in which a carbon atom bonds to $Q^+$, m represents an integer of 1 to 4;

in formulae (II), (III) and (IV), $A_1$, $A_2$, $A_3$, $A_4$ and $A_5$ each represent an organic moiety necessary to complete a quaternary nitrogen-containing unsaturated heterocyclic ring, $L_1$ and $L_2$ each represent a divalent connecting group, $R_1$, $R_2$ and $R_3$ each independently represent a substituent;

in formulae (I), (II), (III) and (IV), $X^{n-}$ represents an n-valent counter anion, n represents an integer of 1 to 3, provided that $X^{n-}$ can be omitted when another anionic group exists in a molecule and forms an intramolecular salt with $Q^+$ or a quaternary nitrogen atom;

the quaternary salts represented by formulae (I), (II), (III) and (IV) each have 20 or more of total recurring units consisting of an ethyleneoxy group and/or a propyleneoxy group in each of their molecules, said recurring units may be present at plural portions in the molecule.

4. The silver halide photographic light-sensitive material as claimed in claim 3, wherein the quaternary salt compound is a compound represented by the formula (II) or (III).

5. The silver halide photographic light-sensitive material as claimed in claim 4, wherein the quaternary nitrogen-containing unsaturated heterocyclic groups in the formula (II) or (III) are pyridine derivatives.

6. The silver halide photographic light-sensitive material as claimed in claim 5, wherein the pyridine derivatives are at least one kind of compounds selected from the group consisting of 4-phenylpyridines, quinolines, and isoquinolines.

7. The silver halide photographic light-sensitive material as claimed in claim 6, wherein the pyridine derivative is selected from 4-phenylpyridines.

8. The silver halide photographic light-sensitive material as claimed in claim 3, wherein said silver halide emulsion layer comprises at least one kind of hydrazine derivatives.

9. The silver halide photographic light-sensitive material as claimed in claim 8, wherein a second silver halide emulsion layer which is different from the first silver halide emulsion layer containing the hydrazine derivatives, or another hydrophilic colloidal layer, comprise a redox compound capable of releasing a development inhibitor by oxidization.

10. A processing method of a silver halide photographic light-sensitive material, which comprises processing the silver halide photographic light-sensitive material as claimed in claim 3 with a developing solution having a pH of less than 11.0, thereby forming an ultrahigh contrast negative image.

11. The silver halide photographic light-sensitive material as claimed in claim 8, wherein said at least one kind of hydrazine derivatives is represented by the following formula (D):

formula (D)

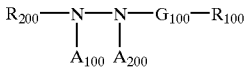

wherein $A_{100}$ and $A_{200}$ each represent a hydrogen atom; $G_{100}$ represents —CO— or —COCO—; $R_{100}$ represents a hydrogen atom or an alkyl group when $G_{100}$ is —CO—, or $R_{100}$ represents a substituted amino group when $G_{100}$ is —COCO—; and $R_{200}$ represent a substituted phenyl group whose substituent is a benzenesulfonamide group, and the benzene ring of the benzenesulfonamide group is further substituted directly or indirectly with a ballast group, a group adsorptive onto a silver halide, a group containing a quaternary ammonio group, a nitrogen-containing heterocyclic group having a quaternary nitrogen atom, a group containing a repeating unit of an ethyleneoxy group, an (alkyl, aryl or heterocyclic)thio group, a dissociating group dissociable by an alkaline developer, or a hydrazino group that can form a multimer.

12. The silver halide photographic light-sensitive material as claimed in claim 11, wherein a second silver halide emulsion layer which is different from the first silver halide emulsion layer containing the hydrazine derivatives, or another hydrophilic colloidal layer, comprise a redox compound capable of releasing a development inhibitor by oxidization.

13. A processing method of a silver halide photographic light-sensitive material, which comprises processing the silver halide photographic light-sensitive material as claimed in claim 12 with a developing solution having a pH of less than 11.0, thereby forming an ultrahigh contrast negative image.

14. The silver halide photographic light-sensitive material as claimed in claim 1, wherein said silver halide emulsion layer comprises at least one kind of hydrazine derivatives.

15. The silver halide photographic light-sensitive material as claimed in claim 14, wherein a second silver halide emulsion layer which is different from the first silver halide emulsion layer containing the hydrazine derivatives, or another hydrophilic colloidal layer, comprise a redox compound capable of releasing a development inhibitor by oxidization.

16. The silver halide photographic light-sensitive material as claimed in claim 14, wherein said at least one kind of hydrazine derivatives is represented by the following formula (D):

formula (D)

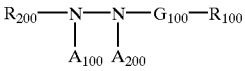

wherein $A_{100}$ and $A_{200}$ each represent a hydrogen atom; $G_{100}$ represents —CO— or —COCO—; $R_{100}$ represents a hydrogen atom or an alkyl group when $G_{100}$ is —CO—, or $R_{100}$ represents a substituted amino group when $G_{100}$ is —COCO—; and $R_{200}$ represent a substituted phenyl group whose substituent is a benzenesulfonamide group, and the benzene ring of the benzenesulfonamide group is further substituted directly or indirectly with a ballast group, a group adsorptive onto a silver halide, a group containing a quaternary ammonio group, a nitrogen-containing heterocyclic group having a quaternary nitrogen atom, a group containing a repeating unit of an ethyleneoxy group, an (alkyl, aryl or heterocyclic)thio group, a dissociating group dissociable by an alkaline developer, or a hydrazino group that can form a multimer.

17. The silver halide photographic light-sensitive material as claimed in claim 16, wherein a second silver halide emulsion layer which is different from the first silver halide emulsion layer containing the hydrazine derivatives, or another hydrophilic colloidal layer, comprise a redox compound capable of releasing a development inhibitor by oxidization.

18. A processing method of a silver halide photographic light-sensitive material, which comprises processing the silver halide photographic light-sensitive material as claimed in claim 17 with a developing solution having a pH of less than 11.0, thereby forming an ultrahigh contrast negative image.

19. A processing method of a silver halide photographic light-sensitive material, which comprises processing the silver halide photographic light-sensitive material as claimed in claim 1 with a developing solution having a pH of less than 11.0, thereby forming an ultrahigh contrast negative image.

* * * * *